US009557083B2

(12) United States Patent
Azuma et al.

(10) Patent No.: US 9,557,083 B2
(45) Date of Patent: Jan. 31, 2017

(54) AIR-CONDITIONING APPARATUS WITH MULTIPLE OPERATIONAL MODES

(75) Inventors: Koji Azuma, Tokyo (JP); Daisuke Shimamoto, Tokyo (JP); Osamu Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 387 days.

(21) Appl. No.: 14/115,018

(22) PCT Filed: May 23, 2012

(86) PCT No.: PCT/JP2012/003355

§ 371 (c)(1),
(2), (4) Date: Oct. 31, 2013

(87) PCT Pub. No.: WO2012/172731

PCT Pub. Date: Dec. 20, 2012

(65) Prior Publication Data

US 2014/0060105 A1 Mar. 6, 2014

(30) Foreign Application Priority Data

Jun. 16, 2011 (WO) ..... PCT/JP2011/003430

(51) Int. Cl.
*F25B 30/02* (2006.01)
*F25B 13/00* (2006.01)
(Continued)

(52) U.S. Cl.
CPC ..... *F25B 30/02* (2013.01); *F24F 3/065* (2013.01); *F24F 11/0076* (2013.01);
(Continued)

(58) Field of Classification Search
CPC .. F25B 30/02; F25B 25/005; F25B 2700/2106
See application file for complete search history.

(56) References Cited

U.S. PATENT DOCUMENTS 4,559,788 A * 12/1985 McFarlan ..... F24F 3/08 237/2 B
4,869,074 A * 9/1989 Hoshi ..... F24F 3/06 62/238.7

(Continued)

FOREIGN PATENT DOCUMENTS

EP 2476966 A1 7/2012
JP 05-280818 A 10/1993

(Continued)

OTHER PUBLICATIONS

Extended European Search Report mailed on Jun. 2, 2015 in the corresponding EP application No. 12800116.1.

(Continued)

*Primary Examiner* — Allen Flanigan
*Assistant Examiner* — Filip Zec
(74) *Attorney, Agent, or Firm* — Posz Law Group, PLC

(57) ABSTRACT

An air-conditioning apparatus has a heating only temporary operation mode in which, in changing from a heating main operation mode to a heating only operation mode, when an outside air temperature is at or above a predetermined temperature, at least one of heat exchangers functioning as a condenser in the heating main operation mode continues functioning as the condenser, and the refrigerant is not supplied to the intermediate heat exchanger functioning as an evaporator in the heating main operation mode and a cooling only temporary operation mode in which, in changing from a cooling main operation mode to a cooling only operation mode, when the outside air temperature is at or below a predetermined temperature, at least one of heat exchangers functioning as the evaporator in the cooling main operation mode continues functioning as the evaporator, and the refrigerant is not supplied to the intermediate (Continued)

heat exchanger functioning as the condenser in the cooling main operation mode.

26 Claims, 16 Drawing Sheets

(51) Int. Cl.

| | |
|---|---|
| ***F24F 11/02*** | (2006.01) |
| ***F24F 3/06*** | (2006.01) |
| ***F24F 11/00*** | (2006.01) |
| *F25B 25/00* | (2006.01) |

(52) U.S. Cl.
CPC ..... *F24F 11/02* (2013.01); *F25B 13/00* (2013.01); *F24F 2011/0064* (2013.01); *F25B 25/005* (2013.01); *F25B 2313/0231* (2013.01); *F25B 2313/0272* (2013.01); *F25B 2313/02334* (2013.01); *F25B 2313/02732* (2013.01); *F25B 2313/02741* (2013.01); *F25B 2700/2106* (2013.01)

(56) References Cited

U.S. PATENT DOCUMENTS

| | | | | |
|---|---|---|---|---|
| 5,237,833 | A * | 8/1993 | Hayashida | F24F 3/065 62/228.1 |
| 5,664,421 | A * | 9/1997 | Matsue | F24F 3/06 62/160 |
| 7,395,677 | B2 * | 7/2008 | Fujiyoshi | F24F 3/065 62/324.1 |
| 7,493,775 | B2 * | 2/2009 | Shimamoto | F24F 3/065 62/199 |
| 7,954,333 | B2 * | 6/2011 | Yoshimi | F24F 3/065 62/127 |
| 2007/0271936 | A1 * | 11/2007 | Wakamoto | F25B 7/00 62/160 |
| 2008/0271881 | A1 * | 11/2008 | Blecker | F24F 3/06 165/254 |
| 2011/0088421 | A1 * | 4/2011 | Wakamoto | F25B 13/00 62/238.7 |

FOREIGN PATENT DOCUMENTS

| | | | |
|---|---|---|---|
| JP | 2000-205683 | A | 7/2000 |
| JP | 2001-289465 | A | 10/2001 |
| JP | 2003-343936 | A | 12/2003 |
| JP | 2005-140444 | A | 6/2005 |
| JP | 2006-078026 | A | 3/2006 |
| WO | 2011-030429 | A1 | 3/2011 |
| WO | 2011/052042 | A1 | 5/2011 |

OTHER PUBLICATIONS

International Search Report of the International Searching Authority mailed Aug. 7, 2012 for the corresponding international application No. PCT/JP2012/003355 (with English translation).

* cited by examiner

FIG. 7

| PATTERN No. | OPERATION MODE OF OUTDOOR UNIT | | | | SECOND REFRIGERANT FLOW SWITCHING DEVICE 28a | EXPANSION DEVICE 26a | SECOND REFRIGERANT FLOW SWITCHING DEVICE 28b | EXPANSION DEVICE 26b | OPENING AND CLOSING DEVICE 29 | CONDITION EXAMPLE 1 | CONDITION EXAMPLE 2 |
|---|---|---|---|---|---|---|---|---|---|---|---|
| | COOLING ONLY | COOLING MAIN | HEATING MAIN | HEATING ONLY | | | | | | OUTSIDE AIR TEMPERATURE | WATER TEMPERATURE DIFFERENCE |
| 1 | ● | – | – | – | COOLING SIDE | SH CONTROL | COOLING SIDE | SH CONTROL | Close | Ta>28°C | NOT REQUIRED |
| 2 | ● | | | | COOLING SIDE | SH CONTROL | HEATING SIDE | FULL CLOSE | Close | Ta≦28°C | ※1 |
| 3 | – | ● | – | – | COOLING SIDE | FULL OPEN | HEATING SIDE | SC CONTROL | Close | NOT REQUIRED | NOT REQUIRED |
| 4 | – | – | ● | – | COOLING SIDE | FULL OPEN | HEATING SIDE | SC CONTROL | Close | NOT REQUIRED | NOT REQUIRED |
| 5 | – | – | – | ● | COOLING SIDE | FULL CLOSE | HEATING SIDE | SC CONTROL | Open | Ta≧-5°C | ※2 |
| 6 | | | | ● | HEATING SIDE | SC CONTROL | HEATING SIDE | SC CONTROL | Open | Ta<-5°C | NOT REQUIRED |

*1 SHIFTED TO PATTERN No. 1 WHEN 30 MIN. OR MORE ELAPSES FROM SHIFTING TO PATTERN No. 2 AND A WATER TEMPERATURE DIFFERENCE CANNOT BE ENSURED.
*2 SHIFTED TO PATTERN No. 6 WHEN 30 MIN. OR MORE ELAPSES FROM SHIFTING TO PATTERN No. 5 AND A WATER TEMPERATURE DIFFERENCE CANNOT BE ENSURED.

FIG. 9

| PATTERN No. | OPERATION MODE OF OUTDOOR UNIT | | | | SECOND REFRIGERANT FLOW SWITCHING DEVICE 28a | EXPANSION DEVICE 26a | SECOND REFRIGERANT FLOW SWITCHING DEVICE 28b | EXPANSION DEVICE 26b | OPENING AND CLOSING DEVICE 29 | CONDITION EXAMPLE 1 | | CONDITION EXAMPLE 2 |
|---|---|---|---|---|---|---|---|---|---|---|---|---|
| | | | | | | | | | | OPERATION CAPACITY OF INDOOR UNIT | | WATER TEMPERA-TURE DIFFERENCE |
| | COOLING ONLY | COOLING MAIN | HEATING MAIN | HEATING ONLY | | | | | | COOLING | HEATING | |
| 1 | ● | – | – | – | COOLING SIDE | SH CONTROL | COOLING SIDE | SH CONTROL | Close | Qa>50% LOAD | Qb=0% LOAD | NOT REQUIRED |
| 2 | ● | | | | COOLING SIDE | SH CONTROL | HEATING SIDE | FULL CLOSE | Close | Qa≦50% LOAD | Qb=0% LOAD | ※1 |
| 3 | – | ● | – | – | COOLING SIDE | FULL OPEN | HEATING SIDE | SC CONTROL | Close | NOT REQUIRED | NOT REQUIRED | NOT REQUIRED |
| 4 | – | – | ● | – | COOLING SIDE | FULL OPEN | HEATING SIDE | SC CONTROL | Close | NOT REQUIRED | NOT REQUIRED | NOT REQUIRED |
| 5 | – | – | – | ● | COOLING SIDE | FULL CLOSE | HEATING SIDE | SC CONTROL | Open | Qa=0% LOAD | Qb≦50% LOAD | ※2 |
| 6 | | | | ● | HEATING SIDE | SC CONTROL | HEATING SIDE | SC CONTROL | Open | Qa=0% LOAD | Qb>50% LOAD | NOT REQUIRED |

*1 SHIFTED TO PATTERN No. 1 WHEN 30 MIN. OR MORE ELAPSES FROM SHIFTING TO PATTERN No. 2 AND A WATER TEMPERATURE DIFFERENCE CANNOT BE ENSURED.
*2 SHIFTED TO PATTERN No. 6 WHEN 30 MIN. OR MORE ELAPSES FROM SHIFTING TO PATTERN No. 5 AND A WATER TEMPERATURE DIFFERENCE CANNOT BE ENSURED.

FIG. 11

| PATTERN No. | OPERATION MODE OF OUTDOOR UNIT | | | | SECOND REFRIGERANT FLOW SWITCHING DEVICE 28a | EXPAN-SION DEVICE 26a | SECOND REFRIGERANT FLOW SWITCHING DEVICE 28b | EXPAN-SION DEVICE 26b | OPENING AND CLOSING DEVICE 29 | CONDITION EXAMPLE 1 | | | | CONDITION EXAMPLE 2 |
|---|---|---|---|---|---|---|---|---|---|---|---|---|---|---|
| | COOLING ONLY | COOLING MAIN | HEATING MAIN | HEATING ONLY | | | | | | CONDITION EXAMPLE 1 OUTSIDE AIR TEMPERA-TURE | — | OPERATION CAPACITY OF INDOOR UNIT | | WATER TEMPERA-TURE DIFFERENCE |
| | | | | | | | | | | | | COOLING | HEATING | |
| 1 | ● | – | – | – | COOLING SIDE | SH CONTROL | COOLING SIDE | SH CONTROL | Close | Ta>28℃ | and | Qa>50% LOAD | Qb=0% LOAD | NOT REQUIRED |
| 2 | ● | | | | COOLING SIDE | SH CONTROL | HEATING SIDE | FULL CLOSE | Close | Ta≦28℃ | or | Qa≦50% LOAD | Qb=0% LOAD | ※1 |
| 3 | – | ● | – | – | COOLING SIDE | FULL OPEN | HEATING SIDE | SC CONTROL | Close | NOT REQUIRED | — | NOT REQUIRED | NOT REQUIRED | NOT REQUIRED |
| 4 | – | – | ● | – | COOLING SIDE | FULL OPEN | HEATING SIDE | SC CONTROL | Close | NOT REQUIRED | — | NOT REQUIRED | NOT REQUIRED | NOT REQUIRED |
| 5 | – | – | – | ● | COOLING SIDE | FULL CLOSE | HEATING SIDE | SC CONTROL | Open | Ta≧-5℃ | or | Qa=0% LOAD | Qb≦50% LOAD | ※2 |
| 6 | | | | ● | HEATING SIDE | SC CONTROL | HEATING SIDE | SC CONTROL | Open | Ta<-5℃ | and | Qa=0% LOAD | Qa>50% LOAD | NOT REQUIRED |

*1 SHIFTED TO PATTERN No. 1 WHEN 30 MIN. OR MORE ELAPSES FROM SHIFTING TO PATTERN No. 2 AND A WATER TEMPERATURE DIFFERENCE CANNOT BE ENSURED.
*2 SHIFTED TO PATTERN No. 6 WHEN 30 MIN. OR MORE ELAPSES FROM SHIFTING TO PATTERN No. 5 AND A WATER TEMPERATURE DIFFERENCE CANNOT BE ENSURED.

FIG. 13

| PATTERN No. | OPERATION MODE OF OUTDOOR UNIT | | | | SECOND REFRIGERANT FLOW SWITCHING DEVICE 28a | EXPANSION DEVICE 26a | SECOND REFRIGERANT FLOW SWITCHING DEVICE 28b | EXPANSION DEVICE 26b | OPENING AND CLOSING DEVICE 29 | CONDITION EXAMPLE WATER TEMPERATURE DIFFERENCE |
|---|---|---|---|---|---|---|---|---|---|---|
| | COOLING ONLY | COOLING MAIN | HEATING MAIN | HEATING ONLY | | | | | | |
| 1 | ● | – | – | – | COOLING SIDE | SH CONTROL | COOLING SIDE | SH CONTROL | Close | NOT REQUIRED |
| 2 | ● | | | | COOLING SIDE | SH CONTROL | HEATING SIDE | FULL CLOSE | Close | ※1 |
| 3 | – | ● | – | – | COOLING SIDE | FULL OPEN | HEATING SIDE | SC CONTROL | Close | NOT REQUIRED |
| 4 | – | – | ● | – | COOLING SIDE | FULL OPEN | HEATING SIDE | SC CONTROL | Close | NOT REQUIRED |
| 5 | – | – | – | ● | COOLING SIDE | FULL CLOSE | HEATING SIDE | SC CONTROL | Open | ※2 |
| 6 | | | | ● | HEATING SIDE | SC CONTROL | HEATING SIDE | SC CONTROL | Open | NOT REQUIRED |

*1 SHIFTED TO PATTERN No. 1 WHEN 30 MIN. OR MORE ELAPSES FROM SHIFTING TO PATTERN No. 2 AND A WATER TEMPERATURE DIFFERENCE CANNOT BE ENSURED.
*2 SHIFTED TO PATTERN No. 6 WHEN 30 MIN. OR MORE ELAPSES FROM SHIFTING TO PATTERN No. 5 AND A WATER TEMPERATURE DIFFERENCE CANNOT BE ENSURED.

FIG. 15

| PATTERN No. | OPERATION MODE OF OUTDOOR UNIT | | | | SECOND REFRIGERANT FLOW SWITCHING DEVICE 28a | EXPANSION DEVICE 26a | SECOND REFRIGERANT FLOW SWITCHING DEVICE 28b | EXPANSION DEVICE 26b | OPENING AND CLOSING DEVICE 29 | CONDITION EXAMPLE 1 | CONDITION EXAMPLE 2 |
|---|---|---|---|---|---|---|---|---|---|---|---|
| | COOLING ONLY | COOLING MAIN | HEATING MAIN | HEATING ONLY | | | | | | OUTSIDE AIR TEMPERATURE | WATER TEMPERATURE DIFFERENCE |
| 1 | ● | – | – | – | COOLING SIDE | SH CONTROL | COOLING SIDE | SH CONTROL | Close | Ta>28°C | NOT REQUIRED |
| 2 | ● | | | | COOLING SIDE | SH CONTROL | HEATING SIDE | FULL CLOSE | Close | Ta≦28°C | ※1 |
| 3 | – | ● | – | – | COOLING SIDE | FULL OPEN | HEATING SIDE | SC CONTROL | Close | NOT REQUIRED | NOT REQUIRED |
| 4 | – | – | ● | – | COOLING SIDE | FULL OPEN | HEATING SIDE | SC CONTROL | Close | NOT REQUIRED | NOT REQUIRED |
| 5 | – | – | – | ● | COOLING SIDE | FULL CLOSE | HEATING SIDE | SC CONTROL | Open | Ta≧-5°C | ※2 |
| 6 | | | | ● | HEATING SIDE | SC CONTROL | HEATING SIDE | SC CONTROL | Open | Ta<-5°C | NOT REQUIRED |

*1 SHIFTED TO PATTERN No. 1 WHEN 30 MIN. OR MORE ELAPSES FROM SHIFTING TO PATTERN No. 2 AND A WATER TEMPERATURE DIFFERENCE CANNOT BE ENSURED.
*2 SHIFTED TO PATTERN No. 6 WHEN 30 MIN. OR MORE ELAPSES FROM SHIFTING TO PATTERN No. 5 AND A WATER TEMPERATURE DIFFERENCE CANNOT BE ENSURED.

AIR-CONDITIONING APPARATUS WITH MULTIPLE OPERATIONAL MODES

CROSS REFERENCE TO RELATED APPLICATIONS

This application is a U.S. national stage application of PCT/JP2012/003355 filed on May 23, 2013, which claims priority to PCT application no. PCT/JP2011/003430 filed on Jun. 16, 2011, the disclosures of which are incorporated herein by reference.

TECHNICAL FIELD

The present invention relates to an air-conditioning apparatus applied to, for example, a multi-air-conditioning device for buildings.

BACKGROUND

There is an air-conditioning apparatus in which a heat source unit (outdoor unit) is arranged outside a construction and indoor units are arranged inside the construction, such as a multi-air-conditioning device for buildings. A refrigerant circulating in a refrigerant circuit in such an air-conditioning apparatus transfers (removes) heat to (from) air to be supplied to a heat exchanger in an indoor unit, thereby heating or cooling the air. The heated or cooled air is sent to an air-conditioned space so that the space is heated or cooled.

As a heat source side refrigerant for use in such an air-conditioning apparatus, a hydrofluorocarbon (HFC)-based refrigerant is used in many cases. As the heat source side refrigerant, a refrigerant using a natural refrigerant, such as carbon dioxide ($CO_2$), has also been proposed.

As an air-conditioner, one configured to include a plurality of indoor units, each of which is capable of selecting heating operation or cooling operation is proposed (see, for example, Patent Literature 1). The technique described in Patent Literature 1 has a cooling only mode, in which all indoor units perform cooling operation, a heating only mode, in which all indoor units perform heating operation, a heating main mode in simultaneous cooling and heating as simultaneous cooling and heating operation with the larger heating load, and a cooling main mode in simultaneous cooling and heating as simultaneous cooling and heating operation with a larger cooling load. The technique described in Patent Literature 1 switches between the heating only mode and the heating main mode in simultaneous cooling and heating or between the cooling only mode and the cooling main mode in simultaneous cooling and heating by switching one of a plurality of four-way valves.

There also exists an air-conditioning apparatus having another configuration typified by a chiller system. In such an air-conditioning apparatus, a heat source unit arranged outside a room generates cooling energy or heating energy, a heat exchanger arranged inside an outdoor unit heats or cools a heat medium, such as water or an antifreeze solution, the heat medium is transported to a fan coil unit, a panel heater, or the like that is an indoor unit arranged in an air-conditioned space, and cooling or heating is performed (see, for example, Patent Literature 2).

There also exists a heat source side heat exchanger called an exhaust heat recovery chiller in which four water pipes are connected between a heat source unit and an indoor unit, cooled water and heated water and the like are simultaneously supplied, and cooling or heating can be freely selected in the indoor unit (see, for example, Patent Literature 3).

There also exists an air-conditioning apparatus in which a heat exchanger for a primary refrigerant and a heat exchanger for a secondary refrigerant are arranged in the vicinity of each indoor unit and the secondary refrigerant is transported to the indoor unit (see, for example, Patent Literature 4).

There also exists an air-conditioning apparatus in which two pipes are connected between an outdoor unit and a branch unit including a heat exchanger and a secondary refrigerant is transported to an indoor unit (see, for example, Patent Literature 5).

PATENT LITERATURE

Patent Literature 1: Japanese Unexamined Patent Application Publication No. 2006-78026 (for example, FIGS. 1 and 2)

Patent Literature 2: Japanese Unexamined Patent Application Publication No. 2005-140444 (for example, page 4 and FIG. 1)

Patent Literature 3: Japanese Unexamined Patent Application Publication No. 5-280818 (for example, pages 4 and 5 and FIG. 1)

Patent Literature 4: Japanese Unexamined Patent Application Publication No. 2001-289465 (for example, pages 5 to 8 and FIGS. 1 and 2)

Patent Literature 5: Japanese Unexamined Patent Application Publication No. 2003-343936 (for example, page 5 and FIG. 1)

The technique described in Patent Literature 1 switches the operation mode between the heating only mode and the heating main mode in simultaneous cooling and heating or the operation mode between the cooling only mode and the cooling main mode in simultaneous cooling and heating by the use of the four-way valves. Accordingly, if a load required by an indoor unit frequently changes during heating operation of the air-conditioning apparatus, switching between the heating only mode and the heating main mode in simultaneous cooling and heating frequently occurs. If a load required by an indoor unit frequently changes during cooling operation of the air-conditioning apparatus, switching between the cooling only mode and the cooling main mode in simultaneous cooling and heating also frequently occurs.

If switching between the heating only mode and the heating main mode in simultaneous cooling and heating or switching between the cooling only mode and the cooling main mode in simultaneous cooling and heating frequently occurs, as described above, the frequency of switching the four-way valves in accordance with the operation mode is also high correspondingly, and the four-way valves may wear out and deteriorate. In addition, the increased number of switching the four-way valves leads to an increase in the time of variations in refrigerant pressure occurring in switching the four-way valves.

Furthermore, the increased number of switching the four-way valves results in an increase in the frequency of occurrence of switching sounds. If the four-way valves, which are frequently switched, are placed in the vicinity of a room, the switching sounds tend to leak to the room, and this may reduce the comfort of users.

The techniques described in Patent Literatures 2 and 3 heat or cool a heat medium in a heat source unit outside a construction and transport it to an indoor unit side. That is, because the heat source unit and the indoor unit are connected by heat-medium piping, the circulation path is extended correspondingly. Here, when the heat medium is compared with a heat source side refrigerant, the amount of energy consumption caused by a transport power to transport heat for performing a work of predetermined heating or cooling is large. Accordingly, for the techniques described in Patent Literatures 2 and 3, the extended circulation path for the heat medium results in a significant increase in the transport power.

The technique described in Patent Literature 3 is the one that includes a plurality of indoor units and connects an indoor side and an outdoor side using four pipes to enable cooling or heating to be selectable in each of these indoor units. The technique described in Patent Literature 5 is the one having a configuration that is similar to a system in which an outdoor unit and a branch unit are connected by four pipes as a result of the fact that the branch unit and an extended pipe are connected by a total of four pipes consisting of two cooling pipes and two heating pipes.

In this manner, the techniques described in Patent Literatures 3 and 5 need to connect from the outdoor side to the indoor side by four pipes, and thus Workability in constructing work was not very satisfactory.

The technique described in Patent Literature 4 is the one including pumps for transporting a heat medium mounted on individual indoor units. Because of this, the technique described in Patent Literature 4 is not only an expensive system whose cost is increased in accordance with the number of the pumps, but also produces loud noise caused by the pumps. Thus this technique is not practical.

In addition, because a heat exchanger through which a refrigerant passes is arranged in the vicinity of an indoor unit, the refrigerant may leak inside or in the vicinity of a room.

The technique described in Patent Literature 5 is the one in which a primary refrigerant after heat exchange enters the same flow as that for the primary refrigerant before the heat exchange. Therefore, when a plurality of indoor units are connected, each of the indoor units cannot achieve the maximum performance. Thus this technique is a configuration that is wasteful in terms of energy.

SUMMARY

The present invention is made to solve at least one of the above problems, and it is a first object of the invention to provide an air-conditioning apparatus with operation reliability improved by a reduction in abrasion caused by switching of four-way valves and a reduction in refrigerant variations resulting from the switching, the reductions achieved by a reduction in the number of switching the four-way valves.

It is a second object of the invention to provide an air-conditioning apparatus that suppresses a decrease in user comfort even when four-way valves for switching the operation mode between a heating only operation mode and a heating main operation mode in simultaneous cooling and heating or between a cooling only operation mode and a cooling main operation mode in simultaneous cooling and heating is disposed in the vicinity of a room by a reduction in the number of switching the four-way valves.

Solution to Problem

An air-conditioning apparatus according to the present invention includes an outdoor unit, a relay unit, and at least one indoor unit. The outdoor unit includes a compressor, a first refrigerant flow switching device, and a heat source side heat exchanger. The relay unit includes a plurality of intermediate heat exchangers, a plurality of expansion devices, and a plurality of second refrigerant flow switching devices. The indoor unit includes a use side heat exchanger. The compressor, the first refrigerant flow switching device, the expansion devices, the second refrigerant flow switching devices, and the intermediate heat exchangers are connected by a refrigerant pipe to form a refrigeration cycle. The intermediate heat exchangers and the use side heat exchanger are connected by a heat medium pipe to form a heat medium circulation circuit through which a heat medium different from the refrigerant circulates. The air-conditioning apparatus switches the second refrigerant flow switching devices corresponding to the intermediate heat exchangers and causes each of the intermediate heat exchangers to function as a condenser or an evaporator. The air-conditioning apparatus has a heating only operation mode in which all the intermediate heat exchangers function as condensers, a heating main operation mode in which at least one of the intermediate heat exchangers functions as the condenser, at least one thereof functions as the evaporator, and a heating load is larger than a cooling load, a heating only temporary operation mode in which, in changing from the heating main operation mode to the heating only operation mode, when an outside air temperature is at or above a predetermined temperature, at least one of the intermediate heat exchangers functioning as the condenser in the heating main operation mode continues functioning as the condenser, and the refrigerant is not supplied to the intermediate heat exchanger functioning as the evaporator in the heating main operation mode, a cooling only operation mode in which all the intermediate heat exchangers function as evaporators, a cooling main operation mode in which at least one of the intermediate heat exchangers functions as the evaporator, at least one thereof functions as the condenser, and the cooling load is larger than the heating load, and a cooling only temporary operation mode in which, in changing from the cooling main operation mode to the cooling only operation mode, when the outside air temperature is at or below a predetermined temperature, at least one of the intermediate heat exchangers functioning as the evaporator in the cooling main operation mode continues functioning as the evaporator, and the refrigerant is not supplied to the intermediate heat exchanger functioning as the condenser in the cooling main operation mode.

According to the air-conditioning apparatus of the present invention, because the number of switching the four-way valves (second flow switching devices) in accordance with the operation mode can be reduced, degradation caused by operations of the four-way valves can be reduced, the number of variations in the refrigerant resulting from the switching can be reduced, and the operation reliability of the air conditioner can be improved. A reduction in the number of switching the four-way valves can reduce the frequency of occurrence of switching sounds correspondingly. Thus even if the four-way valves are disposed in the vicinity of the inside of a room, a decrease in the comfort of users can be suppressed.

BRIEF DESCRIPTION OF DRAWINGS

FIG. 7 is a table that describes switching of a second refrigerant flow switching device illustrated in FIG. 2 and the opening degree of an expansion device for each operation mode.

FIG. 9 is a table that describes switching of the second refrigerant flow switching device, the opening degree of the expansion device, and the operation capacity of an indoor unit for each operation mode in the air-conditioning apparatus according to Embodiment 2 of the present invention.

FIG. 11 is a table that describes switching of the second refrigerant flow switching device, the opening degree of the expansion device, and the operation capacity of the indoor unit for each operation mode in the air-conditioning apparatus according to Embodiment 3 of the present invention.

FIG. 13 is a table that describes switching of the second refrigerant flow switching device and the opening degree of the expansion device for each operation mode in the air-conditioning apparatus according to Embodiment 4 of the present invention.

FIG. 15 is a table that describes switching of the second refrigerant flow switching device, the opening degree of the expansion device, and the operation capacity of an indoor unit for each operation mode in the air-conditioning apparatus according to Embodiment 5 of the present invention.

DETAILED DESCRIPTION

Embodiments of the present invention will be described below with reference to the drawings.

Embodiment 1

Figure 1:
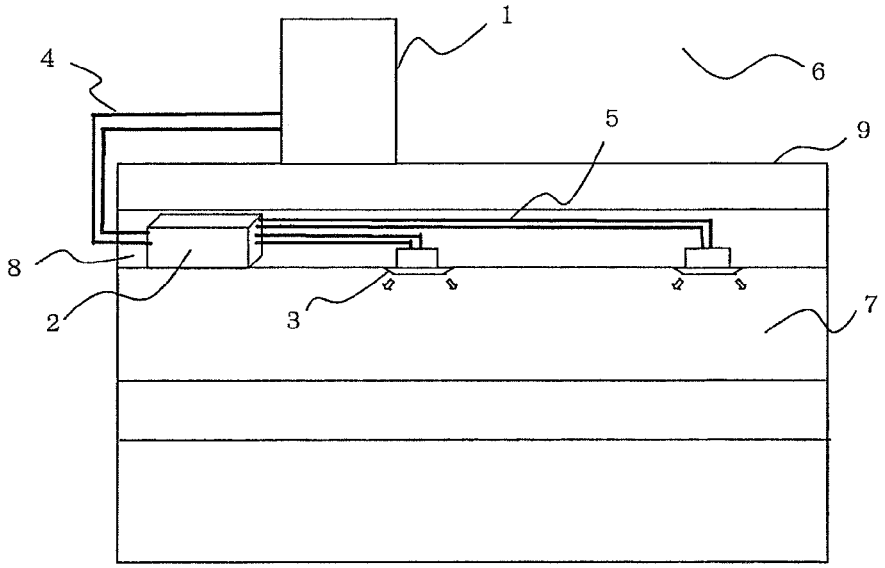
FIG. 1 is a schematic diagram that illustrates a placement example of an air-conditioning apparatus according to Embodiment 1 of the present invention.

FIG. 1 is a schematic diagram that illustrates a placement example of an air-conditioning apparatus according to Embodiment 1 of the present invention.

As illustrated in FIG. 1, the air-conditioning apparatus according to Embodiment 1 of the present invention includes an outdoor unit (heat source unit) 1, a plurality of indoor units 3, and a single relay unit 2 disposed between the outdoor unit 1 and the indoor units 3. The relay unit 2 exchanges heat between a heat source side refrigerant and a heat medium. The outdoor unit 1 and the relay unit 2 are connected by refrigerant pipes 4 through which the heat source side refrigerant passes. The relay unit 2 and the indoor units 3 are connected by heat medium pipes 5 through which the heat medium passes. Cooling energy or heating energy produced by the outdoor unit 1 is delivered to the indoor units 3 through the relay unit 2.

The outdoor unit 1 is typically arranged in an outdoor space 6 being a space outside a construction 9 such as a building (e.g., a space above a roof) and supplies cooling energy or heating energy to each of the indoor units 3 through the relay unit 2. The indoor unit 3 is arranged in a position where it can supply air for cooling or air for heating to an indoor space 7 being a space inside the construction 9 (e.g., room) and supplies the air for cooling or the air for heating to the indoor space 7 being an air-conditioned space.

The relay unit 2 conveys heating energy or cooling energy produced by the outdoor unit 1 to the indoor unit 3. The relay unit 2 is configured such that it can be placed in a position different from the outdoor space 6 and the indoor space 7 as a unit having a casing different from that of the outdoor unit 1 and the indoor unit 3. The relay unit 2 is connected to the outdoor unit 1 through the refrigerant pipes 4 and is connected to the indoor units 3 through the heat medium pipes 5.

The heat source side refrigerant is transported from the outdoor unit 1 to the relay unit 2 through the refrigerant pipe 4. The transported heat source side refrigerant exchanges heat with the heat medium in an intermediate heat exchanger in the relay unit 2 (described later) and heats or cools the heat medium. That is, the heat medium is heated or cooled in the intermediate heat exchanger and thus becomes hot water or cold water. The hot water or cold water made in the relay unit 2 is transported by a heat medium transport device (describe later) through the heat medium pipe 5 to the indoor unit 3 and is used in heating operation or cooling operation for the indoor space 7 in the indoor unit 3.

Examples of the heat source side refrigerant can include a single refrigerant, such as R-22 or R-134a, a near-azeotropic refrigerant mixture, such as R-410A or R-404A, azeotropic refrigerant mixture, such as R-407C, a refrigerant that contains a double bond in its chemical formula and that has a relatively small global warming potential value, such as $CF_3$ or $CF{=}CH_2$, a mixture thereof, and a natural refrigerant, such as $CO_2$ or propane.

Examples of the heat medium can include water, antifreeze solution, a mixture of water and antifreeze solution, and a mixed solution of water and an additive having a high anti-corrosive effect. An air-conditioning apparatus 100 according to Embodiment 1 is described on the assumption that water is used as the heat medium.

As illustrated in FIG. 1, in the air-conditioning apparatus according to Embodiment 1, the outdoor unit 1 and the relay unit 2 are connected using the two refrigerant pipes 4, and the relay unit 2 and each of the indoor units 3 are connected using the two heat medium pipes 5. In this manner, for the air-conditioning apparatus according to Embodiment 1, connecting the units (outdoor unit 1, relay unit 2, and indoor unit 3) using two pipes (refrigerant pipes 4, heat medium pipes 5) facilitates its construction.

FIG. 1 illustrates, as an example, the state where the relay unit 2 is disposed in a space that is inside the construction 9 but different from the indoor space 7, such as a space above a ceiling, (hereinafter referred to simply as space 8). The relay unit 2 can also be disposed in a common space, such as the one where an elevator is located. FIG. 1 illustrates, as an example, the case where the indoor unit 3 is of a ceiling cassette type. The indoor unit 3 is not limited to this type and may be of any type that can blow air for heating or air for cooling to the indoor space 7 directly or using a duct, such as a ceiling concealed type or a ceiling suspended type.

FIG. 1 illustrates, as an example, the case where the outdoor unit 1 is disposed in the outdoor space 6. However, the invention is not limited to this case. For example, the outdoor unit 1 may be disposed in a surrounded space, such as a machine room with an air vent. If waste heat can be ejected outside the construction 9 through an exhaust duct, the outdoor unit 1 may be disposed inside the construction 9. If the outdoor unit 1 is of a water-cooled type, it may be disposed inside the construction 9. Even if the outdoor unit 1 is disposed in such locations, no particular problem occurs.

The relay unit 2 may be disposed in the vicinity of the outdoor unit 1. When the relay unit 2 is disposed in the vicinity of the outdoor unit 1, the length of the heat medium pipe 5 connecting from the relay unit 2 to the indoor unit 3 may be noted. This is because, if the distance from the relay unit 2 to the indoor unit 3 is long, the power for transporting the heat medium is large correspondingly, and the energy saving effect is low.

In addition, the number of the outdoor unit 1, relay unit 2, and indoor units 3 being connected is not limited to the number illustrated in FIG. 1, and may be determined in accordance with the construction 9 where the air-conditioning apparatus according to Embodiment 1 is disposed.

When a plurality of relay units 2 are connected to a single outdoor unit 1, the plurality of relay units 2 can be interspersed in a space, such as a common space or a space above a ceiling, in a construction, such as a building. This enables the intermediate heat exchanger in each relay unit 2 to provide an air conditioning load. The indoor unit 3 can be disposed at a distance or height within a transport possible area of the heat medium transport device in each relay unit 2, and the indoor units 3 can be arranged throughout a construction, such as a building.

Figure 2:
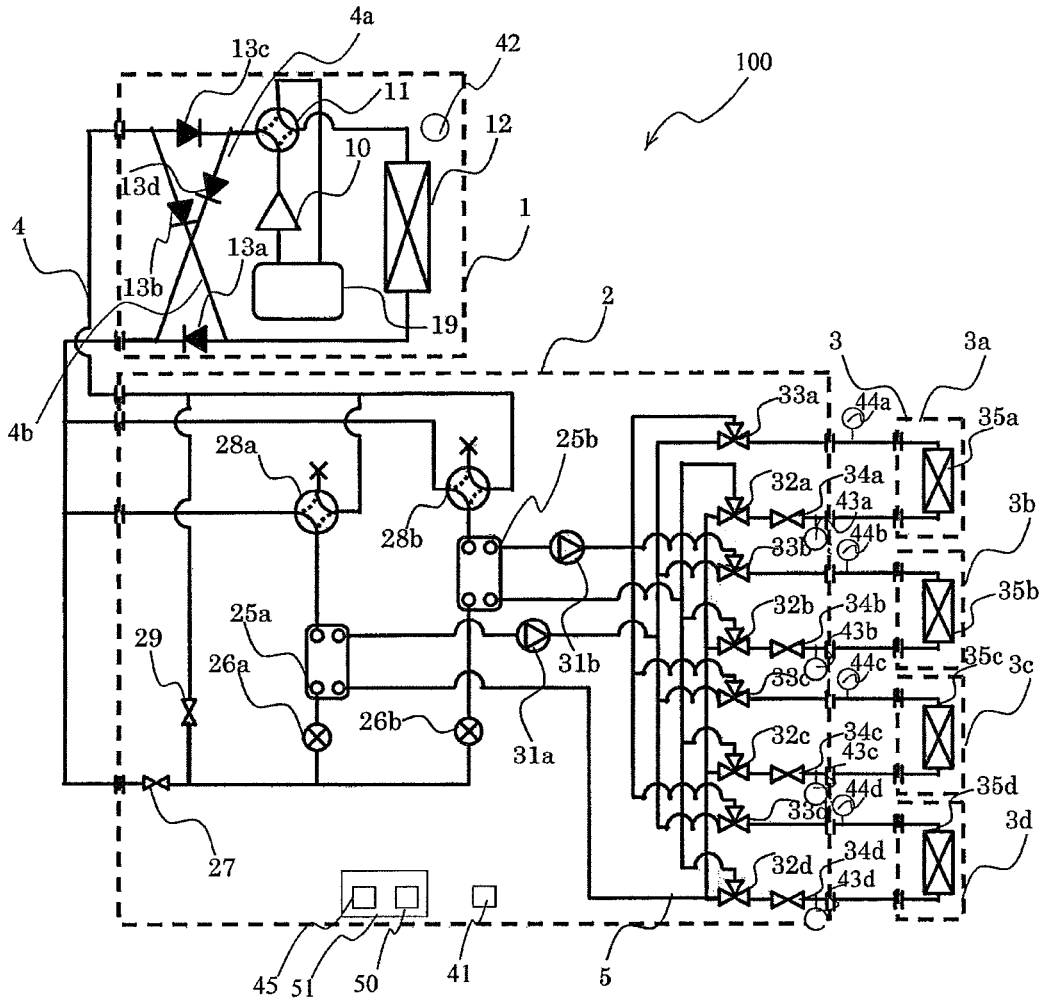
FIG. 2 illustrates an example of a refrigerant circuit configuration in the air-conditioning apparatus according to Embodiment 1 of the present invention.

FIG. 2 illustrates an example of a refrigerant circuit configuration in the air-conditioning apparatus 100 according to Embodiment 1 of the present invention. As illustrated in FIG. 2, the outdoor unit 1 and the relay unit 2 are connected by the refrigerant pipes 4 through intermediate heat exchangers 25*a* and 25*b* included in the relay unit 2. The relay unit 2 and the indoor unit 3 are connected by the heat medium pipes 5 through the intermediate heat exchangers 25*a* and 25*b*. That is, the intermediate heat exchangers 25*a* and 25*b* exchange heat between the heat source side refrigerant supplied through the refrigerant pipe 4 and the heat medium supplied through the heat medium pipe 5. The refrigerant pipe 4 and heat medium pipe 5 are described later.

The air-conditioning apparatus 100 according to Embodiment 1 includes a refrigerant circuit A being a refrigeration cycle that circulates the heat source side refrigerant and a heat medium circulation circuit B that circulates the heat medium and allows all of the indoor units 3 to select a cooling operation or a heating operation.

Here, a mode in which all of the running indoor units 3 perform a heating operation is referred to as a heating only operation mode, a mode in which all of the running indoor units 3 perform a cooling operation is referred to as a cooling only operation mode, and a mode in which there coexist an indoor unit 3 performing a cooling operation and an indoor unit 3 performing a heating operation is referred to as a cooling and heating mixed operation mode. The cooling and heating mixed operation mode includes a cooling main operation mode with a larger cooling load and a heating main operation mode with the larger heating load.

The air-conditioning apparatus 100 further has a cooling only temporary operation mode and a heating only temporary operation mode. The heating only temporary operation mode is an operation mode in which, at the time of changing from the heating main operation mode to the heating only operation mode, when an outside air temperature is equal to or higher than a predetermined temperature, at least one intermediate heat exchanger 25 functioning as a condenser in heating main operation mode continues functioning as the condenser and no refrigerant is supplied to an intermediate heat exchanger functioning as an evaporator in heating main operation mode. The cooling only temporary operation mode is an operation mode in which, at the time of changing from the cooling main operation mode to the cooling only operation mode, when an outside air temperature is equal to or higher than a predetermined temperature, at least one intermediate heat exchanger 25 functioning as an evaporator in cooling main operation mode continues functioning as the evaporator and no refrigerant is supplied to an intermediate heat exchanger 25 functioning as a condenser in cooling main operation mode.

[Outdoor Unit 1]

The outdoor unit 1 includes a compressor 10, a first refrigerant flow switching device 11, for example, a four-way valve, a heat source side heat exchanger 12, and an accumulator 19 connected by the refrigerant pipes 4. The outdoor unit 1 is equipped with a first connection pipe 4*a*, a second connection pipe 4*b*, and check valves 13*a* to 13*d*. The equipping of the first connection pipe 4*a*, second connection pipe 4*b*, and check valves 13*a* to 13*d* enables the air-conditioning apparatus 100 to have a unidirectional stream of the heat source side refrigerant to be supplied from the outdoor unit 1 to the relay unit 2 for each of the heating only operation mode and the cooling only operation mode.

The compressor 10 sucks a refrigerant, compresses the refrigerant to put it in a high-temperature and high-pressure state, and transports it to the refrigerant circuit A. The discharge side of this compressor 10 is connected to the first refrigerant flow switching device 11, and the suction side thereof is connected to the accumulator 19. The compressor 10 may comprise an inverter compressor capable of controlling its capacity.

The first refrigerant flow switching device 11 connects the discharge side of the compressor 10 and the check valve 13*d* and connects the heat source side heat exchanger 12 and the suction side of the accumulator 19 in heating only operation mode and in heating main operation mode of the cooling and heating mixed operation mode. The first refrigerant flow switching device 11 connects the discharge side of the compressor 10 and the heat source side heat exchanger 12 and connects the check valve 13*c* and the suction side of the accumulator 19 in cooling only operation mode and in cooling main operation mode of the cooling and heating mixed operation mode. The first refrigerant flow switching device 11 may comprise a four-way valve.

The heat source side heat exchanger 12 functions as an evaporator in heating operation, functions as a condenser (or radiator) in cooling operation, exchanges heat between a fluid of air supplied from an air-sending device (not illustrated), such as a fan, and a heat source side refrigerant, and evaporates and gasifies the heat source side refrigerant or condenses and liquefies it. In heating operation mode, one side of the heat source side heat exchanger 12 is connected to the check valve 13*b*, and the other side thereof is connected to the suction side of the accumulator 19. In cooling operation mode, one side of the heat source side heat exchanger 12 is connected to the discharge side of the compressor 10, and the other side thereof is connected to the check valve 13*a*. The heat source side heat exchanger 12 may comprise a plate fin and tube heat exchanger capable of exchanging heat between a refrigerant flowing through a refrigerant pipe and air passing through fins.

The accumulator 19 stores a redundant refrigerant resulting from a difference between a refrigerant in heating operation mode and that in cooling operation mode and a redundant refrigerant to a transient change in operation (e.g., a change in the number of running indoor units 3). In heating operation mode, the suction side of the accumulator 19 is connected to the heat source side heat exchanger 12, and the discharge side thereof is connected to the suction side of the compressor 10. In cooling operation mode, the suction side of the accumulator 19 is connected to the check valve 13*c*, and the discharge side thereof is connected to the suction side of the compressor 10.

The check valve 13*c* is disposed on the refrigerant pipe 4 between the relay unit 2 and the first refrigerant flow switching device 11 and permits the heat source side refrigerant to flow in only a predetermined direction (direction from the relay unit 2 to the outdoor unit 1).

The check valve 13*a* is disposed on the refrigerant pipe 4 between the heat source side heat exchanger 12 and the relay unit 2 and permits the heat source side refrigerant to flow in only a predetermined direction (direction from the outdoor unit 1 to the relay unit 2).

The check valve 13*d* is disposed on the first connection pipe 4*a* and enables the heat source side refrigerant discharged from the compressor 10 to be sent to the relay unit 2 in heating operation.

The check valve 13*b* is disposed on the second connection pipe 4*b* and enables the heat source side refrigerant returned from the relay unit 2 to be sent to the suction side of the compressor 10 in heating operation.

The first connection pipe 4*a* connects the refrigerant pipe 4 between the first refrigerant flow switching device 11 and the check valve 13*c* and the refrigerant pipe 4 between the check valve 13*a* and the relay unit 2 in the outdoor unit 1. The second connection pipe 4*b* connects the refrigerant pipe 4 between the check valve 13*c* and the relay unit 2 and the refrigerant pipe 4 between the heat source side heat exchanger 12 and the check valve 13*a* in the outdoor unit 1. FIG. 2 illustrates, as an example, the case where the first connection pipe 4*a*, second connection pipe 4*b*, check valve 13*a*, check valve 13*b*, check valve 13*c*, and check valve 13*d* are disposed. The invention is not limited to this case. These components are optional.

[Indoor Unit 3]

The indoor unit 3 includes use side heat exchangers 35*a* to 35*d* (sometimes referred to simply as use side heat exchanger 35). The use side heat exchanger 35 is connected to heat medium flow control devices 34*a* to 34*d* (sometimes referred to simply as heat medium flow control device 34) through the heat medium pipes 5 and is connected to second heat medium flow switching devices 33*a* to 33*d* (sometimes referred to simply as second heat medium flow switching device 33) through the heat medium pipes 5. The use side heat exchanger 35 exchanges heat between air supplied from the air-sending device (not illustrated), such as a fan, and the heat medium and produces air for heating or air for cooling to be supplied to the indoor space 7.

FIG. 2 illustrates, as an example, the case where the four indoor units 3*a* to 3*d* are connected to the relay unit 2 through the heat medium pipes 5. In accordance with the indoor units 3*a* to 3*d*, the use side heat exchanger 35 is indicated as, from above in FIG. 2, the use side heat exchanger 35*a*, use side heat exchanger 35*b*, use side heat exchanger 35*c*, and use side heat exchanger 35*d*. The number of the indoor units 3 being connected is not limited to four.

[Relay Unit 2]

The relay unit 2 includes two intermediate heat exchangers 25*a* and 25*b* (sometimes referred to simply as intermediate heat exchanger 25), two expansion devices 26*a* and 26*b* (sometimes referred to simply as expansion device 26), two opening and closing devices (opening and closing device 27 and opening and closing device 29), two second refrigerant flow switching devices 28*a* and 28*b* (sometimes referred to simply as second refrigerant flow switching device 28), two pumps 31*a* and 31*b* (sometimes referred to simply as pump 31), four first heat medium flow switching devices 32*a* to 32*d* (sometimes referred to simply as first heat medium flow switching device 32), four second heat medium flow switching devices 33*a* to 33*d* (sometimes referred to simply as second heat medium flow switching device 33), and four heat medium flow control devices 34*a* to 34*d* (sometimes referred to simply as heat medium flow control device 34).

The heat exchanger 25 functions as a condenser (radiator) or an evaporator, exchanges heat between the heat source side refrigerant and the heat medium, and conveys cooling energy or heating energy produced by the outdoor unit 1 and stored in the heat source side refrigerant to the heat medium. That is, in heating operation, the intermediate heat exchanger 25 functions as a condenser (radiator) and conveys heating energy to the heat medium. In cooling operation, the intermediate heat exchanger 25 functions as an evaporator and conveys cooling energy to the heat medium.

The intermediate heat exchanger 25*a* is disposed between the expansion device 26*a* and the second refrigerant flow switching device 28*a* in the refrigerant circuit A and provides cooling for the heat medium in cooling and the heating mixed operation mode. The intermediate heat exchanger 25*b* is disposed between the expansion device 26*b* and the second refrigerant flow switching device 28*b* in the refrigerant circuit A and provides heating for the heat medium in cooling and heating mixed operation mode.

The expansion device 26 has the function as a pressure reducing valve and an expansion valve, reduces the pressure of the heat source side refrigerant, and expands it. The expansion device 26*a* is disposed upstream of the intermediate heat exchanger 25*a* in the stream of the heat source side refrigerant in cooling only operation mode. The expansion device 26*b* is disposed upstream of the intermediate heat exchanger 25*b* in the stream of the heat source side refrigerant in cooling only operation mode. The expansion device 26 may comprise a device whose opening degree is controllable, such as an electronic expansion valve.

Each of the opening and closing device 27 and the opening and closing device 29 may comprise a solenoid valve whose opening and closing operations can be performed by energization. Each of the opening and closing device 27 and the opening and closing device 29 opens and closes the flow on which it is disposed. That is, the opening and closing of each of the opening and closing device 27 and opening and closing device 29 is controlled in accordance with the operation mode to switch the flow of the heat source side refrigerant.

The opening and closing device 27 is disposed on the refrigerant pipe 4 on the entry side for the heat source side refrigerant (the lowermost refrigerant pipe 4 of the refrigerant pipes 4 connecting the outdoor unit 1 and the relay unit 2 in FIG. 2). The opening and closing device 29 is disposed on the pipe connecting the refrigerant pipe 4 on the entry side for the heat source side refrigerant and the refrigerant pipe 4 on the exit side therefor. Each of the opening and closing device 27 and the opening and closing device 29 may be any device capable of opening and closing the flow on which it is disposed, and an example thereof may be a device whose opening degree is controllable, such as an electronic expansion valve.

The second refrigerant flow switching device 28 may comprise a four-way valve. The second refrigerant flow switching device 28 switches the stream of the heat source side refrigerant so that the intermediate heat exchanger 25 acts as a condenser or an evaporator depending on the operation mode. The second refrigerant flow switching device 28*a* is disposed downstream of the intermediate heat exchanger 25*a* in the stream of the heat source side refrigerant in cooling only operation mode. The second refrigerant flow switching device 28*b* is disposed downstream of the intermediate heat exchanger 25*b* in the stream of the heat source side refrigerant in cooling only operation mode.

The pump 31 circulates the heat medium flowing in the heat medium pipe 5 through the heat medium circulation circuit B. The pump 31*a* is disposed on the heat medium pipe 5 between the intermediate heat exchanger 25*a* and the second heat medium flow switching device 33. The pump 31*b* is disposed on the heat medium pipe 5 between the intermediate heat exchanger 25*b* and the second heat medium flow switching device 33. The pump 31 may comprise a pump whose capacity is controllable, and the quantity of flow thereof may be adjustable in accordance with the magnitude of the load in the indoor unit 3.

FIG. 2 illustrates, as an example, the case where the pump 31 is disposed on the heat medium pipe 5 downstream of the intermediate heat exchanger 25. The invention is not limited to this case. That is, the pump 31 may be disposed on the heat medium pipe 5 upstream of the intermediate heat exchanger 25.

The first heat medium flow switching device 32 switches the connection between the exit side for the heat medium flow of the use side heat exchanger 35 and the entry side for the heat medium flow of the intermediate heat exchanger 25. The number of the first heat medium flow switching devices 32 corresponds to the number of the indoor units 3 being placed (here, four). Each of the first heat medium flow switching devices 32 has three sides: a first one is connected to the intermediate heat exchanger 25*a*, a second one is connected to the intermediate heat exchanger 25*b*, and a third one is connected to the heat medium flow control device 34. The first heat medium flow switching device 32 is disposed on the exit side for the heat medium flow of the use side heat exchanger 35. In accordance with the indoor units 3, the first heat medium flow switching device 32 is indicated as, from above in FIG. 2, the first heat medium flow switching device 32*a*, first heat medium flow switching device 32*b*, first heat medium flow switching device 32*c*, and first heat medium flow switching device 32*d*. The switching of the heat medium flow contains not only full switching from one to another but also partial switching from one to another. The first heat medium flow switching device 32 may comprise a three-way valve.

The second heat medium flow switching device 33 switches the connection between the exit side for the heat medium flow of the intermediate heat exchanger 25 and the entry side for the heat medium flow of the use side heat exchanger 35. The number of the second heat medium flow switching devices 33 corresponds to the number of the indoor units 3 being placed (here, four). Each of the second heat medium flow switching devices 33 has three sides: a first one is connected to the intermediate heat exchanger 25*a*, a second one is connected to the intermediate heat exchanger 25*b*, and a third one is connected to the use side heat exchanger 35. The second heat medium flow switching device 33 is disposed on the entry side for the heat medium flow of the use side heat exchanger 35. In accordance with the indoor units 3, the second heat medium flow switching device 33 is indicated as, from above in FIG. 2, the second heat medium flow switching device 33*a*, second heat medium flow switching device 33*b*, second heat medium flow switching device 33*c*, and second heat medium flow switching device 33*d*. The switching of the heat medium flow contains not only full switching from one to another but also partial switching from one to another. The second heat medium flow switching device 33 may comprise a three-way valve.

The heat medium flow control device 34 may comprise a two-way valve whose opening area is controllable. The heat medium flow control device 34 controls the quantity of flow of the heat medium in the heat medium pipe 5. The number of the heat medium flow control devices 34 corresponds to the number of the indoor units 3 being placed (here, four). One side of each of the heat medium flow control devices 34 is connected to the use side heat exchanger 35, and the other side thereof is connected to the first heat medium flow switching device 32. The heat medium flow control device 34 is disposed on the exit side for the heat medium flow of the use side heat exchanger 35. That is, the heat medium flow control device 34 adjusts the amount of the heat medium to flow into the indoor unit 3 depending on the temperature of the heat medium to flow into the indoor unit 3 and the temperature of the heat medium flowing out and can provide the indoor unit 3 with the optimal amount of the heat medium corresponding to a load inside a room.

In accordance with the indoor units 3, the heat medium flow control device 34 is indicated as, from above in FIG. 2, the heat medium flow control device 34*a*, heat medium flow control device 34*b*, heat medium flow control device 34*c*, and heat medium flow control device 34*d*. The heat medium flow control device 34 may be disposed on the entry side for the heat medium flow of the use side heat exchanger 35. The heat medium flow control device 34 may be disposed on the entry side for the heat medium flow of the use side heat exchanger 35 and between the second heat medium flow switching device 33 and the use side heat exchanger 35. If no load is required in the indoor unit 3, for example, in stop mode or a thermostat off state, supplying the heat medium to the indoor unit 3 can be shut off by fully closing the heat medium flow control device 34.

If the first heat medium flow switching device 32 or the second heat medium flow switching device 33 has the function of the heat medium flow control device 34, the heat medium flow control device 34 can be omitted.

[Temperature Sensor]

The air-conditioning apparatus 100 includes outdoor space temperature detecting means 42 for detecting a temperature of the outdoor space 6 illustrated in FIG. 1, four heat medium temperature detecting means 43*a* to 43*d* (sometimes referred to simply as heat medium temperature detecting means 43) for detecting a temperature of the heat medium flowing out of the indoor units 3 and returning to the pump 31, and four heat medium temperature detecting means 44*a* to 44*d* (sometimes referred to simply as heat medium temperature detecting means 44) for detecting a temperature of the heat medium being sent from the pump 31 to the indoor unit 3.

The outdoor space temperature detecting means 42, heat medium temperature detecting means 43, and heat medium temperature detecting means 44 are connected to a controller 51, which is described later. Results of detection by these components are used in various kinds of control in the air-conditioning apparatus 100. Each of these components may comprise a thermistor.

The outdoor space temperature detecting means 42 detects a temperature of the outdoor space 6. A position where the outdoor space temperature detecting means 42 is disposed is not particularly limited. For example, the outdoor space temperature detecting means 42 may be disposed inside the outdoor unit 1, as illustrated in FIG. 2.

The heat medium temperature detecting means 43 is disposed on the heat medium pipe 5 connecting the use side heat exchanger 35 and the heat medium flow control device 34 and detects a temperature of the heat medium flowing out of the use side heat exchanger 35. The number of the heat medium temperature detecting means 43 corresponds to the number of the indoor units 3 being placed (here, four). A position where the heat medium temperature detecting means 43 is disposed is not particularly limited and may be inside the indoor unit 3 or inside the relay unit 2. Here, in accordance with the indoor units 3, the heat medium temperature detecting means 43 is indicated as, from below in FIG. 2, the heat medium temperature detecting means 43*d*, heat medium temperature detecting means 43*c*, heat medium temperature detecting means 43*b*, and heat medium temperature detecting means 43*a*.

The heat medium temperature detecting means 44 is disposed on the heat medium pipe 5 connecting the second heat medium flow switching device 33 and the use side heat exchanger 35 and detects a temperature of the heat medium flowing in the use side heat exchanger 35. The number of the heat medium temperature detecting means 44 corresponds to the number of the indoor units 3 being placed (here, four). A position where the heat medium temperature detecting means 44 is disposed is not particularly limited and may be inside the indoor unit 3 or inside the relay unit 2. Here, in accordance with the indoor units 3, the heat medium temperature detecting means 43 is indicated as, from below in FIG. 2, the heat medium temperature detecting means 44*d*, heat medium temperature detecting means 44*c*, heat medium temperature detecting means 44*b*, and heat medium temperature detecting means 44*a*.

The air-conditioning apparatus 100 according to Embodiment 1 has four operation modes as normal operation. The four operation modes consist of the cooling only operation mode, the cooling main operation mode, the heating only operation mode, and the heating main operation mode. The air-conditioning apparatus 100 according to Embodiment 1 further has the cooling only temporary operation mode and the heating only temporary operation mode as control for reducing the number of switching the second refrigerant flow switching device 28 (four-way valve switching reduction control), in addition to the above four operation modes, so it has the six operation modes in total. The four-way valve switching reduction control is described later with reference to FIGS. 7 and 8. That is, when the air-conditioning apparatus 100 shifts from the normal operation to the four-way valve switching reduction control operation, it also becomes operable in cooling only temporary operation mode and heating only temporary operation mode.

The air-conditioning apparatus 100 according to Embodiment 1 includes operation mode detecting means 41 for detecting the operation mode of the air-conditioning apparatus 100 and the controller 51 for controlling various devices on the basis of results of detection performed by various detecting means to execute the four-way valve switching reduction control.

[Operation Mode Detecting Means 41]

The operation mode detecting means 41 detects operation and an operation load of each of the indoor units 3*a* to 3*d* and outdoor unit 1, determines the operation mode of the air-conditioning apparatus 100 on the basis of the detection, and outputs the result of the detection to the controller 51. FIG. 2 illustrates an example in which the operation mode detecting means 41 is disposed in the relay unit 2. The invention is not limited to this example.

When all of the indoor units 3*a* to 3*d* are in cooling operation, that is, when a cooling load is 100%, the operation mode detecting means 41 determines that the air-conditioning apparatus 100 is executing the cooling only operation mode.

When there coexist cooling operation and heating operation of the indoor units 3*a* to 3*d* and a cooling load is larger in the operation load, the operation mode detecting means 41 determines that the air-conditioning apparatus 100 is executing the cooling main operation mode.

When all of the indoor units 3*a* to 3*d* are in heating operation, that is, when a heating load is 100%, the operation mode detecting means 41 determines that the air-conditioning apparatus 100 is executing the heating only operation mode.

When there coexist cooling operation and heating operation of the indoor units 3*a* to 3*d* and a heating load is larger in the operation load, the operation mode detecting means 41 determines that the air-conditioning apparatus 100 is executing the heating main operation mode.

The operation mode detecting means 41 is required to be able to detect the four operation modes, which are the modes for normal operation, to execute the four-way valve switching reduction control. As for the heating only temporary operation mode and the cooling only temporary operation mode, the controller 51 identifies a special operation mode occurring in shifting from the heating main operation mode to the heating only operation mode as the heating only temporary operation mode and identifies a special operation mode occurring in shifting from the cooling main operation mode to the cooling only operation mode as the cooling only temporary operation mode.

[Controller 51]

The controller 51 may comprise a microcomputer. The controller 51 controls a driving frequency of the compressor 10, a rotation speed (including ON/OFF) of the air-sending device (not illustrated), switching of each of the first refrigerant flow switching device 11 and the second refrigerant flow switching device 28, an opening degree of the expansion device 26, driving of the pump 31, opening or closing of each of the opening and closing device 27 and the opening and closing device 29, switching of each of the first heat medium flow switching device 32 and the second heat medium flow switching device 33, an opening degree of the heat medium flow control device 34, and other elements. The driving frequency of the compressor 10, rotation speed (including ON/OFF) of the air-sending device (not illustrated), and switching of the first refrigerant flow switching device 11 may be controlled by an outdoor unit control device (not illustrated) that is disposed in the outdoor unit 1 and that is a device different from the controller 51.

Here, the controller 51 controls the above-described devices on the basis of at least results of detection performed by the operation mode detecting means 41, outdoor space temperature detecting means 42, heat medium temperature detecting means 43, heat medium temperature detecting means 44, and the like and an instruction from a remote controller. The controller 51 has the function of measuring the amount of time having elapsed from switching of the operation mode.

The controller 51 includes heat medium temperature difference calculating means 45 for calculating the difference between a result of detection performed by the heat medium temperature detecting means 43 and a result of detection performed by the heat medium temperature detecting means 44 and four-way valve switching reduction means 50 for performing processing for reducing the number of switching the second refrigerant flow switching device 28.

The heat medium temperature difference calculating means 45 calculates the difference between a temperature of the heat medium flowing out of the use side heat exchanger 35, this temperature being a result of detection performed by the heat medium temperature detecting means 43, and a temperature of the heat medium flowing in the use side heat exchanger 35, this temperature being a result of detection performed by the heat medium temperature detecting means 44.

The four-way valve switching reduction means 50 performs computation so as to reduce the number of switching the second refrigerant flow switching device 28 on the basis of a result of calculation performed by the heat medium temperature difference calculating means 45, a result of detection performed by the operation mode detecting means 41, a result of detection performed by the outdoor space temperature detecting means 42, and a result of detection of the amount of time having elapsed from switching of the operation mode. The controller 51 controls the opening degree of the expansion device 26 and the switching of the second refrigerant flow switching device 28 on the basis of a result of detection performed by the four-way valve switching reduction means 50.

The controller 51, which is illustrated in FIG. 2 as being disposed in the relay unit 2 as an example, may be disposed for each of the indoor units 3 or may also be disposed in the outdoor unit 1.

[Operation Mode]

The air-conditioning apparatus 100 can execute the above-described six operation modes consisting of four normal operation modes and additional two modes as control for reducing the number of switching the second refrigerant flow switching device 28 (four-way valve switching reduction control).

Each of the operation modes is described below with streams of the heat source side refrigerant and the heat medium.

[Cooling Only Operation Mode (Pattern No. 1)]

Figure 3:
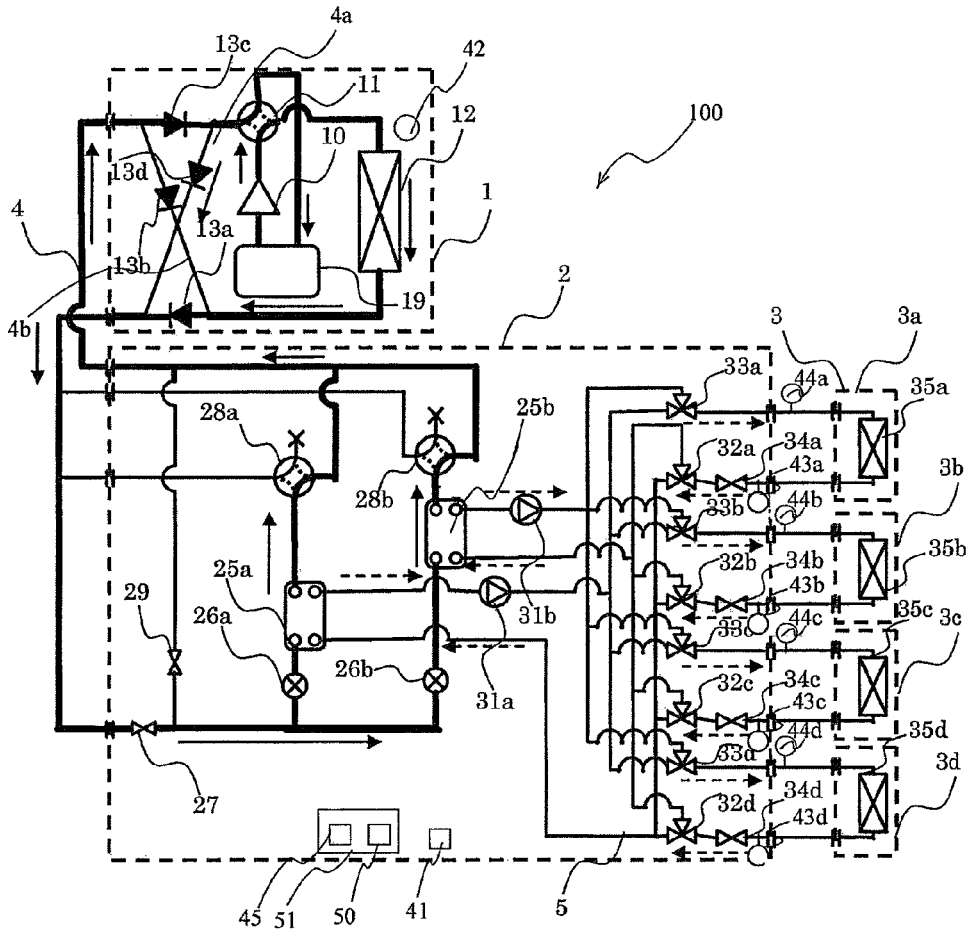
FIG. 3 is a refrigerant circuit diagram that illustrates a stream of a refrigerant in cooling only operation mode in the air-conditioning apparatus illustrated in FIG. 2.

FIG. 3 is a refrigerant circuit diagram that illustrates a stream of a refrigerant in cooling only operation mode in the air-conditioning apparatus 100 illustrated in FIG. 2. With reference to FIG. 3, the cooling only operation mode is described using, an example, the case where a cooling load is occurring in all the use side heat exchangers 35*a* to 35*d*. In FIG. 3, the directions of streams of the heat source side refrigerant are indicated by the solid-line arrows, and the directions of streams of the heat medium are indicated by the dash-line arrows. The cooling only operation mode corresponds to the operation mode of pattern No. 1 illustrated in FIG. 7.

In the case of the cooling only operation mode illustrated in FIG. 3, in the outdoor unit 1, the first refrigerant flow switching device 11 is switched such that the heat source side refrigerant discharged from the compressor 10 flows into the heat source side heat exchanger 12.

In the relay unit 2, the pumps 31*a* and 31*b* are driven, the heat medium flow control devices 34*a* to 34*d* are opened, and the heat medium is circulated between each of the intermediate heat exchangers 25*a* and 25*b* and each of the use side heat exchangers 35*a* to 35*d*. The second refrigerant flow switching devices 28*a* and 28*b* are switched to the cooling side, the opening and closing device 27 is opened, and the opening and closing device 29 is closed.

In the foregoing description, the state where the second refrigerant flow switching device 28 is switched to the cooling side means that the refrigerant flowing from the outdoor unit 1 into the relay unit 2 flows in the direction from the intermediate heat exchanger 25 toward the second refrigerant flow switching device 28.

First, a stream of the heat source side refrigerant in the refrigerant circuit A is described.

A low-temperature and low-pressure refrigerant is compressed by the compressor 10, it becomes a high-temperature and high-pressure gas refrigerant, and the gas refrigerant is discharged. The high-temperature and high-pressure gas refrigerant discharged from the compressor 10 runs through the first refrigerant flow switching device 11, passes through the heat source side heat exchanger 12, exchanges heat with outside air, and becomes a high-temperature and high-pressure liquid or two-phase refrigerant. The liquid or two-phase refrigerant passes through the check valve 13*a*, then flows through the first connection pipe 4*a*, and flows out of the outdoor unit 1. The high-temperature and high-pressure liquid or two-phase refrigerant flowing out of the outdoor unit 1 flows into the relay unit 2 through the refrigerant pipe 4. The high-temperature and high-pressure liquid or two-phase refrigerant flowing in the relay unit 2 passes through the opening and closing device 27, is then split into the liquids or refrigerants directed to the expansion devices 26*a* and 26*b*. The liquids or refrigerants are expanded by the expansion devices 26*a* and 26*b* and become low-temperature and low-pressure two-phase refrigerants. These two-phase refrigerants vaporize while removing heat from the heat medium circulating through the heat medium circulation circuit B and become low-temperature gas refrigerants. The gas refrigerants flowing out of the intermediate heat exchangers 25*a* and 25*b* pass through the second refrigerant flow switching devices 28*a* and 28*b*, flow out of the relay unit 2, pass through the second connection pipe 4*b*, the first refrigerant flow switching device 11, and the accumulator 19, and is sucked into the compressor 10 again.

At this time, the opening degree of the expansion device 26 is controlled such that a superheat (degree of superheat) obtained as the difference between a value in which the pressure of the heat source side refrigerant flowing between the intermediate heat exchanger 25 and the expansion device 26 is converted into a saturation temperature and a temperature at the exit side of the intermediate heat exchanger 25 is constant. If a temperature at an intermediate position of the intermediate heat exchanger 25 can be measured, the saturation temperature obtained by conversion from the temperature at that intermediate position may be used instead. In this case, it is not necessary to include a pressure sensor, and the system can be made inexpensively.

Next, a stream of the heat medium in the heat medium circulation circuit B is described.

In cooling only operation mode, the heating energy of the heat medium is conveyed to the heat source side refrigerant in both the intermediate heat exchangers 25*a* and 25*b*, the cooled heat medium is pressurized by the pumps 31*a* and 31*b* and flows out, and the heat medium flows into the use side heat exchangers 35*a* to 35*d* through the second heat medium flow switching devices 33*a* to 33*d*. The heat medium removes heat from inside air in the use side heat exchangers 35*a* to 35*d*, thereby cooling the indoor space 7.

Then the heat medium flows out the use side heat exchangers 35*a* to 35*d* and flows into the heat medium flow control devices 34*a* to 34*d*. At this time, the quantity of flow of the heat medium controlled to the quantity of flow required to compensate for a cooling load necessary in the inside of a room by the working of the heat medium flow control devices 34*a* to 34*d* flows into the use side heat exchangers 35*a* to 35*d*. The heat medium flowing out of the heat medium flow control devices 34*a* to 34*d* passes through the first heat medium flow switching devices 32*a* to 32*d*, flows into the intermediate heat exchangers 25*a* and 25*b*, gives the refrigerant side heat whose quantity corresponds to that removed from the indoor space 7 through the indoor units 3, and is sucked into the pumps 31*a* and 31*b* again.

In the heat medium pipe 5 in the use side heat exchanger 35, the heat medium flows in the direction from the second heat medium flow switching device 33 toward the first heat medium flow switching device 32 through the heat medium flow control device 34.

At this time, the opening degree of each of the first heat medium flow switching device 32 and the second heat medium flow switching device 33 is controlled to an intermediate opening degree or the opening degree corresponding to the temperature of the heat medium at the exit of each of the intermediate heat exchangers 25*a* and 25*b* so as to ensure flows through which the heat medium can flow to both the intermediate heat exchangers 25*a* and 25*b*. The use side heat exchanger 35 is controlled in accordance with the temperature difference between its entry and exit.

[Cooling Only Temporary Operation Mode (Pattern No. 2)]

The cooling only operation mode illustrated in FIG. 3 is a mode in which the heat medium circulating through the heat medium circulation circuit B is cooled in the two intermediate heat exchangers 25*a* and 25*b* (corresponding to pattern No. 1 illustrated in FIG. 7 described later). The cooling only operation mode can also be executed when the expansion device 26*b* is fully closed and the heat medium circulating through the heat medium circulation circuit B is cooled by the intermediate heat exchanger 25*a* alone (corresponding to pattern No. 2 illustrated in FIG. 7). These cooling only operation modes can be switched in accordance with a load required by the indoor unit 3.

Here, the cooling only temporary operation mode (pattern No. 2) can be shifted only from the cooling main operation mode (pattern No. 3). The cooling only temporary operation mode (pattern No. 2) can be shifted to the cooling only operation mode (pattern No. 1) or the cooling main operation mode (pattern No. 3).

The switching states of the second refrigerant flow switching devices 28*a* and 28*b* in cooling only temporary operation mode are substantially the same as those in cooling and heating mixed operation. That is, the second refrigerant flow switching device 28*a* is switched to the cooling side, whereas the second refrigerant flow switching device 28*b* is switched to the heating side.

[Cooling Main Operation Mode (Pattern No. 3)]

Figure 4:
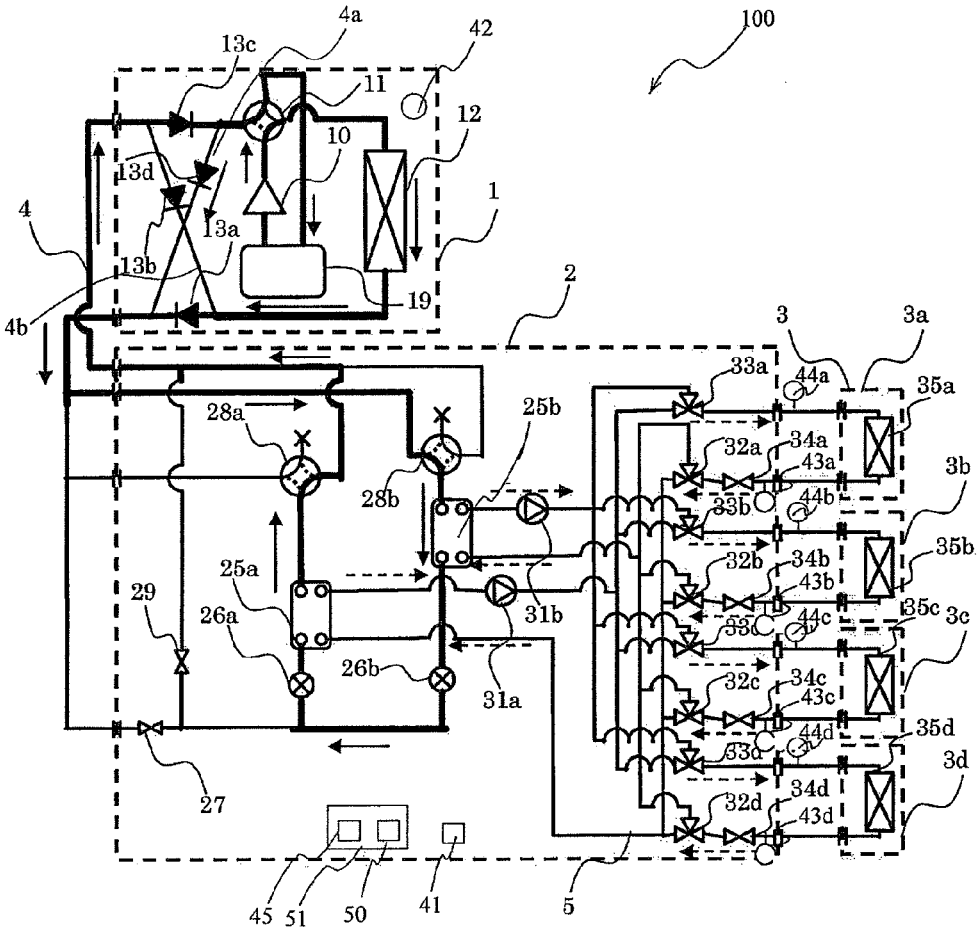
FIG. 4 is a refrigerant circuit diagram that illustrates a stream of a refrigerant in cooling main operation mode of a cooling and heating mixed operation mode in the air-conditioning apparatus illustrated in FIG. 2.

FIG. 4 is a refrigerant circuit diagram that illustrates a stream of a refrigerant in cooling main operation mode of the cooling and heating mixed operation mode in the air-conditioning apparatus 100 illustrated in FIG. 2. The cooling main operation mode corresponds to pattern No. 3 in FIG. 7 described later. With reference to FIG. 4, of the mixed operations, where a heating load is occurring in one or more of the use side heat exchangers 35 and a cooling load is occurring in the remaining of the use side heat exchangers 35, the cooling main operation mode is described. In FIG. 4, the pipes indicated with the thick lines illustrate the pipes through which the heat source side refrigerant circulates. In FIG. 4, the directions of streams of the heat source side refrigerant are indicated by the solid-line arrows, and the directions of streams of the heat medium are indicated by the dash-line arrows. The cooling main operation mode corresponds to the operation mode of pattern No. 3 illustrated in FIG. 7.

In the case of the cooling main operation mode illustrated in FIG. 4, in the outdoor unit 1, the first refrigerant flow switching device 11 is switched such that the heat source side refrigerant discharged from the compressor 10 flows into the relay unit 2 through the heat source side heat exchanger 12. In the relay unit 2, the pumps 31*a* and 31*b* are driven, the heat medium flow control devices 34*a* to 34*d* are opened, and the heat medium is circulated between the intermediate heat exchanger 25*a* and the use side heat exchanger(s) 35 in which a cooling load is occurring and between the intermediate heat exchanger 25*b* and the use side heat exchanger(s) 35 in which a heating load is occurring. The second refrigerant flow switching device 28*a* is switched to the cooling side, the second refrigerant flow switching device 28*b* is switched to the heating side, the expansion device 26*a* is fully opened, the opening and closing device 27 is closed, and the opening and closing device 29 is closed.

First, a stream of the heat source side refrigerant in the refrigerant circuit A is described.

A low-temperature and low-pressure refrigerant is compressed by the compressor 10, it becomes a high-temperature and high-pressure gas refrigerant, and the gas refrigerant is discharged. The high-temperature and high-pressure gas refrigerant discharged from the compressor 10 runs through the first refrigerant flow switching device 11 and the heat source side heat exchanger 12, passes through the check valve 13*a*, and flows out of the outdoor unit 1. The high-temperature and high-pressure two-phase refrigerant flowing out of the outdoor unit 1 flows through the refrigerant pipe 4 and flows into the relay unit 2. The high-temperature and high-pressure two-phase refrigerant flowing in the relay unit 2 passes through the second refrigerant flow switching device 28*b* and then flows into the intermediate heat exchanger 25*b* acting as a condenser.

The two-phase refrigerant flowing in the intermediate heat exchanger 25*b* condenses and liquefies while transferring heat to the heat medium circulating through the heat medium circulation circuit B and becomes a liquid refrigerant. The liquid refrigerant flowing out of the intermediate heat exchanger 25*b* is expanded by the expansion device 26*b* and becomes a low-pressure two-phase refrigerant. The low-pressure two-phase refrigerant flows into the intermediate heat exchanger 25*a* acting as an evaporator through the expansion device 26*a*. The low-pressure two-phase refrigerant flowing in the intermediate heat exchanger 25*a* is made to become a low-temperature and low-pressure gas refrigerant by removing heat from the heat medium circulating through the heat medium circulation circuit B, thus cooling the heat medium. The low-temperature and low-pressure gas refrigerant flows out of the intermediate heat exchanger 25*a*, flows out of the relay unit 2 through the second refrigerant flow switching device 28*a*, flows through the refrigerant pipe 4, and flows into the outdoor unit 1 again.

The low-temperature and low-pressure gas refrigerant flowing in the outdoor unit 1 passes through the check valve 13*c* and is sucked into the compressor 10 again through the first refrigerant flow switching device 11 and the accumulator 19.

The opening degree of the expansion device 26*b* is controlled such that the subcooling (degree of subcooling) of the refrigerant at the exit of the intermediate heat exchanger 25*b* becomes a target value. The expansion device 26*b* may be fully opened, and the subcooling may be controlled using the expansion device 26*a*.

Next, a stream of the heat medium in the heat medium circulation circuit B is described.

In cooling main operation mode, the heating energy of the heat source side refrigerant is conveyed to the heat medium in the intermediate heat exchanger 25*b*, and the heat medium is made to flow in the heat medium pipe 5 by the pump 31*b*. In cooling main operation mode, the cooling energy of the heat source side refrigerant is conveyed to the heat medium in the intermediate heat exchanger 25*a*, and the cooled heat medium is made to flow in the heat medium pipe 5 by the pump 31*a*. The cooled heat medium pressurized by the pump 31*a* and flowing out of the pump 31*a* flows into the use side heat exchanger(s) 35 in which a cooling load is occurring through the second heat medium flow switching device 33, whereas the heat medium pressurized by the pump 31*b* and flowing out of the pump 31*b* flows into the use side heat exchanger(s) 35 in which a heating load is occurring through the second heat medium flow switching device 33.

At this time, when the indoor unit 3 connected to the second heat medium flow switching device 33 is in heating operation mode, the second heat medium flow switching device 33 is switched to the direction in which the intermediate heat exchanger 25*b* and the pump 31*b* are connected; when the indoor unit 3 connected thereto is in cooling operation mode, the second heat medium flow switching device 33 is switched to the direction in which the intermediate heat exchanger 25*a* and the pump 31*a* are connected. That is, the heat medium to be supplied to the indoor unit 3 can be switched to the one for heating or the one for cooling by the second heat medium flow switching device 33.

In the use side heat exchanger 35, cooling operation for the indoor space 7 by the heat medium removing heat from the inside air or heating operation for the indoor space 7 by the heat medium transferring heat to the inside air is performed. At this time, the quantity of flow of the heat medium is controlled to the quantity of flow required to provide an air conditioning load necessary in the inside of a room by the working of the heat medium flow control device 34, and it flows into the use side heat exchanger 35.

The heat medium used in cooling operation and passing through the use side heat exchanger 35, the heat medium having an increased temperature, passes through the heat medium flow control device 34 and the first heat medium flow switching device 32, flows into the intermediate heat exchanger 25*a*, and is sucked into the pump 31*a* again. The heat medium used in heating operation and passing through the use side heat exchanger 35, the heat medium having a reduced temperature, passes through the heat medium flow control device 34 and the first heat medium flow switching device 32, flows into the intermediate heat exchanger 25*b*, and is sucked into the pump 31*b* again. At this time, when the indoor unit 3 connected to the first heat medium flow switching device 32 is in heating operation mode, the first heat medium flow switching device 32 is switched to the direction in which the intermediate heat exchanger 25*b* and the pump 31*b* are connected; when the indoor unit 3 connected thereto is in cooling operation mode, the first heat medium flow switching device 32 is switched to the direction in which the intermediate heat exchanger 25*a* and the pump 31*a* are connected.

During this time, the warm heat medium and the cold heat medium from being mixed, and the warm heat medium and the cold heat medium are introduced to the use side heat exchanger(s) 35 having a heating load and the use side heat exchanger(s) 35 having a cooling load, respectively, without being mixed, by the working of the first heat medium flow switching device 32 and the second heat medium flow switching device 33. This causes the heat medium used in heating operation mode to flow into the intermediate heat exchanger 25*b*, which provides heat from the refrigerant for the use in heating, and causes the heat medium used in cooling operation mode to flow into the intermediate heat exchanger 25*a*, in which the refrigerant receives heat for the use in cooling. The heat media in the intermediate heat exchangers 25*a* and 25*b* exchange heat with the refrigerant again and are then transported to the pumps 31*a* and 31*b*, respectively.

In the heat medium pipe 5 in the use side heat exchanger 35, the heat medium flows in the direction from the second heat medium flow switching device 33 through the heat medium flow control device 34 to the first heat medium flow switching device 32 on both the heating side and the cooling side. The air conditioning load required in the indoor space 7 can be met by control in which, on the heating side, the difference between a result of detection performed by the heat medium temperature detecting means 43 and that by the heat medium temperature detecting means 44 corresponding to the use side heat exchanger 35 for heating and, on the cooling side, the difference between a result of detection performed by the heat medium temperature detecting means 43 and that by the heat medium temperature detecting means 44 corresponding to the use side heat exchanger 35 for cooling are kept at their respective target values.

[Heating Only Operation Mode (Pattern No. 6)]

Figure 5:
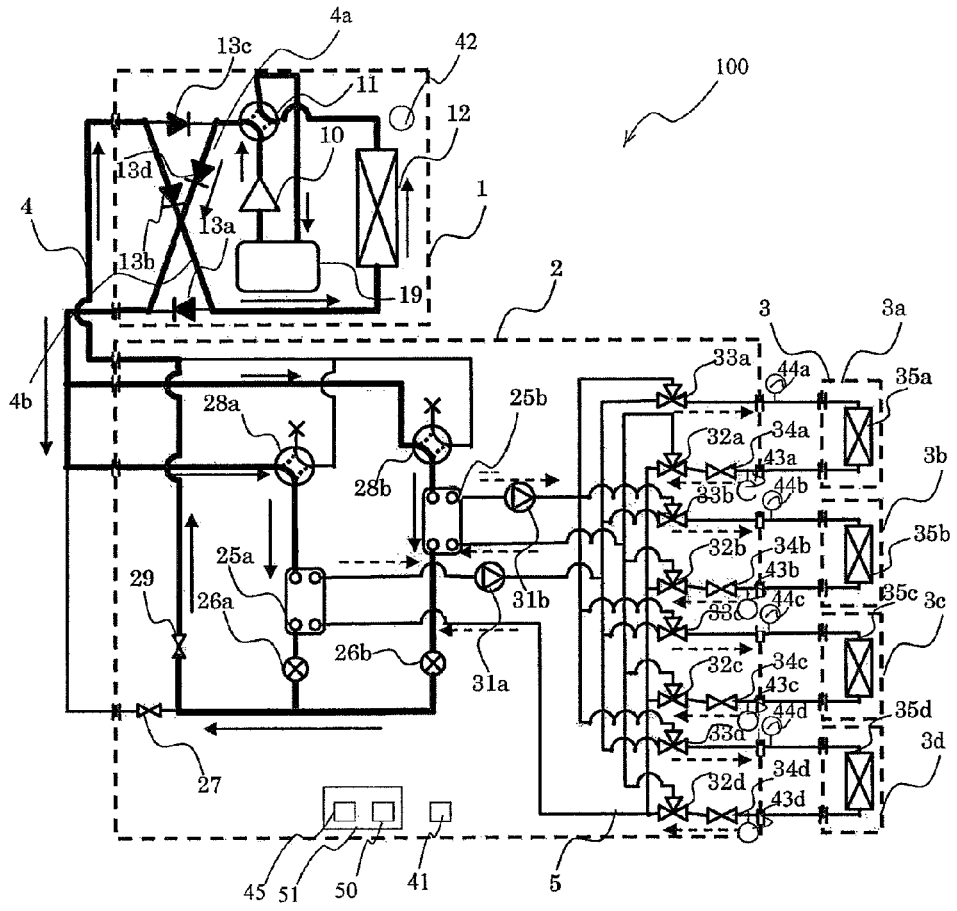
FIG. 5 is a refrigerant circuit diagram that illustrates a stream of a refrigerant in heating only operation mode in the air-conditioning apparatus illustrated in FIG. 2.

FIG. 5 is a refrigerant circuit diagram that illustrates a stream of a refrigerant in heating only operation mode in the air-conditioning apparatus 100 illustrated in FIG. 2. With reference to FIG. 5, the heating only operation mode is described using, an example, the case where a heating load is occurring in all the use side heat exchangers 35*a* to 35*d*. In FIG. 5, the pipes indicated with the thick lines illustrate the pipes through which the heat source side refrigerant flows. In FIG. 5, the directions of streams of the heat source side refrigerant are indicated by the solid-line arrows, and the directions of streams of the heat medium are indicated by the dash-line arrows. The heating only operation mode corresponds to the operation mode of pattern No. 6 illustrated in FIG. 7.

In the case of the heating only operation mode illustrated in FIG. 5, in the outdoor unit 1, the first refrigerant flow switching device 11 is switched such that the heat source side refrigerant discharged from the compressor 10 flows into the relay unit 2 without passing through the 12. In the relay unit 2, the pumps 31*a* and 31*b* are driven, the heat medium flow control devices 34*a* to 34*d* are opened, and the heat medium circulates between each of the intermediate heat exchangers 25*a* and 25*b* and each of the use side heat exchangers 35*a* to 35*d*. The second refrigerant flow switching devices 28*a* and 28*b* are switched to the heating side, the opening and closing device 27 is closed, and the opening and closing device 29 is opened.

In the foregoing description, the state where the second refrigerant flow switching device 28 is switched to the heating side means that the refrigerant flowing from the outdoor unit 1 into the relay unit 2 flows in the direction from the second refrigerant flow switching device 28 toward the intermediate heat exchanger 25.

First, a stream of the heat source side refrigerant in the refrigerant circuit A is described.

A low-temperature and low-pressure refrigerant is compressed by the compressor 10, it becomes a high-temperature and high-pressure gas refrigerant, and the gas refrigerant is discharged. The high-temperature and high-pressure gas refrigerant discharged from the compressor 10 passes through the first refrigerant flow switching device 11, flows through the first connection pipe 4*a*, passes through the check valve 13*d*, and flows out of the outdoor unit 1. The high-temperature and high-pressure gas refrigerant flowing out of the outdoor unit 1 flows into the relay unit 2 through the refrigerant pipe 4. The high-temperature and high-pressure gas refrigerant flowing in the relay unit 2 is split into the gas refrigerants directed to the second refrigerant flow switching devices 28*a* and 28*b*. The gas refrigerants pass through the second refrigerant flow switching devices 28*a* and 28*b* and flow into the intermediate heat exchangers 25*a* and 25*b*, respectively.

The high-temperature and high-pressure gas refrigerants flowing into the intermediate heat exchangers 25*a* and 25*b* condenses and liquefies while transferring heat to the heat medium circulating through the heat medium circulation circuit B and becomes high-pressure liquid refrigerants. The liquid refrigerants flowing out of the intermediate heat exchangers 25*a* and 25*b* are expanded by the expansion device 26*a* and the expansion device 26*b* and become low-temperature and low-pressure two-phase refrigerants. These two-phase refrigerants join into one, and then the two-phase refrigerant passes through the opening and closing device 29, flows out of the relay unit 2, flows through the refrigerant pipe 4, and flows into the outdoor unit 1 again. The refrigerant flowing in the outdoor unit 1 flows through the second connection pipe 4*b*, passes through the check valve 13*b*, and flows into the heat source side heat exchanger 12 acting as an evaporator.

Then the heat source side refrigerant flowing in the heat source side heat exchanger 12 removes heat from air in the outdoor space 6 (hereinafter referred to as outside air) in the heat source side heat exchanger 12 and becomes a low-temperature and low-pressure gas refrigerant. The low-temperature and low-pressure gas refrigerant flowing out of the heat source side heat exchanger 12 passes through the first refrigerant flow switching device 11 and the accumulator 19 and is sucked into the compressor 10 again.

At this time, the opening degree of the expansion device 26 is controlled such that the subcooling (degree of subcooling) obtained as the difference between a value in which the pressure of the heat source side refrigerant flowing between the intermediate heat exchanger 25 and the expansion device 26 is converted into a saturation temperature and a temperature at the exit side of the intermediate heat exchanger 25 is constant.

Next, a stream of the heat medium in the heat medium circulation circuit B is described.

In heating only operation mode, the heating energy of the heat source side refrigerant is conveyed to the heat medium in both the intermediate heat exchanger 25*a* and the intermediate heat exchanger 25*b*, and the heated heat medium is made to flow in the heat medium pipe 5 by the pumps 31*a* and 31*b*. The heat medium pressurized by the pumps 31*a* and 31*b* and flowing out of the pumps 31*a* and 31*b* flows into the use side heat exchangers 35*a* to 35*d* through the second heat medium flow switching devices 33*a* to 33*d*. Then the heat medium transfers heat to the inside air in the use side heat exchangers 35*a* to 35*d*, thereby heating the indoor space 7.

Then the heat medium flows out of the use side heat exchangers 35*a* to 35*d* and flows into the heat medium flow control devices 34*a* to 34*d*. At this time, the quantity of flow of the heat medium is controlled to the quantity of flow required to provide an air conditioning load necessary in the inside of a room by the working of the heat medium flow control devices 34*a* to 34*d*, and the heat medium flows into the use side heat exchangers 35*a* to 35*d*. The heat medium flowing out of the heat medium flow control devices 34*a* to 34*d* passes through the first heat medium flow switching devices 32*a* to 32*d*, flows into the intermediate heat exchangers 25*a* and 25*b*, receives heat whose quantity corresponds to that supplied to the indoor space 7 through the indoor units 3 from the refrigerant side, and is sucked into the pumps 31*a* and 31*b* again.

In the heat medium pipe 5 in the use side heat exchanger 35, the heat medium flows in the direction from the second heat medium flow switching device 33 through the heat medium flow control device 34 to the first heat medium flow switching device 32. The air conditioning load required in the indoor space 7 can be met by control in which the difference between a result of detection performed by the heat medium temperature detecting means 43 and that by the heat medium temperature detecting means 44 is kept at its target values.

At this time, the opening degree of each of the first heat medium flow switching device 32 and the second heat medium flow switching device 33 is controlled to an intermediate opening degree or an opening degree corresponding to the temperature of the heat medium at the exit of each of the intermediate heat exchangers 25*a* and 25*b* so as to ensure flows through which the heat medium can flow to both the intermediate heat exchangers 25*a* and 25*b*. The use side heat exchanger 35 is controlled in accordance with the temperature difference between its entry and exit.

In executing the heating only operation mode, because it is not necessary to feed a use side heat exchanger 35 having no heat load (including that in a thermostat off state and in stop mode) with the heat medium, the flow thereto is closed by the heat medium flow control device 34 so that the heat medium is prevented from flowing in the use side heat exchanger 35. In FIG. 5, where all of the use side heat exchangers 35*a* to 35*d* have a heat load, the heat medium is fed to them. If the heat load disappears, a corresponding heat medium flow control device 34 may be fully closed. Then if a heat load appears again, the corresponding heat medium flow control device 34 may be opened so that the heat medium is circulated. The same applies to other operation modes described below.

[Heating Only Temporary Operation Mode (Pattern No. 5)]

The heating only operation mode illustrated in FIG. 5 is a mode in which the heat medium circulating through the heat medium circulation circuit B is heated in the two intermediate heat exchangers 25*a* and 25*b* (corresponding to pattern No. 6 in FIG. 7 described later). The heating only operation mode can also be executed when the expansion device 26*a* is fully closed and the heat medium circulating through the heat medium circulation circuit B is heated in the intermediate heat exchanger 25*b* alone (corresponding to pattern No. 5 in FIG. 7 described later). These heating only operation modes can be switched in accordance with a load required by the indoor unit 3.

Here, the heating only temporary operation mode (pattern No. 5) can be shifted only from the heating main operation mode (pattern No. 4). The heating only temporary operation mode (pattern No. 5) can be shifted to the heating only operation mode (pattern No. 6) or the heating main operation mode (pattern No. 4).

The switching states of the second refrigerant flow switching devices 28*a* and 28*b* in heating only temporary mode are substantially the same as those in cooling and heating mixed operation. That is, the second refrigerant flow switching device 28*a* is switched to the cooling side, whereas the second refrigerant flow switching device 28*b* is switched to the heating side.

[Heating Main Operation Mode (Pattern No. 4)]

Figure 6:
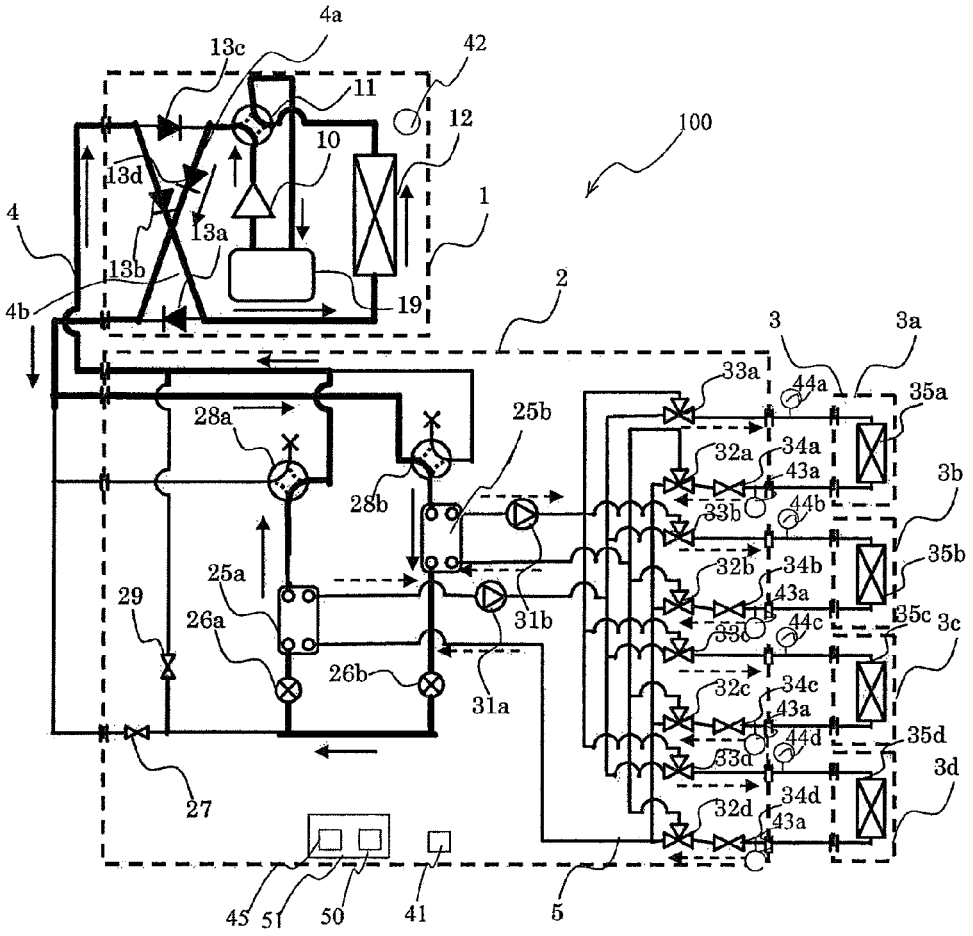
FIG. 6 is a refrigerant circuit diagram that illustrates a stream of a refrigerant in heating main operation mode of the cooling and heating mixed operation mode in the air-conditioning apparatus illustrated in FIG. 2.

FIG. 6 is a refrigerant circuit diagram that illustrates a stream of a refrigerant in heating main operation mode of the cooling and heating mixed operation mode in the air-conditioning apparatus 100 illustrated in FIG. 2. The heating main operation mode corresponds to pattern No. 4 in FIG. 7 described later. With reference to FIG. 6, of the mixed operations, where a heating load is occurring in one or more of the use side heat exchangers 35 and a cooling load is occurring in the remaining of the use side heat exchangers 35, the heating main operation mode is described. In FIG. 6, the pipes indicated with the thick lines illustrate the pipes through which the heat source side refrigerant circulates. In FIG. 6, the directions of streams of the heat source side refrigerant are indicated by the solid-line arrows, and the directions of streams of the heat medium are indicated by the dash-line arrows. The heating main operation mode corresponds to the operation mode of pattern No. 4 illustrated in FIG. 7.

In the case of the heating main operation mode illustrated in FIG. 6, in the outdoor unit 1, the first refrigerant flow switching device 11 is switched such that the heat source side refrigerant discharged from the compressor 10 flows into the relay unit 2 without passing through the heat source side heat exchanger 12. In the relay unit 2, the pumps 31*a* and 31*b* are driven, the heat medium flow control devices 34*a* to 34*d* are opened, and the heat medium is circulated between the intermediate heat exchanger 25*a* and the use side heat exchanger(s) 35 in which a cooling load is occurring and between the intermediate heat exchanger 25*b* and the use side heat exchanger(s) 35 in which a heating load is occurring. The second refrigerant flow switching device 28*a* is switched to the cooling side, the second refrigerant flow switching device 28*b* is switched to the heating side, the expansion device 26*a* is fully opened, the opening and closing device 27 is closed, and the opening and closing device 29 is closed.

First, a stream of the heat source side refrigerant in the refrigerant circuit A is described.

A low-temperature and low-pressure refrigerant is compressed by the compressor 10, it becomes a high-temperature and high-pressure gas refrigerant, and the gas refrigerant is discharged. The high-temperature and high-pressure gas refrigerant discharged from the compressor 10 runs through the first refrigerant flow switching device 11 and the check valve 13*d* and flows out of the outdoor unit 1. The high-temperature and high-pressure gas refrigerant flowing out of the outdoor unit 1 flows through the refrigerant pipe 4 and flows into the relay unit 2. The high-temperature and high-pressure gas refrigerant flowing in the relay unit 2 passes through the second refrigerant flow switching device 28*b* and then flows into the intermediate heat exchanger 25*b* acting as a condenser.

The high-temperature and high-pressure gas refrigerant flowing in the intermediate heat exchanger 25*b* condenses and liquefies while transferring heat to the heat medium circulating through the heat medium circulation circuit B and becomes a liquid refrigerant. The liquid refrigerant flowing out of the intermediate heat exchanger 25*b* is expanded by the expansion device 26*b* and becomes a low-pressure two-phase refrigerant. The low-pressure two-phase refrigerant flows in the intermediate heat exchanger 25*a* acting as an evaporator through the expansion device 26*a*. The low-pressure two-phase refrigerant flowing into the intermediate heat exchanger 25*a* is evaporated by removing heat from the heat medium circulating through the heat medium circulation circuit B, thus cooling the heat medium. The low-pressure two-phase refrigerant flows out of the intermediate heat exchanger 25*a*, flows out of the relay unit 2 through the second refrigerant flow switching device 28*a*, flows through the refrigerant pipe 4, and flows into the outdoor unit 1 again.

The low-temperature and low-pressure two-phase refrigerant flowing in the outdoor unit 1 passes through the check valve 13*b* and flows into the heat source side heat exchanger 12 acting as an evaporator. The refrigerant flowing in the heat source side heat exchanger 12 removes heat from the outside air and becomes a low-temperature and low-pressure gas refrigerant. The low-temperature and low-pressure gas refrigerant flowing out of the heat source side heat exchanger 12 is sucked into the compressor 10 again through the first refrigerant flow switching device 11 and the accumulator 19.

The opening degree of the expansion device 26*b* is controlled such that the subcooling (degree of subcooling) of the refrigerant at the exit of the intermediate heat exchanger 25*b* becomes a target value.

Next, a stream of the heat medium in the heat medium circulation circuit B is described.

In heating main operation mode, the heating energy of the heat source side refrigerant is conveyed to the heat medium in the intermediate heat exchanger 25*b*, and the heated heat medium is made to flow in the heat medium pipe 5 by the pump 31*b*. In heating main operation mode, the cooling energy of the heat source side refrigerant is conveyed to the heat medium in the intermediate heat exchanger 25*a*, and the cooled heat medium is made to flow in the heat medium pipe 5 by the pump 31*a*. The cooled heat medium pressurized by the pump 31*a* and flowing out of the pump 31*a* flows into the use side heat exchanger(s) 35 in which a cooling load is occurring through the second heat medium flow switching device 33, whereas the heat medium pressurized by the pump 31*b* and flowing out of the pump 31*b* flows into the use side heat exchanger(s) 35 in which a heating load is occurring through the second heat medium flow switching device 33.

At this time, when the indoor unit 3 connected to the second heat medium flow switching device 33 is in heating operation mode, the second heat medium flow switching device 33 is switched to the direction in which the intermediate heat exchanger 25*b* and the pump 31*b* are connected; when the indoor unit 3 connected thereto is in cooling operation mode, the second heat medium flow switching device 33 is switched to the direction in which the intermediate heat exchanger 25*a* and the pump 31*a* are connected. That is, the heat medium to be supplied to the indoor unit 3 can be switched to the one for heating or the one for cooling by the second heat medium flow switching device 33.

In the use side heat exchanger 35, cooling operation for the indoor space 7 by the heat medium removing heat from the inside air or heating operation for the indoor space 7 by the heat medium transferring heat to the inside air is performed. At this time, the quantity of flow of the heat medium is controlled to the quantity of flow required to provide an air conditioning load necessary in the inside of a room by the working of the heat medium flow control device 34, and it flows into the use side heat exchanger 35.

The heat medium used in cooling operation and passing through the use side heat exchanger 35 to have an increased temperature, passes through the heat medium flow control device 34 and the first heat medium flow switching device 32, flows into the intermediate heat exchanger 25*a*, and is sucked into the pump 31*a* again. The heat medium used in heating operation and passing through the use side heat exchanger 35, the heat medium having a reduced temperature, passes through the heat medium flow control device 34 and the first heat medium flow switching device 32, flows into the intermediate heat exchanger 25*b*, and is sucked into the pump 31*b* again. At this time, when the indoor unit 3 connected to the first heat medium flow switching device 32 is in heating operation mode, the first heat medium flow switching device 32 is switched to the direction in which the intermediate heat exchanger 25*b* and the pump 31*b* are connected; when the indoor unit 3 connected thereto is in cooling operation mode, the first heat medium flow switching device 32 is switched to the direction in which the intermediate heat exchanger 25*a* and the pump 31*a* are connected.

During this time, the warm heat medium and the cold heat medium are introduced to the use side heat exchanger(s) 35 having a heating load and the use side heat exchanger(s) 35 having a cooling load, respectively, without being mixed, by the working of the first heat medium flow switching device 32 and the second heat medium flow switching device 33. This causes the heat medium used in heating operation mode to flow into the intermediate heat exchanger 25*b*, which provides heat from the refrigerant for the use in heating, and causes the heat medium used in cooling operation mode to flow into the intermediate heat exchanger 25*a*, in which the refrigerant receives heat for the use in cooling. The heat media in the intermediate heat exchangers 25*a* and 25*b* exchange heat with the refrigerant again and are then transported to the pumps 31*a* and 31*b*, respectively.

In the heat medium pipe 5 in the use side heat exchanger 35, the heat medium flows in the direction from the second heat medium flow switching device 33 through the heat medium flow control device 34 to the first heat medium flow switching device 32 on both the heating side and the cooling side. The air conditioning load required in the indoor space 7 can be provided by control in which, on the heating side, the difference between a result of detection performed by the heat medium temperature detecting means 43 and that by the heat medium temperature detecting means 44 corresponding to the use side heat exchanger 35 for heating and, on the cooling side, the difference between a result of detection performed by the heat medium temperature detecting means 43 and that by the heat medium temperature detecting means 44 corresponding to the use side heat exchanger 35 for cooling are kept at their respective target values.

As described above, the air-conditioning apparatus 100 according to Embodiment 1 switches the second refrigerant flow switching device 28 to the cooling side or the heating side in accordance with the operation mode. A way of controlling each of the second refrigerant flow switching devices 28*a* and 28*b*, expansion devices 26*a* and 26*b*, and opening and closing device 29 in each mode is indicated as an item illustrated in FIG. 7. Because the switching state of the second refrigerant flow switching device 28 included in the relay unit 2 is determined by the operation state of each of the indoor units 3, if the operation mode of each of a plurality of indoor units 3 is frequently switched in cooling and heating mixed operation mode, the frequency of switching the second refrigerant flow switching device 28 included in the relay unit 2 is also increased with the switching of the operation mode of the indoor unit 3.

For such a reason, because the frequency of switching the second refrigerant flow switching device 28 is increased, it is necessary to have high durability correspondingly. Because the increased frequency of switching the second refrigerant flow switching device 28 leads to an increased time of variations in the pressure of the refrigerant occurring in switching, it is necessary to suppress the variations in the pressure of the refrigerant. In addition, because the increased frequency of switching the second refrigerant flow switching device 28 leads to an increased frequency of occurrence of switching sounds correspondingly, it is necessary to suppress a reduction in comfort of users even when the second refrigerant flow switching device 28 is disposed in the vicinity of the inside of a room.

FIG. 7 is a table that describes the switching of the second refrigerant flow switching device 28 illustrated in FIG. 2 and the opening degree of the expansion device 26 for each operation mode. In FIG. 7, SH denotes superheat (degree of superheat), and SC denotes subcooling (degree of subcooling).

The operation mode of the air-conditioning apparatus 100 according to Embodiment 1 is switched by a load required by the indoor unit 3. With this, the switching of the second refrigerant flow switching device 28 is determined.

The switching of the second refrigerant flow switching device 28 and the degree of the expansion device 26 for each operation mode are described below.

That is, the heating only operation mode, where the two intermediate heat exchangers 25*a* and 25*b* heat the heat medium circulating through the heat medium circulation circuit B, corresponds to pattern No. 6 in FIG. 7. In this mode, the two second refrigerant flow switching devices 28 are switched to the heating side, and the opening degree of each of the two expansion devices 26*a* and 26*b* is controlled such that the subcooling is constant.

The heating only temporary operation mode, where the heat medium circulating through the heat medium circulation circuit B is heated in the intermediate heat exchanger 25*b* alone, corresponds to pattern No. 5 in FIG. 7. In this mode, the second refrigerant flow switching device 28*a* is switched to the cooling side, and the second refrigerant flow switching device 28*b* is switched to the heating side. The expansion device 26*a* is fully closed, and the opening degree of the expansion device 26*b* is controlled such that the subcooling (degree of subcooling) is constant.

In addition, the heating main operation mode corresponds to pattern No. 4 in FIG. 7. In this mode, the second refrigerant flow switching device 28*a* is switched to the cooling side, and the second refrigerant flow switching device 28*b* is switched to the heating side. The expansion device 26*a* is fully opened, and the opening degree of the expansion device 26*b* is controlled such that the subcooling (degree of subcooling) is constant. That is, the switching of the second refrigerant flow switching device 28 in heating main operation mode and that in heating only temporary operation mode are the same.

For shifting from pattern No. 4 to pattern No. 6, pattern No. 4 is directly shifted to pattern No. 6, or pattern No. 4 is shifted to pattern No. 6 through pattern No. 5.

For shifting from pattern No. 6 to pattern No. 4, pattern No. 6 is only shifted directly to pattern No. 4, that is, without through pattern No. 5.

The cooling only operation mode, where the heat medium circulating through the heat medium circulation circuit B is cooled in the two intermediate heat exchangers 25*a* and 25*b*, corresponds to pattern No. 1 in FIG. 7. In this mode, the two second refrigerant flow switching devices 28 are switched to the cooling side, and the opening degree of each of the two expansion devices 26*a* and 26*b* is controlled such that the superheat (degree of superheat) is constant.

The cooling only temporary operation mode, where the heat medium circulating through the heat medium circulation circuit B is cooled in the intermediate heat exchanger 25*a* alone, corresponds to pattern No. 2 in FIG. 7. In this mode, the second refrigerant flow switching device 28*a* is switched to the cooling side, and the second refrigerant flow switching device 28*b* is switched to the heating side. The expansion device 26*b* is fully closed, and the opening degree of the expansion device 26*a* is controlled such that the superheat (degree of superheat) is constant.

In addition, the cooling main operation mode corresponds to pattern No. 3 in FIG. 7. In this mode, the second refrigerant flow switching device 28*a* is switched to the cooling side, and the second refrigerant flow switching device 28*b* is switched to the heating side. The expansion device 26*a* is fully opened, and the opening degree of the expansion device 26*b* is controlled such that the subcooling (degree of subcooling) is constant. That is, the switching of the second refrigerant flow switching device 28 in cooling main operation mode and that in cooling only temporary operation mode are the same.

For shifting from pattern No. 3 to pattern No. 1, pattern No. 3 is directly shifted to pattern No. 1, or pattern No. 3 is shifted to pattern No. 1 through pattern No. 2.

For shifting from pattern No. 1 to pattern No. 3, pattern No. 1 is only shifted directly to pattern No. 3, that is, without through pattern No. 2.

The table in FIG. 7 reveals that the switching of the second refrigerant flow switching device 28 is the minimum with respect to the supply capacity of the indoor unit 3.

Figure 8:
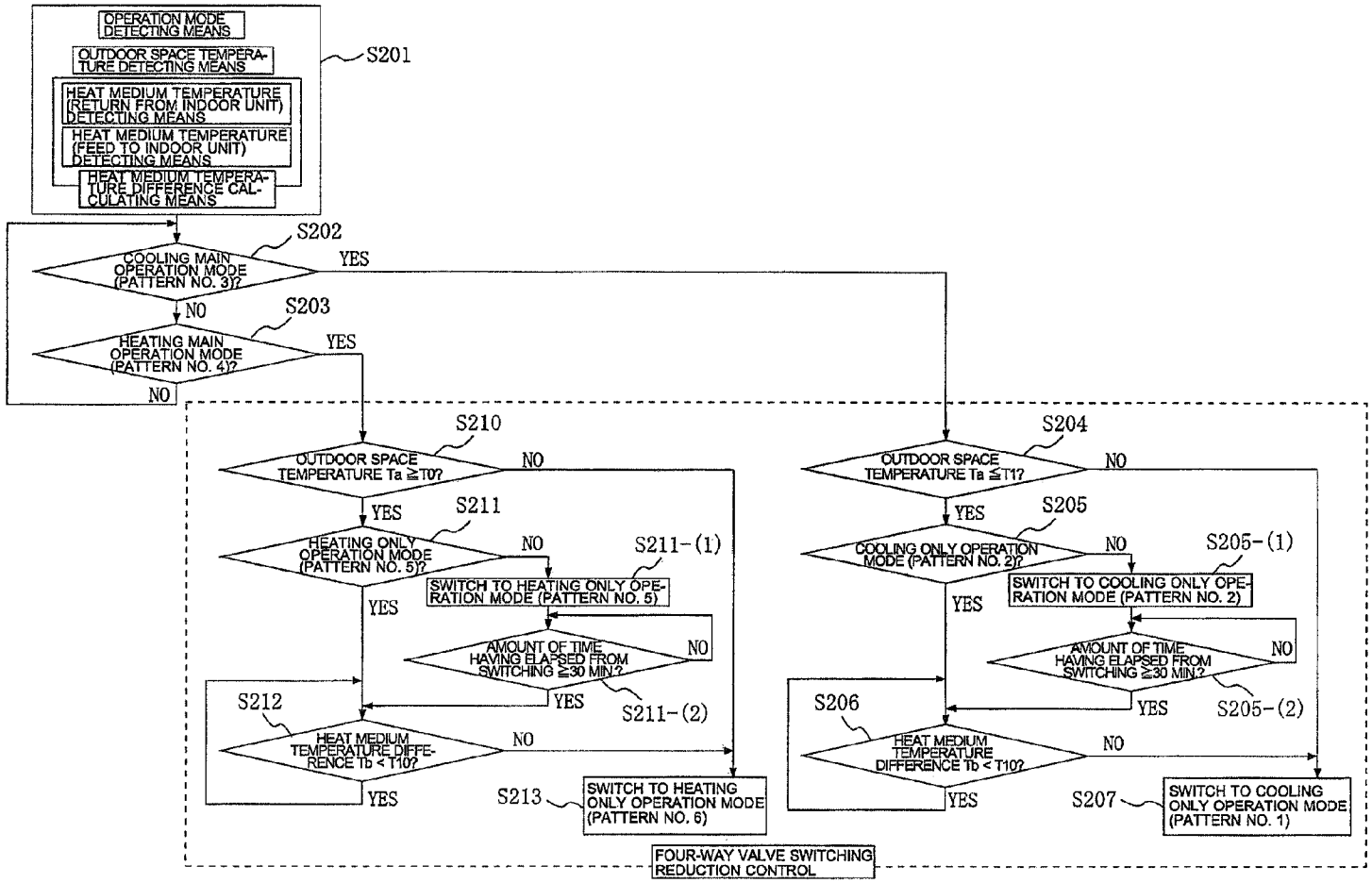
FIG. 8 is a flowchart that describes control for reducing the number of switching the second refrigerant flow switching device in the air-conditioning apparatus illustrated in FIG. 2.

FIG. 8 is a flowchart that describes control for reducing the number of switching the second refrigerant flow switching device 28 (four-way valve switching reduction control) in the air-conditioning apparatus 100 illustrated in FIG. 2. The four-way valve switching reduction control performed by the controller 51 is described with reference to FIG. 8.

(Step S201)

The controller 51 (four-way valve switching reduction means 50) receives a result of detection by the operation mode detecting means 41 (information indicating the operation mode of the indoor unit 3, the operation load, and the operation mode of the outdoor unit 1), a result of detection by the outdoor space temperature detecting means 42, and a result of calculation by the heat medium temperature difference calculating means 45. If the operation mode is switched, the controller 51 also receives information corresponding to the time elapsed from this switching.

(Step S202)

The controller 51 (four-way valve switching reduction means 50) determines whether the operation mode is the cooling main operation mode (corresponding to pattern No. 3 in FIG. 7).

When it is determined that the operation mode is the cooling main operation mode (YES), the processing proceeds to step S204.

When it is determined that the operation mode is not the cooling main operation mode (NO), the processing proceeds to step S203.

(Step S203)

The controller 51 (four-way valve switching reduction means 50) determines whether the operation mode is the heating main operation mode (corresponding to pattern No. 4 in FIG. 7).

When it is determined that the operation mode is the heating main operation mode (YES), the processing proceeds to step S210.

When it is determined that the operation mode is not the heating main operation mode (NO), the processing returns to step S202.

(Step S204)

The controller 51 (four-way valve switching reduction means 50) determines whether a detection result Ta by the outdoor space temperature detecting means 42 is at or below a predetermined temperature T1.

When it is determined that the detection result Ta is at or below the predetermined temperature T1 (YES), the processing proceeds to step S205. The reason why the processing proceeds to step S205 is that because the outside of a room is not so hot the cooling capacity required by the indoor unit 3 can be provided by the cooling only temporary operation mode.

When it is determined that the detection result Ta is not at or below the predetermined temperature T1 (NO), the processing proceeds to step S207. The reason why the processing proceeds to step S207 is that because the outside of a room is hot the cooling capacity required by the indoor unit 3 cannot be provided by the cooling only temporary operation mode.

An example of the predetermined temperature T1 may be 28 degrees C.

(Step S205)

The controller 51 (four-way valve switching reduction means 50) determines whether the operation mode is the cooling only temporary operation mode (corresponding to pattern No. 2 in FIG. 7).

When it is determined that the operation mode is the cooling only temporary operation mode (YES), the processing proceeds to step S206.

When it is determined that the operation mode is not the cooling only temporary operation mode (NO), the processing proceeds to step S205-(1).

(Step S205-(1))

The controller 51 (four-way valve switching reduction means 50) switches the operation mode to the cooling only temporary operation mode. After the control in step S205-(1), the processing proceeds to step S205-(2).

(Step S205-(2))

The controller 51 (four-way valve switching reduction means 50) determines whether the amount of time having elapsed from the switching to the cooling only temporary operation mode is equal to or larger than a predetermined amount of time. As illustrated in FIG. 8, an example of the predetermined amount of time may be 30 minutes or more.

When it is determined that the amount of time having elapsed is equal to or larger than the predetermined amount of time (YES), the processing proceeds to step S206.

When it is determined that the amount of time having elapsed is not equal to or larger than the predetermined amount of time (NO), step S205-(2) is executed again.

(Step S206)

The controller 51 (four-way valve switching reduction means 50) determines whether a detection result Tb by the heat medium temperature difference calculating means 45 is smaller than a predetermined temperature difference T10.

When it is determined that the detection result Tb is smaller than the predetermined temperature difference T10 (YES), step S206 is executed again. The reason why step S206 is executed again is that because the detection result Tb is smaller than the predetermined temperature difference T10 the capability of the cooling operation in cooling only temporary operation mode is sufficient.

When it is determined that the detection result Tb is not smaller than the predetermined temperature difference T10 (NO), the processing proceeds to step S207. The reason why the processing proceeds to step S207 is that because the detection result Tb is not smaller than the predetermined temperature difference T10 the capability of the cooling operation in cooling only temporary operation mode is not sufficient.

An example of the predetermined temperature difference T10 may be 5 degrees C.

In the controller 51, a first criterion value for use in comparison with the detection result Tb by the heat medium temperature difference calculating means 45 is set in advance. In this step S206, determination whether the difference between the detection result Tb and the first criterion value is smaller than the predetermined temperature difference T10 enables the operation capability of the air-conditioning apparatus 100 to be determined.

The first criterion value is set on the condition that the quantity of water supplied to the indoor unit 3 is constant. It is merely required that the excess or deficiency of the operation capability of the air-conditioning apparatus 100 can be determined. If the quantity of water supplied to the indoor unit 3 is made to vary, the above-described first criterion value may not be used.

(Step S207)

The controller 51 (four-way valve switching reduction means 50) switches the operation mode to the cooling only operation mode.

(Step S210)

The controller 51 (four-way valve switching reduction means 50) determines whether the detection result Ta by the outdoor space temperature detecting means 42 is at or above a predetermined temperature T0.

When it is determined that the detection result Ta is at or above the predetermined temperature T0 (YES), the processing proceeds to step S211. The reason why the processing proceeds to step S211 is that because the outside of a room is not so cold the heating capacity required by the indoor unit 3 can be provided by the heating only temporary operation mode.

When it is determined that the detection result Ta is not at or above the predetermined temperature T0 (NO), the processing proceeds to step S213. The reason why the processing proceeds to step S213 is that because the outside of a room is cold the heating capacity cannot be provided by the heating only temporary operation mode.

An example of the predetermined temperature T0 may be −5 degrees C.

(Step S211)

The controller 51 (four-way valve switching reduction means 50) determines whether the operation mode is the heating only temporary operation mode (corresponding to pattern No. 5 in FIG. 7).

When it is determined that the operation mode is the heating only temporary operation mode (YES), the processing proceeds to step S212.

When it is determined that the operation mode is not the heating only temporary operation mode (NO), the processing proceeds to step S211-(1).

(Step S211-(1))

The controller 51 (four-way valve switching reduction means 50) switches the operation mode to the heating only temporary operation mode. After the control in step S211-(1), the processing proceeds to step S211-(2).

(Step S211-(2))

The controller 51 (four-way valve switching reduction means 50) determines whether the amount of time having elapsed from the switching to the heating only temporary operation mode is equal to or larger than a predetermined amount of time. As illustrated in FIG. 8, an example of the predetermined amount of time may be 30 minutes or more.

When it is determined that the amount of time having elapsed is equal to or larger than the predetermined amount of time (YES), the processing proceeds to step S212.

When it is determined that the amount of time having elapsed is not equal to or larger than the predetermined amount of time (NO), step S211-(2) is executed again.

(Step S212)

The controller 51 (four-way valve switching reduction means 50) determines whether the detection result Tb by the heat medium temperature difference calculating means 45 is smaller than the predetermined temperature difference T10.

When it is determined that the detection result Tb is smaller than the predetermined temperature difference T10 (YES), step S212 is executed again. The reason why step S212 is executed again is that because the detection result Tb is smaller than the predetermined temperature difference T10 the capability of the heating operation in heating only temporary operation mode is sufficient.

When it is determined that the detection result Tb is not smaller than the predetermined temperature difference T10 (NO), the processing proceeds to step S213. The reason why the processing proceeds to step S213 is that because the detection result Tb is not smaller than the predetermined temperature difference T10 the capability of the heating operation in heating only temporary operation mode is not sufficient.

An example of the predetermined temperature difference T10 may be 5 degrees C.

In the controller 51, a second criterion value for use in comparison with the detection result Tb by the heat medium temperature difference calculating means 45 is set in advance. In this step S212, determination whether the difference between the detection result Tb and the second criterion value is smaller than the predetermined temperature difference T10 enables the operation capability of the air-conditioning apparatus 100 to be determined.

The second criterion value is set on the condition that the quantity of water supplied to the indoor unit 3 is constant. It is merely required that the excess or deficiency of the operation capability of the air-conditioning apparatus 100 can be determined. If the quantity of water supplied to the indoor unit 3 is made to vary, the above-described second criterion value may not be used.

(Step S213)

The controller 51 (four-way valve switching reduction means 50) switches the operation mode to the heating only operation mode.

[Advantageous Effects of Air-Conditioning Apparatus 100 According to Embodiment 1]

For a traditional air-conditioning apparatus capable of executing a cooling and heating mixed operation mode, a reduction in the number of switching a flow switching device, such as a four-way valve, between a cooling main operation mode and a cooling only operation mode and between a heating main operation mode and a heating only operation mode is not considered. In contrast to this, the air-conditioning apparatus 100 according to Embodiment 1 has the cooling only temporary operation mode and the heating only temporary operation mode and can achieve the four-way valve switching reduction control performed by the four-way valve switching reduction means 50, as described above.

This means that in switching between the cooling main operation mode and the cooling only operation mode (between step S202 and step S204) and between the heating main operation mode and the heating only operation mode (between step S203 and step S210), the second refrigerant flow switching device 28 is not switched. That is, in the above-described operation-mode switching, even if the heating capacity or cooling capacity required by the air-conditioning apparatus 100 varies, no switching occurs in the second refrigerant flow switching device 28.

Accordingly, because the air-conditioning apparatus 100 according to Embodiment 1 can reduce the number of switching the second refrigerant flow switching device 28, degradation caused by operations of the second refrigerant flow switching device 28 can be reduced, the number of variations in refrigerant resulting from switching can be reduced, and the operation reliability of the air-conditioning apparatus 100 can be improved.

A reduction in the number of switching the second refrigerant flow switching device 28 can reduce the frequency of occurrence of switching sounds correspondingly. Thus even if the second refrigerant flow switching device 28 is disposed in the vicinity of the inside of a room, a decrease in the comfort of users can be suppressed.

The second refrigerant flow switching device 28 is described as comprising a four-way valve. The second refrigerant flow switching device 28 may also comprise a combination of other elements, such as a three-way valve and a two-way valve, the combination having the function equivalent to that of a four-way valve.

Embodiment 2

Figure 10:
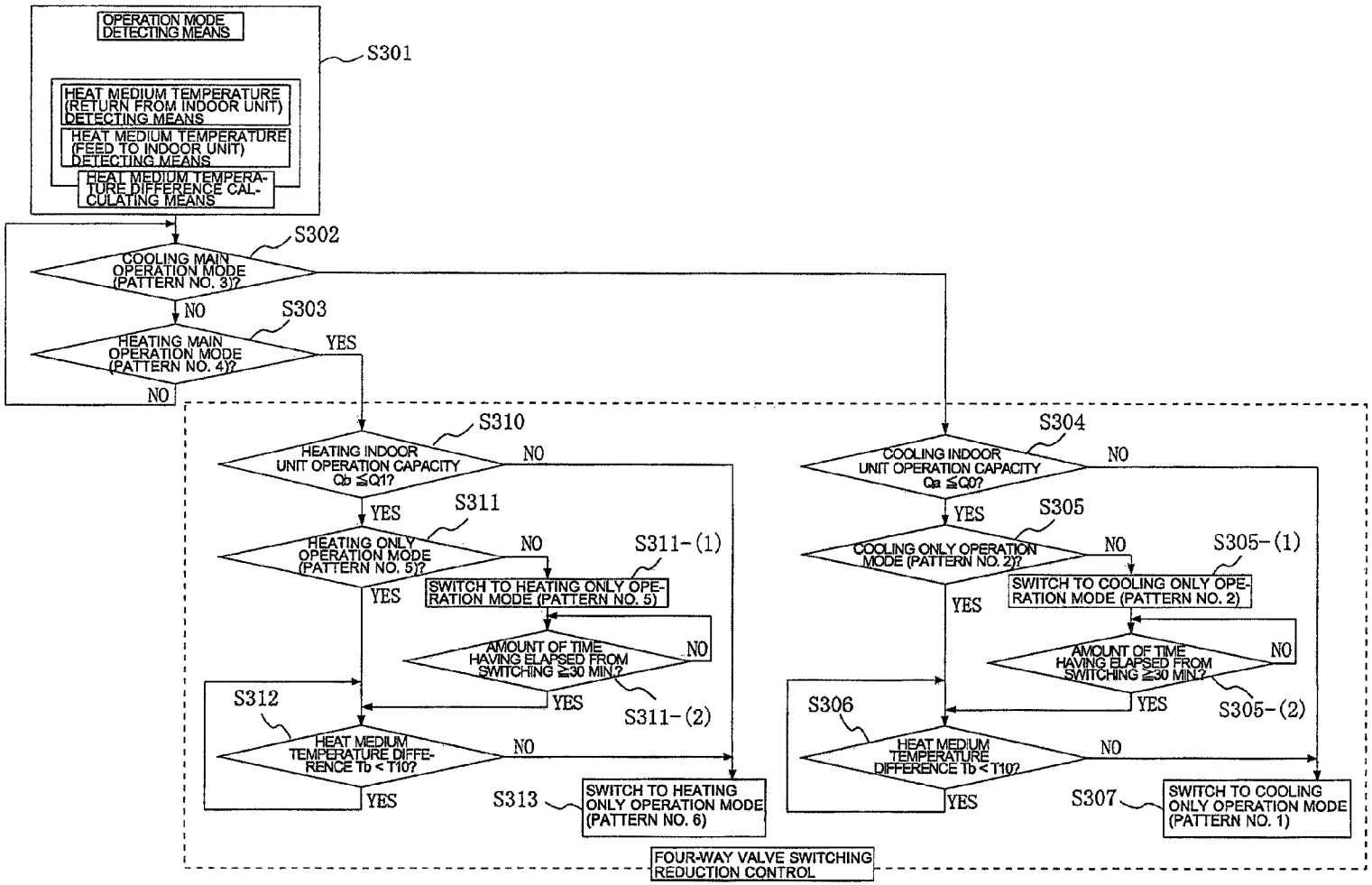
FIG. 10 is a flowchart that describes control for reducing the number of switching the second refrigerant flow switching device in the air-conditioning apparatus according to Embodiment 2 of the present invention.

FIG. 9 is a table that describes switching of the second refrigerant flow switching device 28, the opening degree of the expansion device 26, and the operation capacity of the indoor unit 3 for each operation mode in the air-conditioning apparatus according to Embodiment 2. FIG. 10 is a flowchart that describes control for reducing the number of switching the second refrigerant flow switching device 28 in the air-conditioning apparatus according to Embodiment 2.

In Embodiment 2, differences from Embodiment 1 are mainly described, and the same parts as in Embodiment 1 have the same reference numerals. The configuration of the refrigerant circuit and operation mode of the air-conditioning apparatus according to Embodiment 2 are substantially the same as those of the air-conditioning apparatus 100 according to Embodiment 1.

The air-conditioning apparatus according to Embodiment 2 performs control based on an operation load (operation capacity) of the indoor unit 3 (see step S304 and step S310 in FIG. 10), in place of control based on an outdoor space temperature in the air-conditioning apparatus 100 according to Embodiment 1 (see step S204 and step S210 in FIG. 8).

Four-way valve switching reduction control performed by the controller 51 in the air-conditioning apparatus according to Embodiment 2 is described with reference to FIGS. 9 and 10.

(Step S301)

The controller 51 (four-way valve switching reduction means 50) receives a result of detection by the operation mode detecting means 41 (information indicating the operation mode of the indoor unit 3, the operation load, and the operation mode of the outdoor unit 1) and a result of calculation by the heat medium temperature difference calculating means 45. If the operation mode is switched, the controller 51 also receives information corresponding to the time elapsed from this switching.

(Step S302)

The controller 51 (four-way valve switching reduction means 50) determines whether the operation mode is the cooling main operation mode (corresponding to pattern No. 3 in FIG. 9).

When it is determined that the operation mode is the cooling main operation mode (YES), the processing proceeds to step S304.

When it is determined that the operation mode is not the cooling main operation mode (NO), the processing proceeds to step S303.

(Step S303)

The controller 51 (four-way valve switching reduction means 50) determines whether the operation mode is the heating main operation mode (corresponding to pattern No. 4 in FIG. 9).

When it is determined that the operation mode is the heating main operation mode (YES), the processing proceeds to step S310.

When it is determined that the operation mode is not the heating main operation mode (NO), the processing returns to step S302.

(Step S304)

The controller 51 (four-way valve switching reduction means 50) determines whether a cooling indoor unit operation capacity Qa detected by the operation mode detecting means 41 is at or below a predetermined operation capacity Q0.

When it is determined that the cooling indoor unit operation capacity Qa is at or below the predetermined operation capacity Q0 (YES), the processing proceeds to step S305. The reason why the processing proceeds to step S305 is that because the cooling load (capacity) of the indoor unit 3 is not so large the cooling capacity required by the indoor unit 3 can be provided by the cooling only temporary operation mode.

When it is determined that the cooling indoor unit operation capacity Qa is not at or below the predetermined operation capacity Q0 (NO), the processing proceeds to step S307. The reason why the processing proceeds to step S307 is that because the cooling load (capacity) of the indoor unit 3 is large the cooling capacity required by the indoor unit 3 cannot be provided by the cooling only temporary operation mode.

An example of the predetermined operation capacity Q0 may be 50% load.

(Step S305)

The controller 51 (four-way valve switching reduction means 50) determines whether the operation mode is the cooling only temporary operation mode (corresponding to pattern No. 2 in FIG. 9).

When it is determined that the operation mode is the cooling only temporary operation mode (YES), the processing proceeds to step S306.

When it is determined that the operation mode is not the cooling only temporary operation mode (NO), the processing proceeds to step S305-(1).

(Step S305-(1))

The controller 51 (four-way valve switching reduction means 50) switches the operation mode to the cooling only temporary operation mode. After the control in step S305-(1), the processing proceeds to step S305-(2).

(Step S305-(2))

The controller 51 (four-way valve switching reduction means 50) determines whether the amount of time having elapsed from the switching to the cooling only temporary operation mode is equal to or larger than a predetermined amount of time. As illustrated in FIG. 10, an example of the predetermined amount of time may be 30 minutes or more.

When it is determined that the amount of time having elapsed is equal to or larger than the predetermined amount of time (YES), the processing proceeds to step S306.

When it is determined that the amount of time having elapsed is not equal to or larger than the predetermined amount of time (NO), step S305-(2) is executed again.

(Step S306)

The controller 51 (four-way valve switching reduction means 50) determines whether the detection result Tb by the heat medium temperature difference calculating means 45 is smaller than a predetermined temperature difference T10.

When it is determined that the detection result Tb is smaller than the predetermined temperature difference T10 (YES), step S306 is executed again. The reason why step S306 is executed again is that because the detection result Tb is smaller than the predetermined temperature difference T10 the capability of the cooling operation in cooling only temporary operation mode is sufficient.

When it is determined that the detection result Tb is not smaller than the predetermined temperature difference T10 (NO), the processing proceeds to step S307. The reason why the processing proceeds to step S307 is that because the detection result Tb is not smaller than the predetermined temperature difference T10 the capability of the cooling operation in cooling only temporary operation mode is not sufficient.

An example of the predetermined temperature difference T10 may be 5 degrees C.

In the controller 51, the first criterion value for use in comparison with the detection result Tb by the heat medium temperature difference calculating means 45 is set in advance. In this step S306, determination whether the difference between the detection result Tb and the first criterion value is smaller than the predetermined temperature difference T10 enables the operation capability of the air-conditioning apparatus according to Embodiment 2 to be determined.

The first criterion value is set on the condition that the quantity of water supplied to the indoor unit 3 is constant. It is merely required that the excess or deficiency of the operation capability of the air-conditioning apparatus according to Embodiment 2 can be determined. If the quantity of water supplied to the indoor unit 3 is made to vary, the above-described first criterion value may not be used.

(Step S307)

The controller 51 (four-way valve switching reduction means 50) switches the operation mode to the cooling only operation mode.

(Step S310)

The controller 51 (four-way valve switching reduction means 50) determines whether a heating indoor unit operation capacity Qb detected by the operation mode detecting means 41 is at or below a predetermined operation capacity Q1.

When it is determined that the heating indoor unit operation capacity Qb is at or below the predetermined operation capacity Q1 (YES), the processing proceeds to step S311. The reason why the processing proceeds to step S311 is that because the heating load (heating capacity) of the indoor unit 3 is not so large the heating capacity required by the indoor unit 3 can be provided by the heating only temporary operation mode.

When it is determined that the heating indoor unit operation capacity Qb is not at or below the predetermined operation capacity Q1 (NO), the processing proceeds to step S313. The reason why the processing proceeds to step S313 is that because the heating load (heating capacity) of the indoor unit 3 is large the heating capacity required by the indoor unit 3 cannot be provided by the heating only temporary operation mode.

An example of the predetermined operation capacity Q1 may be 50% load.

(Step S311)

The controller 51 (four-way valve switching reduction means 50) determines whether the operation mode is the heating only temporary operation mode (corresponding to pattern No. 5 in FIG. 9).

When it is determined that the operation mode is the heating only temporary operation mode (YES), the processing proceeds to step S312.

When it is determined that the operation mode is not the heating only temporary operation mode (NO), the processing proceeds to step S311-(1).

(Step S311-(1))

The controller 51 (four-way valve switching reduction means 50) switches the operation mode to the heating only temporary operation mode. After the control in step S311-(1), the processing proceeds to step S311-(2).

(Step S311-(2))

The controller 51 (four-way valve switching reduction means 50) determines whether the amount of time having elapsed from the switching to the heating only temporary operation mode is equal to or larger than a predetermined amount of time. As illustrated in FIG. 10, an example of the predetermined amount of time may be 30 minutes or more.

When it is determined that the amount of time having elapsed is equal to or larger than the predetermined amount of time (YES), the processing proceeds to step S312.

When it is determined that the amount of time having elapsed is not equal to or larger than the predetermined amount of time (NO), step S311-(2) is executed again.

(Step S312)

The controller 51 (four-way valve switching reduction means 50) determines whether the detection result Tb by the heat medium temperature difference calculating means 45 is smaller than the predetermined temperature difference T10.

When it is determined that the detection result Tb is smaller than the predetermined temperature difference T10 (YES), step S312 is executed again. The reason why step S312 is executed again is that because the detection result Tb is smaller than the predetermined temperature difference T10 the capability of the heating operation in heating only temporary operation mode is sufficient.

When it is determined that the detection result Tb is not smaller than the predetermined temperature difference T10 (NO), the processing proceeds to step S313. The reason why the processing proceeds to step S313 is that because the detection result Tb is not smaller than the predetermined temperature difference T10 the capability of the heating operation in heating only temporary operation mode is not sufficient.

An example of the predetermined temperature difference T10 may be 5 degrees C.

In the controller 51, the second criterion value for use in comparison with the detection result Tb by the heat medium temperature difference calculating means 45 is set in advance. In this step S312, determination whether the difference between the detection result Tb and the second criterion value is smaller than the predetermined temperature difference T10 enables the operation capability of the air-conditioning apparatus according to Embodiment 2 to be determined.

The second criterion value is set on the condition that the quantity of water supplied to the indoor unit 3 is constant. It is merely required that the excess or deficiency of the operation capability of the air-conditioning apparatus according to Embodiment 2 can be determined. If the quantity of water supplied to the indoor unit 3 is made to vary, the above-described second criterion value may not be used.

(Step S313)

The controller 51 (four-way valve switching reduction means 50) switches the operation mode to the heating only operation mode.

[Advantageous Effects of Air-Conditioning Apparatus According to Embodiment 2]

The air-conditioning apparatus according to Embodiment 2 has control for switching the operation mode on the basis of the operation load (operation capacity) of the indoor unit 3 and has substantially the same advantageous effects as those of the air-conditioning apparatus 100 according to Embodiment 1.

Embodiment 3

Figure 12:
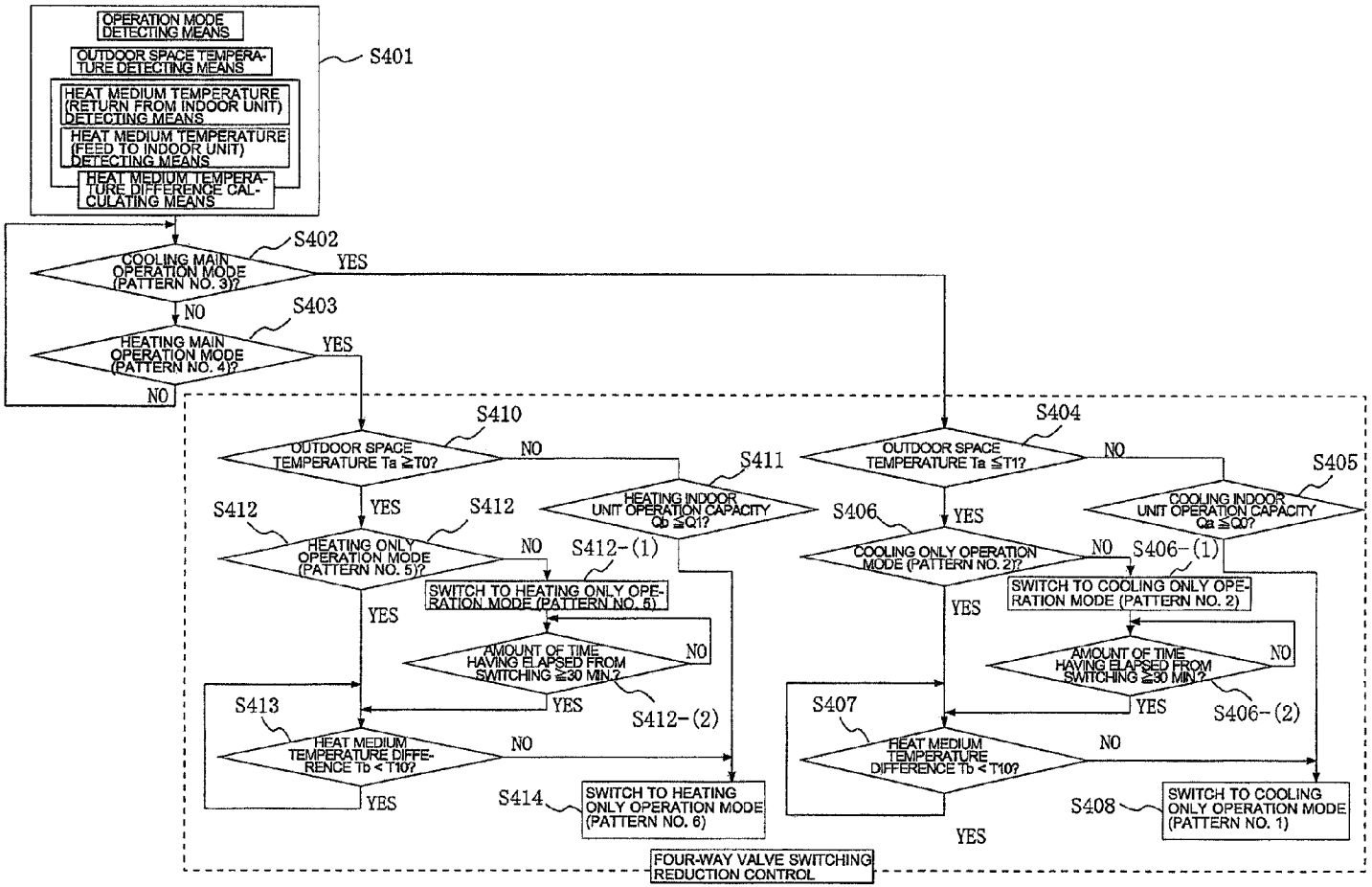
FIG. 12 is a flowchart that describes control for reducing the number of switching the second refrigerant flow switching device in the air-conditioning apparatus according to Embodiment 3 of the present invention.

FIG. 11 is a table that describes switching of the second refrigerant flow switching device 28, the opening degree of the expansion device 26, and the operation capacity of the indoor unit 3 for each operation mode in the air-conditioning apparatus according to Embodiment 3. FIG. 12 is a flowchart that describes control for reducing the number of switching the second refrigerant flow switching device 28 in the air-conditioning apparatus according to Embodiment 3.

In Embodiment 3, differences from Embodiments 1 and 2 are mainly described, and the same parts as in Embodiments 1 and 2 have the same reference numerals. The configuration of the refrigerant circuit and operation mode of the air-conditioning apparatus according to Embodiment 3 are substantially the same as those of the air-conditioning apparatus 100 according to Embodiment 1.

Control for reducing the number of switching the second refrigerant flow switching device 28 in the air-conditioning apparatus according to Embodiment 3 is the one in which control based on an outdoor space temperature in the air-conditioning apparatus 100 according to Embodiment 1 (see step S204 and step S210 in FIG. 8) and control based on an operation load (operation capacity) of the indoor unit 3 in the air-conditioning apparatus according to Embodiment 2 (see step S304 and step S310 in FIG. 10) are combined.

(Step S401)

The controller 51 (four-way valve switching reduction means 50) receives a result of detection by the operation mode detecting means 41 (information indicating the operation mode of the indoor unit 3, the operation load, and the operation mode of the outdoor unit 1), a result of detection by the outdoor space temperature detecting means 42, and a result of calculation by the heat medium temperature difference calculating means 45. If the operation mode is switched, the controller 51 also receives information corresponding to the time elapsed from this switching.

(Step S402)

The controller 51 (four-way valve switching reduction means 50) determines whether the operation mode is the cooling main operation mode (corresponding to pattern No. 3 in FIG. 11).

When it is determined that the operation mode is the cooling main operation mode (YES), the processing proceeds to step S404.

When it is determined that the operation mode is not the cooling main operation mode (NO), the processing proceeds to step S403.

(Step S403)

The controller 51 (four-way valve switching reduction means 50) determines whether the operation mode is the heating main operation mode (corresponding to pattern No. 4 in FIG. 11).

When it is determined that the operation mode is the heating main operation mode (YES), the processing proceeds to step S410.

When it is determined that the operation mode is not the heating main operation mode (NO), the processing returns to step S402.

(Step S404)

The controller 51 (four-way valve switching reduction means 50) determines whether the detection result Ta by the outdoor space temperature detecting means 42 is at or below the predetermined temperature T1.

When it is determined that the detection result Ta is at or below the predetermined temperature T1 (YES), the processing proceeds to step S406. The reason why the processing proceeds to step S406 is that because the outside of a room is not so hot the cooling capacity required by the indoor unit 3 can be provided by the cooling only temporary operation mode.

When it is determined that the detection result Ta is not at or below the predetermined temperature T1 (NO), the processing proceeds to step S405. The reason why the processing proceeds to step S405 is that because the outside of a room is hot the cooling capacity required by the indoor unit 3 cannot be provided by the cooling only temporary operation mode.

An example of the predetermined temperature T1 may be 28 degrees C.

(Step S405)

The controller 51 (four-way valve switching reduction means 50) determines whether the cooling indoor unit operation capacity Qa detected by the operation mode detecting means 41 is at or below the predetermined operation capacity Q0.

When it is determined that the cooling indoor unit operation capacity Qa is at or below the predetermined operation capacity Q0 (YES), the processing proceeds to step S406. The reason why the processing proceeds to step S406 is that, because the outside of a room is hot and the cooling load (capacity) of the indoor unit 3 is not so large, the cooling capacity required by the indoor unit 3 can be provided by the cooling only temporary operation mode.

When it is determined that the cooling indoor unit operation capacity Qa is not at or below the predetermined operation capacity Q0 (NO), the processing proceeds to step S408. The reason why the processing proceeds to step S408 is that because the cooling load (capacity) of the indoor unit 3 is large the cooling capacity required by the indoor unit 3 cannot be provided by the cooling only temporary operation mode.

An example of the predetermined operation capacity Q0 may be 50% load.

(Step S406)

The controller 51 (four-way valve switching reduction means 50) determines whether the operation mode is the cooling only temporary operation mode (corresponding to pattern No. 2 in FIG. 11).

When it is determined that the operation mode is the cooling only temporary operation mode (YES), the processing proceeds to step S407.

When it is determined that the operation mode is not the cooling only temporary operation mode (NO), the processing proceeds to step S406-(1).

(Step S406-(1))

The controller 51 (four-way valve switching reduction means 50) switches the operation mode to the cooling only temporary operation mode. After the control in step S406-(1), the processing proceeds to step S406-(2).

(Step S406-(2))

The controller 51 (four-way valve switching reduction means 50) determines whether the amount of time having elapsed from the switching to the cooling only temporary operation mode is equal to or larger than a predetermined amount of time. As illustrated in FIG. 12, an example of the predetermined amount of time may be 30 minutes or more.

When it is determined that the amount of time having elapsed is equal to or larger than the predetermined amount of time (YES), the processing proceeds to step S407.

When it is determined that the amount of time having elapsed is not equal to or larger than the predetermined amount of time (NO), step S406-(2) is executed again.

(Step S407)

The controller 51 (four-way valve switching reduction means 50) determines whether the detection result Tb by the heat medium temperature difference calculating means 45 is smaller than a predetermined temperature difference T10.

When it is determined that the detection result Tb is smaller than the predetermined temperature difference T10 (YES), step S407 is executed again. The reason why step S407 is executed again is that because the detection result Tb is smaller than the predetermined temperature difference T10 the capability of the cooling operation in cooling only temporary operation mode is sufficient.

When it is determined that the detection result Tb is not smaller than the predetermined temperature difference T10 (NO), the processing proceeds to step S408. The reason why the processing proceeds to step S408 is that because the detection result Tb is not smaller than the predetermined temperature difference T10 the capability of the cooling operation in cooling only temporary operation mode is not sufficient.

An example of the predetermined temperature difference T10 may be 5 degrees C.

In the controller 51, the first criterion value for use in comparison with the detection result Tb by the heat medium temperature difference calculating means 45 is set in advance. In this step S407, determination whether the difference between the detection result Tb and the first criterion value is smaller than the predetermined temperature difference T10 enables the operation capability of the air-conditioning apparatus according to Embodiment 3 to be determined.

The first criterion value is set on the condition that the quantity of water supplied to the indoor unit 3 is constant. It is merely required that the excess or deficiency of the operation capability of the air-conditioning apparatus according to Embodiment 3 can be determined. If the quantity of water supplied to the indoor unit 3 is made to vary, the above-described first criterion value may not be used.

(Step S408)

The controller 51 (four-way valve switching reduction means 50) switches the operation mode to the cooling only operation mode.

(Step S410)

The controller 51 (four-way valve switching reduction means 50) determines whether the detection result Ta by the outdoor space temperature detecting means 42 is at or above the predetermined temperature T0.

When it is determined that the detection result Ta is at or above the predetermined temperature T0 (YES), the processing proceeds to step S412. The reason why the processing proceeds to step S412 is that because the outside of a room is not so cold the heating capacity required by the indoor unit 3 can be provided by the heating only temporary operation mode.

When it is determined that the detection result Ta is not at or above the predetermined temperature T0 (NO), the processing proceeds to step S411. The reason why the processing proceeds to step S411 is that because the outside of a room is cold the heating capacity cannot be provided by the heating only temporary operation mode.

An example of the predetermined temperature T0 may be −5 degrees C.

(Step S411)

The controller 51 (four-way valve switching reduction means 50) determines whether the heating indoor unit operation capacity Qb detected by the operation mode detecting means 41 is at or below the predetermined operation capacity Q1.

When it is determined that the heating indoor unit operation capacity Qb is at or below the predetermined operation capacity Q1 (YES), the processing proceeds to step S412. The reason why the processing proceeds to step S412 is that, because, although the outside of a room is cold, the heating load (heating capacity) of the indoor unit 3 is not so large, the heating capacity required by the indoor unit 3 can be provided by the heating only temporary operation mode.

When it is determined that the heating indoor unit operation capacity Qb is not at or below the predetermined operation capacity Q1 (NO), the processing proceeds to step S414. The reason why the processing proceeds to step S414 is that, because the outside of a room is cold and the heating load (heating capacity) of the indoor unit 3 is large, the heating capacity required by the indoor unit 3 cannot be provided by the heating only temporary operation mode.

An example of the predetermined operation capacity Q1 may be 50% load.

(Step S412)

The controller 51 (four-way valve switching reduction means 50) determines whether the operation mode is the heating only temporary operation mode (corresponding to pattern No. 5 in FIG. 11).

When it is determined that the operation mode is the heating only temporary operation mode (YES), the processing proceeds to step S413.

When it is determined that the operation mode is not the heating only temporary operation mode (NO), the processing proceeds to step S412-(1).

(Step S412-(1))

The controller 51 (four-way valve switching reduction means 50) switches the operation mode to the heating only temporary operation mode. After the control in step S412-(1), the processing proceeds to step S412-(2).

(Step S412-(2))

The controller 51 (four-way valve switching reduction means 50) determines whether the amount of time having elapsed from the switching to the heating only temporary operation mode is equal to or larger than a predetermined amount of time. As illustrated in FIG. 12, an example of the predetermined amount of time may be 30 minutes or more.

When it is determined that the amount of time having elapsed is equal to or larger than the predetermined amount of time (YES), the processing proceeds to step S413.

When it is determined that the amount of time having elapsed is not equal to or larger than the predetermined amount of time (NO), step S412-(2) is executed again.

(Step S413)

The controller 51 (four-way valve switching reduction means 50) determines whether the detection result Tb by the heat medium temperature difference calculating means 45 is smaller than the predetermined temperature difference T10.

When it is determined that the detection result Tb is smaller than the predetermined temperature difference T10 (YES), step S413 is executed again. The reason why step S413 is executed again is that because the detection result Tb is smaller than the predetermined temperature difference T10 the capability of the heating operation in heating only temporary operation mode is sufficient.

When it is determined that the detection result Tb is not smaller than the predetermined temperature difference T10 (NO), the processing proceeds to step S414. The reason why the processing proceeds to step S414 is that because the detection result Tb is not smaller than the predetermined temperature difference T10 the capability of the heating operation in heating only temporary operation mode is not sufficient.

An example of the predetermined temperature difference T10 may be 5 degrees C.

In the controller 51, the second criterion value for use in comparison with the detection result Tb by the heat medium temperature difference calculating means 45 is set in advance. In this step S413, determination whether the difference between the detection result Tb and the second criterion value is smaller than the predetermined temperature difference T10 enables the operation capability of the air-conditioning apparatus according to Embodiment 3 to be determined.

The second criterion value is set on the condition that the quantity of water supplied to the indoor unit 3 is constant. It is merely required that the excess or deficiency of the operation capability of the air-conditioning apparatus according to Embodiment 3 can be determined. If the quantity of water supplied to the indoor unit 3 is made to vary, the above-described second criterion value may not be used.

(Step S414)

The controller 51 (four-way valve switching reduction means 50) switches the operation mode to the heating only operation mode.

[Advantageous Effects of Air-Conditioning Apparatus According to Embodiment 3]

The air-conditioning apparatus according to Embodiment 3 has control based on an outdoor space temperature in the air-conditioning apparatus 100 according to Embodiment 1 and control based on an operation load in the air-conditioning apparatus according to Embodiment 2 and has substantially the same advantageous effects as those of the air-conditioning apparatus 100 according to Embodiment 1.

Embodiment 4

Figure 14:
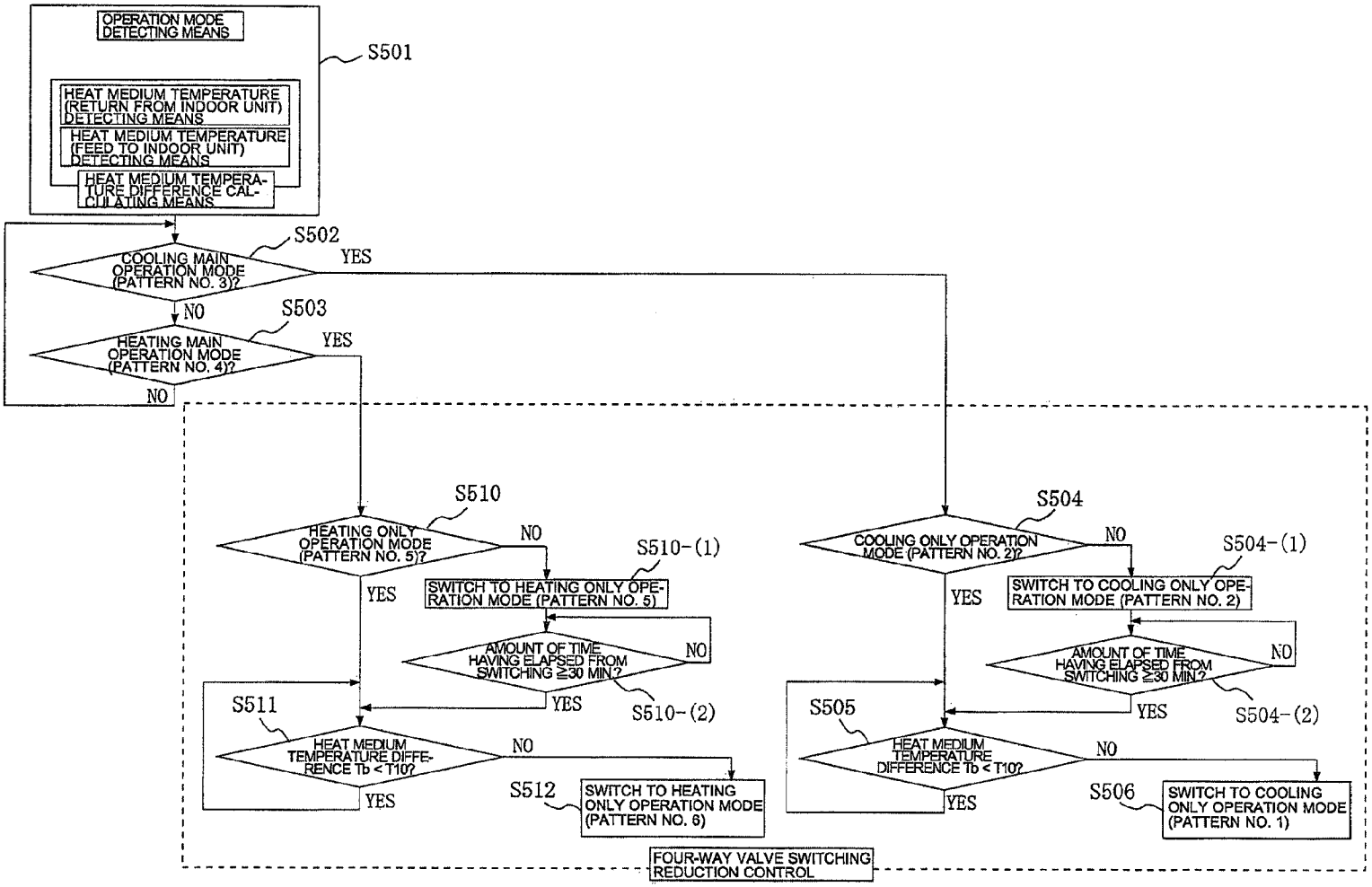
FIG. 14 is a flowchart that describes control for reducing the number of switching the second refrigerant flow switching device in the air-conditioning apparatus according to Embodiment 4 of the present invention.

FIG. 13 is a table that describes switching of the second refrigerant flow switching device 28 and the opening degree of the expansion device 26 for each operation mode in the air-conditioning apparatus according to Embodiment 4. FIG. 14 is a flowchart that describes control for reducing the number of switching the second refrigerant flow switching device 28 in the air-conditioning apparatus according to Embodiment 4.

In Embodiment 4, differences from Embodiments 1 to 3 described above are mainly described, and the same parts as in Embodiments 1 to 3 have the same reference numerals. The configuration of the refrigerant circuit and operation mode of the air-conditioning apparatus according to Embodiment 4 are substantially the same as those of the air-conditioning apparatus 100 according to Embodiment 1.

The air-conditioning apparatus according to Embodiment 4 omits the control based on an outdoor space temperature in the air-conditioning apparatus 100 according to Embodiment 1 (see step S204 and step S210 in FIG. 8) and determines the cooling only temporary operation mode or the heating only temporary operation mode (see step S205 and step S211 in FIG. 8).

Four-way valve switching reduction control performed by the controller 51 in the air-conditioning apparatus according to Embodiment 4 is described with reference to FIGS. 13 and 14.

(Step S501)

The controller 51 (four-way valve switching reduction means 50) receives a result of detection by the operation mode detecting means 41 (information indicating the operation mode of the indoor unit 3, the operation load, and the operation mode of the outdoor unit 1) and a result of calculation by the heat medium temperature difference calculating means 45. If the operation mode is switched, the controller 51 also receives information corresponding to the time elapsed from this switching.

(Step S502)

The controller 51 (four-way valve switching reduction means 50) determines whether the operation mode is the cooling main operation mode (corresponding to pattern No. 3 in FIG. 13).

When it is determined that the operation mode is the cooling main operation mode (YES), the processing proceeds to step S504.

When it is determined that the operation mode is not the cooling main operation mode (NO), the processing proceeds to step S503.

(Step S503)

The controller 51 (four-way valve switching reduction means 50) determines whether the operation mode is the heating main operation mode (corresponding to pattern No. 4 in FIG. 13).

When it is determined that the operation mode is the heating main operation mode (YES), the processing proceeds to step S510.

When it is determined that the operation mode is not the heating main operation mode (NO), the processing returns to step S502.

(Step S504)

The controller 51 (four-way valve switching reduction means 50) determines whether the operation mode is the cooling only temporary operation mode (corresponding to pattern No. 2 in FIG. 13).

When it is determined that the operation mode is the cooling only temporary operation mode (YES), the processing proceeds to step S505.

When it is determined that the operation mode is not the cooling only temporary operation mode (NO), the processing proceeds to step S504-(1).

(Step S504-(1))

The controller 51 (four-way valve switching reduction means 50) switches the operation mode to the cooling only temporary operation mode. After the control in step S504-(1), the processing proceeds to step S504-(2).

(Step S504-(2))

The controller 51 (four-way valve switching reduction means 50) determines whether the amount of time having elapsed from the switching to the cooling only temporary operation mode is equal to or larger than a predetermined amount of time. As illustrated in FIG. 14, an example of the predetermined amount of time may be 30 minutes or more.

When it is determined that the amount of time having elapsed is equal to or larger than the predetermined amount of time (YES), the processing proceeds to step S505.

When it is determined that the amount of time having elapsed is not equal to or larger than the predetermined amount of time (NO), step S504-(2) is executed again.

(Step S505)

The controller 51 (four-way valve switching reduction means 50) determines whether the detection result Tb by the heat medium temperature difference calculating means 45 is smaller than the predetermined temperature difference T10.

When it is determined that the detection result Tb is smaller than the predetermined temperature difference T10 (YES), step S505 is executed again. The reason why step S505 is executed again is that because the detection result Tb is smaller than the predetermined temperature difference T10 the capability of the cooling operation in cooling only temporary operation mode is sufficient.

When it is determined that the detection result Tb is not smaller than the predetermined temperature difference T10 (NO), the processing proceeds to step S506. The reason why the processing proceeds to step S506 is that because the detection result Tb is not smaller than the predetermined temperature difference T10 the capability of the cooling operation in cooling only temporary operation mode is not sufficient.

An example of the predetermined temperature difference T10 may be 5 degrees C.

In the controller 51, the first criterion value for use in comparison with the detection result Tb by the heat medium temperature difference calculating means 45 is set in advance. In this step S505, determination whether the difference between the detection result Tb and the first criterion value is smaller than the predetermined temperature difference T10 enables the operation capability of the air-conditioning apparatus according to Embodiment 4 to be determined.

The first criterion value is set on the condition that the quantity of water supplied to the indoor unit 3 is constant. It is merely required that the excess or deficiency of the operation capability of the air-conditioning apparatus according to Embodiment 4 can be determined. If the quantity of water supplied to the indoor unit 3 is made to vary, the above-described first criterion value may not be used.

(Step S506)

The controller 51 (four-way valve switching reduction means 50) switches the operation mode to the cooling only operation mode.

(Step S510)

The controller 51 (four-way valve switching reduction means 50) determines whether the operation mode is the heating only temporary operation mode (corresponding to pattern No. 5 in FIG. 13).

When it is determined that the operation mode is the heating only temporary operation mode (YES), the processing proceeds to step S511.

When it is determined that the operation mode is not the heating only temporary operation mode (NO), the processing proceeds to step S510-(1).

(Step S510-(1))

The controller 51 (four-way valve switching reduction means 50) switches the operation mode to the heating only temporary operation mode. After the control in step S510-(1), the processing proceeds to step S510-(2).

(Step S510-(2))

The controller 51 (four-way valve switching reduction means 50) determines whether the amount of time having elapsed from the switching to the heating only temporary operation mode is equal to or larger than a predetermined amount of time. As illustrated in FIG. 14, an example of the predetermined amount of time may be 30 minutes or more.

When it is determined that the amount of time having elapsed is equal to or larger than the predetermined amount of time (YES), the processing proceeds to step S511.

When it is determined that the amount of time having elapsed is not equal to or larger than the predetermined amount of time (NO), step S510-(2) is executed again.

(Step S511)

The controller 51 (four-way valve switching reduction means 50) determines whether the detection result Tb by the heat medium temperature difference calculating means 45 is smaller than the predetermined temperature difference T10.

When it is determined that the detection result Tb is smaller than the predetermined temperature difference T10 (YES), step S511 is executed again. The reason why step S511 is executed again is that because the detection result Tb is smaller than the predetermined temperature difference T10 the capability of the heating operation in heating only temporary operation mode is sufficient.

When it is determined that the detection result Tb is not smaller than the predetermined temperature difference T10 (NO), the processing proceeds to step S512. The reason why the processing proceeds to step S512 is that because the detection result Tb is not smaller than the predetermined temperature difference T10 the capability of the heating operation in heating only temporary operation mode is not sufficient.

An example of the predetermined temperature difference T10 may be 5 degrees C.

In the controller 51, the second criterion value for use in comparison with the detection result Tb by the heat medium temperature difference calculating means 45 is set in advance. In this step S511, determination whether the difference between the detection result Tb and the second criterion value is smaller than the predetermined temperature difference T10 enables the operation capability of the air-conditioning apparatus according to Embodiment 4 to be determined.

The second criterion value is set on the condition that the quantity of water supplied to the indoor unit 3 is constant. It is merely required that the excess or deficiency of the operation capability of the air-conditioning apparatus according to Embodiment 4 can be determined. If the quantity of water supplied to the indoor unit 3 is made to vary, the above-described second criterion value may not be used.

(Step S512)

The controller 51 (four-way valve switching reduction means 50) switches the operation mode to the heating only operation mode.

[Advantageous Effects of Air-Conditioning Apparatus According to Embodiment 4]

The air-conditioning apparatus according to Embodiment 4 omits the control based on an outdoor space temperature in the air-conditioning apparatus 100 according to Embodiment 1 (see step S204 and step S210 in FIG. 8) and can reduce the frequency of switching the second refrigerant flow switching device 28 by always switching the operation mode to the heating only temporary operation mode in shifting from the cooling main operation mode to the cooling only operation mode (or always switching the operation mode to the heating only temporary operation mode in shifting from the heating main operation mode to the heating only operation mode).

The air-conditioning apparatus according to Embodiment 4 switches the operation mode from the cooling main operation mode (pattern No. 3 in FIG. 13) to the cooling only operation mode (pattern No. 1 in FIG. 13) and from the heating main operation mode (pattern No. 4 in FIG. 13) to the heating only operation mode (pattern No. 6 in FIG. 13) after detecting that the capacity is insufficient. However, when the frequency of switching the operation mode between the cooling only operation mode (pattern No. 1 in FIG. 13) and the cooling main operation mode (pattern No. 3 in FIG. 13) is high when the frequency of switching the operation mode between the heating main operation mode (pattern No. 4 in FIG. 13) and the heating only operation mode (pattern No. 6 in FIG. 13) is high, the air-conditioning apparatus according to Embodiment 4 has substantially the same advantageous effects as those of the air-conditioning apparatus 100 according to Embodiment 1.

Embodiment 5

Figure 16:
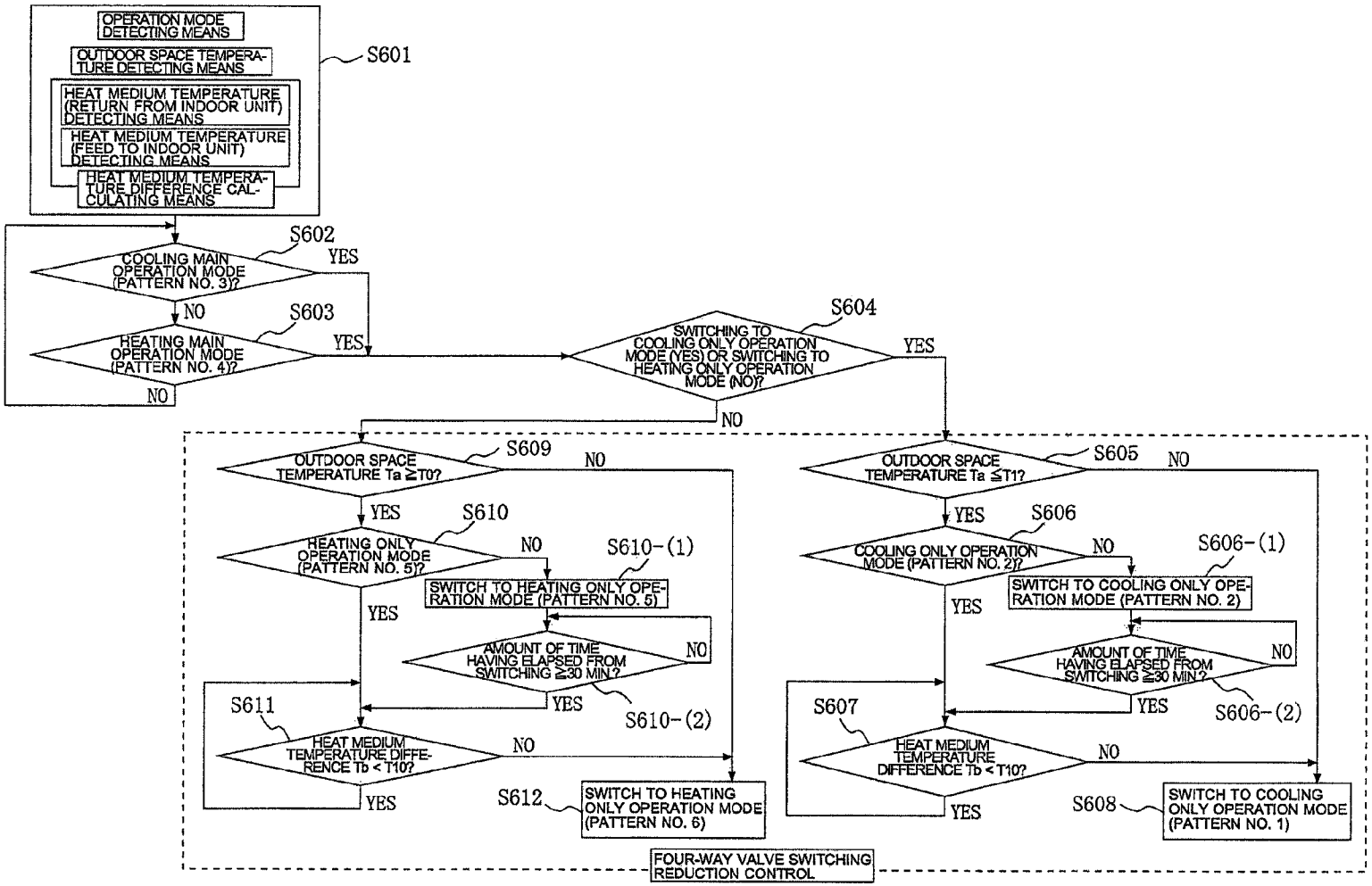
FIG. 16 is a flowchart that describes control for reducing the number of switching the second refrigerant flow switching device in the air-conditioning apparatus according to Embodiment 5 of the present invention.

FIG. 15 is a table that describes switching of the second refrigerant flow switching device 28 and the opening degree of the expansion device 26 for each operation mode in the air-conditioning apparatus according to Embodiment 5. FIG. 16 is a flowchart that describes control for reducing the number of switching the second refrigerant flow switching device 28 in the air-conditioning apparatus according to Embodiment 5.

In Embodiment 5, differences from Embodiments 1 to 4 described above are mainly described, and the same parts as in Embodiments 1 to 4 have the same reference numerals. The configuration of the refrigerant circuit and operation mode of the air-conditioning apparatus according to Embodiment 5 are substantially the same as those of the air-conditioning apparatus 100 according to Embodiment 1.

In the flowchart in FIG. 16 according to Embodiment 5, step of determining whether switching to the cooling only operation mode (or cooling only temporary operation mode) or switching to the heating only operation mode (or heating only temporary operation mode) has been done is added between step S202 and step S204 in Embodiment 1. That is, the cooling main operation mode may be shifted to a mode other than the "cooling only operation mode or cooling only temporary operation mode," and step of determining whether the cooling main operation mode is to be shifted to the "heating only operation mode or heating only temporary operation mode" is added.

Step that is the same as the above-described step is also added between step S203 and step S210 in Embodiment 1. "Switching" in this step may be set by a user, for example.

(Step S601)

The controller 51 (four-way valve switching reduction means 50) receives a result of detection by the operation mode detecting means 41 (information indicating the operation mode of the indoor unit 3, the operation load, and the operation mode of the outdoor unit 1), a result of detection by the outdoor space temperature detecting means 42, and a result of calculation by the heat medium temperature difference calculating means 45. If the operation mode is switched, the controller 51 also receives information corresponding to the time elapsed from this switching.

(Step S602)

The controller 51 (four-way valve switching reduction means 50) determines whether the operation mode is the cooling main operation mode (corresponding to pattern No. 3 in FIG. 15).

When it is determined that the operation mode is the cooling main operation mode (YES), the processing proceeds to step S604.

When it is determined that the operation mode is not the cooling main operation mode (NO), the processing proceeds to step S603.

(Step S603)

The controller 51 (four-way valve switching reduction means 50) determines whether the operation mode is the heating main operation mode (corresponding to pattern No. 4 in FIG. 15).

When it is determined that the operation mode is the heating main operation mode (YES), the processing proceeds to step S604.

When it is determined that the operation mode is not the heating main operation mode (NO), the processing returns to step S602.

(Step S604)

The controller 51 (four-way valve switching reduction means 50) determines whether switching for executing the "cooling only operation mode or cooling only temporary operation mode" (corresponding to patterns Nos. 1 and 2 in FIG. 15) has been done. In this step S604, the controller 51 determines whether the "cooling only operation mode or cooling only temporary operation mode" is to be executed or the "heating only operation mode or heating only temporary operation mode" is to be executed in accordance with an air conditioning load that is occurring in an indoor unit 3 that continues its operation among air conditioning loads occurring in the indoor units 3*a* to 3*d*. That is, both in cooling main operation mode and in heating main operation mode, the controller 51 determines whether the "cooling only operation mode or cooling only temporary operation mode" is to be executed preferentially or the "heating only operation mode or heating only temporary operation mode" is to be executed preferentially in accordance with the air conditioning loads in the indoor units 3*a* to 3*d* at the present time.

This enables the cooling main operation mode to be shifted to the heating only operation mode even if the operation of the indoor unit 3*a* stops in cooling main operation mode in which a large cooling load is occurring in the indoor unit 3*a* and a small heating load is occurring in each of the indoor units 3*b* to 3*d*.

When the controller 51 determines that the switching has been done (YES), the processing proceeds to step S605.

When the controller 51 determines that the switching has not been done (switching for executing the "heating only operation mode or heating only temporary operation mode" has been done) (NO), the processing proceeds to step S609.

(Step S605)

The controller 51 (four-way valve switching reduction means 50) determines whether the detection result Ta by the outdoor space temperature detecting means 42 is at or below the predetermined temperature T1.

When it is determined that the detection result Ta is at or below the predetermined temperature T1 (YES), the processing proceeds to step S606. The reason why the processing proceeds to step S606 is that because the outside of a room is not so hot the cooling capacity required by the indoor unit 3 can be provided by the cooling only temporary operation mode.

When it is determined that the detection result Ta is not at or below the predetermined temperature T1 (NO), the processing proceeds to step S608. The reason why the processing proceeds to step S608 is that because the outside of a room is hot the cooling capacity required by the indoor unit 3 cannot be provided by the cooling only temporary operation mode.

An example of the predetermined temperature T1 may be 28 degrees C.

(Step S606)

The controller 51 (four-way valve switching reduction means 50) determines whether the operation mode is the cooling only temporary operation mode (corresponding to pattern No. 2 in FIG. 15).

When it is determined that the operation mode is the cooling only temporary operation mode (YES), the processing proceeds to step S607.

When it is determined that the operation mode is not the cooling only temporary operation mode (NO), the processing proceeds to step S606-(1).

(Step S606-(1))

The controller 51 (four-way valve switching reduction means 50) switches the operation mode to the cooling only temporary operation mode. After the control in step S606-(1), the processing proceeds to step S606-(2).

(Step S606-(2))

The controller 51 (four-way valve switching reduction means 50) determines whether the amount of time having elapsed from the switching to the cooling only temporary operation mode is equal to or larger than a predetermined amount of time. As illustrated in FIG. 16, an example of the predetermined amount of time may be 30 minutes or more.

When it is determined that the amount of time having elapsed is equal to or larger than the predetermined amount of time (YES), the processing proceeds to step S607.

When it is determined that the amount of time having elapsed is not equal to or larger than the predetermined amount of time (NO), step S606-(2) is executed again.

(Step S607)

The controller 51 (four-way valve switching reduction means 50) determines whether the detection result Tb by the heat medium temperature difference calculating means 45 is smaller than a predetermined temperature difference T10.

When it is determined that the detection result Tb is smaller than the predetermined temperature difference T10 (YES), step S607 is executed again. The reason why step S607 is executed again is that because the detection result Tb is smaller than the predetermined temperature difference T10 the capability of the cooling operation in cooling only temporary operation mode is sufficient.

When it is determined that the detection result Tb is not smaller than the predetermined temperature difference T10 (NO), the processing proceeds to step S608. The reason why the processing proceeds to step S608 is that because the detection result Tb is not smaller than the predetermined temperature difference T10 the capability of the cooling operation in cooling only temporary operation mode is not sufficient.

An example of the predetermined temperature difference T10 may be 5 degrees C.

In the controller 51, the first criterion value for use in comparison with the detection result Tb by the heat medium temperature difference calculating means 45 is set in advance. In this step S607, determination whether the difference between the detection result Tb and the first criterion value is smaller than the predetermined temperature difference T10 enables the operation capability of the air-conditioning apparatus 100 to be determined.

The first criterion value is set on the condition that the quantity of water supplied to the indoor unit 3 is constant. It is merely required that the excess or deficiency of the operation capability of the air-conditioning apparatus 100 can be determined. If the quantity of water supplied to the indoor unit 3 is made to vary, the above-described first criterion value may not be used.

(Step S608)

The controller 51 (four-way valve switching reduction means 50) switches the operation mode to the cooling only operation mode.

(Step S609)

The controller 51 (four-way valve switching reduction means 50) determines whether the detection result Ta by the outdoor space temperature detecting means 42 is at or above the predetermined temperature T0.

When it is determined that the detection result Ta is at or above the predetermined temperature T0 (YES), the processing proceeds to step S610. The reason why the processing proceeds to step S610 is that because the outside of a room is not so cold the heating capacity required by the indoor unit 3 can be provided by the heating only temporary operation mode.

When it is determined that the detection result Ta is not at or above the predetermined temperature T0 (NO), the processing proceeds to step S612. The reason why the processing proceeds to step S612 is that because the outside of a room is cold the heating capacity cannot be provided by the heating only temporary operation mode.

An example of the predetermined temperature T0 may be −5 degrees C.

(Step S610)

The controller 51 (four-way valve switching reduction means 50) determines whether the operation mode is the heating only temporary operation mode (corresponding to pattern No. 5 in FIG. 15).

When it is determined that the operation mode is the heating only temporary operation mode (YES), the processing proceeds to step S611.

When it is determined that the operation mode is not the heating only temporary operation mode (NO), the processing proceeds to step S610-(1).

(Step S610-(1))

The controller 51 (four-way valve switching reduction means 50) switches the operation mode to the heating only temporary operation mode. After the control in step S610-(1), the processing proceeds to step S610-(2).

(Step S610-(2))

The controller 51 (four-way valve switching reduction means 50) determines whether the amount of time having elapsed from the switching to the heating only temporary operation mode is equal to or larger than a predetermined amount of time. As illustrated in FIG. 16, an example of the predetermined amount of time may be 30 minutes or more.

When it is determined that the amount of time having elapsed is equal to or larger than the predetermined amount of time (YES), the processing proceeds to step S611.

When it is determined that the amount of time having elapsed is not equal to or larger than the predetermined amount of time (NO), step S610-(2) is executed again.

(Step S611)

The controller 51 (four-way valve switching reduction means 50) determines whether the detection result Tb by the heat medium temperature difference calculating means 45 is smaller than the predetermined temperature difference T10.

When it is determined that the detection result Tb is smaller than the predetermined temperature difference T10 (YES), step S611 is executed again. The reason why step S611 is executed again is that because the detection result Tb is smaller than the predetermined temperature difference T10 the capability of the heating operation in heating only temporary operation mode is sufficient.

When it is determined that the detection result Tb is not smaller than the predetermined temperature difference T10 (NO), the processing proceeds to step S612. The reason why the processing proceeds to step S612 is that because the detection result Tb is not smaller than the predetermined temperature difference T10 the capability of the heating operation in heating only temporary operation mode is not sufficient.

An example of the predetermined temperature difference T10 may be 5 degrees C.

In the controller 51, the second criterion value for use in comparison with the detection result Tb by the heat medium temperature difference calculating means 45 is set in advance. In this step S611, determination whether the difference between the detection result Tb and the second criterion value is smaller than the predetermined temperature difference T10 enables the operation capability of the air-conditioning apparatus 100 to be determined.

The second criterion value is set on the condition that the quantity of water supplied to the indoor unit 3 is constant. It is merely required that the excess or deficiency of the operation capability of the air-conditioning apparatus 100 can be determined. If the quantity of water supplied to the indoor unit 3 is made to vary, the above-described second criterion value may not be used.

(Step S612)

The controller 51 (four-way valve switching reduction means 50) switches the operation mode to the heating only operation mode.

[Advantageous Effects of Air-Conditioning Apparatus According to Embodiment 5]

For the air-conditioning apparatus according to Embodiment 5, in addition to the control based on an outdoor space temperature in the air-conditioning apparatus 100 according to Embodiment 1, step S604 of determining whether switching for executing the "cooling only operation mode or cooling only temporary operation mode" or switching for executing the "heating only operation mode or heating only temporary operation mode" has been done is added. The air-conditioning apparatus according to Embodiment 5 has substantially the same advantageous effects as those of the air-conditioning apparatus 100 according to Embodiment 1.

Embodiment 5 is described on the basis of Embodiment 1. When the above-described step is added in any one of Embodiments 2 to 4, substantially the same advantageous effects are obtainable.

The air-conditioning apparatus 100 according to Embodiments 1 to 5 is the configuration in which the relay unit 2 and the indoor unit 3 are connected by the heat medium pipes 5 and is not the configuration in which the outdoor unit 1 and the indoor unit 3 are connected by the heat medium pipes 5. That is, because the outdoor unit 1 and the relay unit 2 are not connected by the heat medium pipe, the entire length of the heat medium pipes 5 can be shortened correspondingly. The distance of transporting the heat medium, which has a relatively low transport efficiency in comparison with the heat source side refrigerant, can be shortened, and thus energy saving can be achieved.

In the air-conditioning apparatus 100, the number of the pipes connecting the outdoor unit 1 and the relay unit 2 is two. The number of the pipes connecting the relay unit 2 and the indoor unit 3 is the value obtained by multiplying the number of the indoor units 3 by two. In this manner, because the number of the pipes connecting the outdoor unit 1 and the relay unit 2 (refrigerant pipes 4) and the number of the pipes connecting the relay unit 2 and the indoor unit 3 (heat medium pipes 5) are small, it is easy to construct the pipes correspondingly. That is, the construction work of the air-conditioning apparatus 100 is facilitated.

The air-conditioning apparatus 100 is not the configuration in which the pumps 31*a* and 31*b* for transporting the heat medium are mounted for each of the indoor units 3*a* to 3*d*. That is, because the number of pumps in the air-conditioning apparatus 100 is two, a cost increase and sounds occurring in the pumps can be suppressed.

In addition, the air-conditioning apparatus 100 is not the configuration in which the refrigerant pipes 4 are disposed in the vicinity of the indoor unit 3. Thus leakage of the heat source side refrigerant to the inside of a room or to the vicinity of the inside of a room can be reduced.

The invention claimed is:

1. An air-conditioning apparatus comprising:

an outdoor unit including a compressor, a first refrigerant flow switching device, and a heat source side heat exchanger;

a relay unit including a plurality of intermediate heat exchangers, a plurality of expansion devices, and a plurality of second refrigerant flow switching devices; and at least one indoor unit including a use side heat exchanger, wherein the compressor, the first refrigerant flow switching device, the expansion devices, the second refrigerant flow switching devices, and the intermediate heat exchangers are connected by a refrigerant pipe to form a refrigeration cycle through which a refrigerant circulates, the intermediate heat exchangers and the use side heat exchanger are connected by a heat medium pipe to form a heat medium circulation circuit through which a heat medium different from the refrigerant circulates, the air-conditioning apparatus switches the second refrigerant flow switching devices corresponding to the intermediate heat exchangers and causes each of the intermediate heat exchangers to function as a condenser or an evaporator, and the air-conditioning apparatus has a heating only operation mode in which all the intermediate heat exchangers function as condensers, a heating main operation mode in which at least one of the intermediate heat exchangers functions as the condenser, at least one thereof functions as the evaporator, and a heating load is larger than a cooling load, a heating only temporary operation mode in which, in changing from the heating main operation mode to the heating only operation mode, when an outside air temperature is at or above a predetermined temperature, at least one of the intermediate heat exchangers functioning as the condenser in the heating main operation mode continues functioning as the condenser, and the refrigerant is not supplied to the intermediate heat exchanger functioning as the evaporator in the heating main operation mode, a cooling only operation mode in which all the intermediate heat exchangers function as evaporators, a cooling main operation mode in which at least one of the intermediate heat exchangers functions as evaporator, at least one thereof functions as the condenser, and the cooling load is larger than the heating load, a cooling only temporary operation mode in which, in changing from the cooling main operation mode to the cooling only operation mode, when the outside air temperature is at or below a predetermined temperature, at least one of the intermediate heat exchangers functioning as the evaporator in the cooling main operation mode continues functioning as the evaporator, and the refrigerant is not supplied to the intermediate heat exchanger functioning as the condenser in the cooling main operation mode, the air conditioning apparatus further comprising an operation mode controller that detects whether an operation mode is the heating only operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, the operation mode controller changes the operation mode set in the operation mode controller from the heating main operation mode to the heating only temporary operation mode, and in changing from the cooling main operation mode to the cooling only operation mode, when the operation mode controller detects that the operation mode is the cooling only operation mode, the operation mode controller changes the operation mode set in the operation mode controller from the cooling main operation mode to the cooling only temporary operation mode.

2. The air-conditioning apparatus of claim 1, wherein, after a predetermined amount of time has elapsed since an operation starts in the cooling only temporary operation mode, when a difference between a temperature of the heat medium at an inlet side of the use side heat exchanger and that at an outlet side thereof is at or above a predetermined value, one of the second refrigerant flow switching devices corresponding to the intermediate heat exchanger used for heating in the cooling main operation mode is switched, and the operation is changed to the cooling only operation mode.

3. The air-conditioning apparatus of claim 1, wherein, after a predetermined amount of time has elapsed since an operation starts in the heating only temporary operation mode, when a difference between a temperature of the heat medium at an inlet side of the use side heat exchanger and that at an outlet side thereof is at or above a predetermined value, one of the second refrigerant flow switching devices corresponding to the intermediate heat exchanger used for cooling in the heating main operation mode is switched, and the operation is changed to the heating only operation mode.

4. The air-conditioning apparatus of claim 1, further comprising outside air temperature detector for detecting the outside air temperature, the outside air temperature detector being disposed in the outdoor unit.

5. The air-conditioning apparatus of claim 1, further comprising:

heat medium temperature detector for detecting the temperature of the heat medium at each of the inlet side and the outlet side of the use side heat exchanger; and a controller configured to calculate the difference between the temperature of the heat medium at the inlet side and that at the outlet side on the basis of a result of detection by the heat medium temperature detector.

6. An air-conditioning apparatus comprising:

an outdoor unit including a compressor, a first refrigerant flow switching device, and a heat source side heat exchanger;

a relay unit including a plurality of intermediate heat exchangers, a plurality of expansion devices, and a plurality of second refrigerant flow switching devices; and at least one indoor unit including a use side heat exchanger, wherein the compressor, the first refrigerant flow switching device, the expansion devices, the second refrigerant flow switching devices, and the intermediate heat exchangers are connected by a refrigerant pipe to form a refrigeration cycle through which a refrigerant circulates, the intermediate heat exchangers and the use side heat exchanger are connected by a heat medium pipe to form a heat medium circulation circuit through which a heat medium different from the refrigerant circulates, the air-conditioning apparatus switches the second refrigerant flow switching devices corresponding to the intermediate heat exchangers and causes each of the intermediate heat exchangers to function as a condenser or an evaporator, and the air-conditioning apparatus has a heating only operation mode in which all the intermediate heat exchangers function as condensers, a heating main operation mode in which at least one of the intermediate heat exchangers functions as the condenser, at least one thereof functions as the evaporator, and a heating load is larger than a cooling load, a heating only temporary operation mode in which, in changing from the heating main operation mode to the heating only operation mode, when a total capacity of heating operation capacities of the at least one indoor unit is at or below a predetermined capacity, at least one of the intermediate heat exchangers functioning as the condenser in the heating main operation mode continues functioning as the condenser, and the refrigerant is not supplied to the intermediate heat exchanger functioning as the evaporator in the heating main operation mode, a cooling only operation mode in which all the intermediate heat exchangers function as evaporators, a cooling main operation mode in which at least one of the intermediate heat exchangers functions as the evaporator, at least one thereof functions as the condenser, and the cooling load is larger than the heating load, and a cooling only temporary operation mode in which, in changing from the cooling main operation mode to the cooling only operation mode, when a total capacity of cooling operation capacities of the at least one indoor unit is at or below a predetermined capacity, at least one of the intermediate heat exchangers functioning as the evaporator in the cooling main operation mode continues functioning as the evaporator, and the refrigerant is not supplied to the intermediate heat exchanger functioning as the condenser in the cooling main operation mode, the air conditioning apparatus further comprising an operation mode controller that detects whether an operation mode is the heating operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, in accordance with the air conditioning load of the indoor unit that continues its operation, the operation mode controller changes the operation mode set in the operation mode controller from the heating main operation mode to the heating only temporary operation mode of to the heating only operation mode or changes from the heating main operation mode to the cooling only temporary operation mode or to the cooling only operation mode, and in changing from the cooling main operation mode to the cooling only operation mode, when the operation mode controller detects that the operation mode is the cooling only operation mode, in accordance with the air conditioning load of the indoor unit the continues its operation, the operation mode controller changes the operation mode set in the operation mode controller from the cooling main operation mode to the cooling only temporary operation mode or to the cooling only operation mode or changed from the cooling main operation mode to the heating only temporary operation mode or to the heating only operation mode.

7. The air-conditioning apparatus of claim 6, wherein, after a predetermined amount of time has elapsed since an operation starts in the cooling only temporary operation mode, when a difference between a temperature of the heat medium at an inlet side of the use side heat exchanger and that at an outlet side thereof is at or above a predetermined value, the second refrigerant flow switching device corresponding to the intermediate heat exchanger used for heating in the cooling main operation mode is switched, and the operation is changed to the cooling only operation mode.

8. The air-conditioning apparatus of claim 6, wherein, after a predetermined amount of time has elapsed since an operation starts in the heating only temporary operation mode, when a difference between a temperature of the heat medium at an inlet side of the use side heat exchanger and that at an outlet side thereof is at or above a predetermined value, the second refrigerant flow switching device corresponding to the intermediate heat exchanger used for cooling in the heating main operation mode is switched, and the operation is changed to the heating only operation mode.

9. The air-conditioning apparatus of claim 6, further comprising the operation mode controller that detects whether an operation mode is the heating operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, the operation mode controller changes the operation mode set in the operation mode controller from the heating main operation mode to the heating only temporary operation mode, and in changing from the cooling main operation mode to the cooling only operation mode, when the operation mode controller detects that the operation mode is the cooling only operation mode, the operation mode controller changes the operation mode set in the operation mode controller from the cooling main operation mode to the cooling only temporary operation mode.

10. The air-conditioning apparatus of claim 6, further comprising outside air temperature detector that detects the outside air temperature, the outside air temperature being disposed in the outdoor unit.

11. The air-conditioning apparatus of claim 10, further comprising:

heat medium temperature detector that detects the temperature of the heat medium at each of the inlet side and the outlet side of the use side heat exchanger; and a controller configured to calculate the difference between the temperature of the heat medium at the inlet side and that at the outlet side on the basis of a result of detection by the heat medium temperature.

12. An air-conditioning apparatus comprising:

an outdoor unit including a compressor, a first refrigerant flow switching device, and a heat source side heat exchanger;

a relay unit including a plurality of intermediate heat exchangers, a plurality of expansion devices, and a plurality of second refrigerant flow switching devices; and at least one indoor unit including a use side heat exchanger, wherein the compressor, the first refrigerant flow switching device, the expansion devices, the second refrigerant flow switching devices, and the intermediate heat exchangers are connected by a refrigerant pipe to form a refrigeration cycle through which a refrigerant circulates, the intermediate heat exchangers and the use side heat exchanger are connected by a heat medium pipe to form a heat medium circulation circuit through which a heat medium different from the refrigerant circulates, the air-conditioning apparatus switches the second refrigerant flow switching devices corresponding to the intermediate heat exchangers and causes each of the intermediate heat exchangers to function as a condenser or an evaporator, and the air-conditioning apparatus has a heating only operation mode in which all the intermediate heat exchangers function as condensers, a heating main operation mode in which at least one of the intermediate heat exchangers functions as condenser, at least one thereof functions as the evaporator, and a heating load is larger than a cooling load, a heating only temporary operation mode in which, in changing from the heating main operation mode to the heating only operation mode, when an outside air temperature is at or above a predetermined temperature or when the outside air temperature is below the predetermined temperature and a total capacity of a heating operation capacities of the at least one indoor unit is at or below a predetermined capacity, the at least one of the intermediate heat exchangers functioning as the condenser in the heating main operation mode continues functioning as the condenser, and the refrigerant is not supplied to the intermediate heat exchanger functioning as the evaporator in the heating main operation mode, a cooling only operation mode in which all the intermediate heat exchangers function as evaporators, a cooling main operation mode in which at least one of the intermediate heat exchangers functions as the evaporator, at least one thereof functions as the condenser, and the cooling load is larger than the heating load, and a cooling only temporary operation mode in which, in changing from the cooling main operation mode to the cooling only operation mode, when the outside air temperature is at or below a predetermined temperature or when the outside air temperature is above the predetermined temperature and a total capacity of cooling operation capacities of the at least one indoor unit is at or below a predetermined capacity, the at least one of the intermediate heat exchangers functioning as the evaporator in the cooling main operation mode continues functioning as the evaporator, and the refrigerant is not supplied to the intermediate heat exchanger functioning as the condenser in the cooling main operation mode, the air conditioning apparatus further comprising an operation mode controller that detects whether an operation mode is the heating operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, in accordance with the air conditioning load of the indoor unit that continues its operation, the operation mode controller changes the operation mode set in the operation mode controller from the heating main operation mode to the heating only temporary operation mode or to the heating only operation mode or changed from the heating main operation mode to the cooling only temporary operation mode or to the cooling only operation mode, and in changing from the cooling main operation mode to the cooling only operation mode, when the operation mode controller detects that the operation mode is the cooling only operation mode, in accordance with the air conditioning load of the indoor unit that continues its operation, the operation mode controller changes the operation mode set in the operation mode controller from the cooling main operation mode to the cooling only temporary operation mode or to the cooling only operation mode or changed from the cooling main operation mode to the heating only temporary operation mode or to the heating only operation mode.

13. The air-conditioning apparatus of claim 12, wherein, after a predetermined amount of time has elapsed since an operation starts in the cooling only temporary operation mode, when a difference between a temperature of the heat medium at an inlet side of the use side heat exchanger and that at an outlet side thereof is at or above a predetermined value, the second refrigerant flow switching device corresponding to the intermediate heat exchanger used for heating in the cooling main operation mode is switched, and the operation is changed to the cooling only operation mode.

14. The air-conditioning apparatus of claim 12, wherein, after a predetermined amount of time has elapsed since an operation starts in the heating only temporary operation mode, when a difference between a temperature of the heat medium at an inlet side of the use side heat exchanger and that at an outlet side thereof is at or above a predetermined value, the second refrigerant flow switching device corresponding to the intermediate heat exchanger used for cooling in the heating main operation mode is switched, and the operation is changed to the heating only operation mode.

15. The air-conditioning apparatus of claim 12, further comprising the operation mode controller that detects whether an operation mode is the heating operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, the operation mode controller changes the operation mode set in the operation mode controller from the heating main operation mode to the heating only temporary operation mode, and in changing from the cooling main operation mode to the cooling only operation mode, when the operation mode controller detects that the operation mode is the cooling only operation mode, the operation mode controller changes the operation mode set in the operation mode controller from the cooling main operation mode to the cooling only temporary operation mode.

16. The air-conditioning apparatus of claim 12, further comprising outside air temperature detector that detects the outside air temperature, the outside air temperature detector being disposed in the outdoor unit.

17. The air-conditioning apparatus of claim 16, further comprising:

heat medium temperature detector that detects the temperature of the heat medium at each of the inlet side and the outlet side of the use side heat exchanger; and a controller configured to calculate the difference between the temperature of the heat medium at the inlet side and that at the outlet side on the basis of a result of detection by the heat medium temperature detector.

18. An air-conditioning apparatus comprising:

an outdoor unit including a compressor, a first refrigerant flow switching device, and a heat source side heat exchanger;

a relay unit including a plurality of intermediate heat exchangers, a plurality of expansion devices, and a plurality of second refrigerant flow switching devices; and at least one indoor unit including a use side heat exchanger, wherein the compressor, the first refrigerant flow switching device, the expansion devices, the second refrigerant flow switching devices, and the intermediate heat exchangers are connected by a refrigerant pipe to form a refrigeration cycle through which a refrigerant circulates, the intermediate heat exchangers and the use side heat exchanger are connected by a heat medium pipe to form a heat medium circulation circuit through which a heat medium different from the refrigerant circulates, the air-conditioning apparatus switches the second refrigerant flow switching devices corresponding to the intermediate heat exchangers and causes each of the intermediate heat exchangers to function as a condenser or an evaporator, and the air-conditioning apparatus has a heating main operation mode in which at least one of the intermediate heat exchangers functions as the condenser, at least one thereof functions as the evaporator, and a heating load is larger than a cooling load, a heating only temporary operation mode switched from the heating main operation mode, the heating only temporary operation mode in which the at least one of the intermediate heat exchangers functioning as the condenser in the heating main operation mode continues functioning as the condenser, and the refrigerant is not supplied to the intermediate heat exchanger functioning as the evaporator in the heating main operation mode, a heating only operation mode switched from the heating only temporary operation mode, the heating only operation mode in which all the intermediate heat exchangers function as condensers, a cooling main operation mode in which at least one of the intermediate heat exchangers functions as the evaporator, at least one thereof functions as the condenser, and the cooling load is larger than the heating load, a cooling only temporary operation mode switched from the cooling main operation mode, the cooling only temporary operation mode in which the at least one of the intermediate heat exchangers functioning as the evaporator in the cooling main operation mode continues functioning as the evaporator, and the refrigerant is not supplied to the intermediate heat exchanger functioning as the condenser in the cooling main operation mode, and a cooling only operation mode switched from the cooling only temporary operation mode, the cooling only operation mode being in which all the intermediate heat exchangers function as evaporators, the air-conditioning apparatus further comprising an operation mode controller that detects whether an operation mode is the heating operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, the operation mode controller changes the operation mode set in the operation mode controller from the heating main operation mode to the heating only temporary operation mode, and in changing from the cooling main operation mode to the cooling only operation mode, when the operation mode controller detects that the operation mode is the cooling only operation mode, the operation mode controller changes the operation mode set in the operation mode controller from the cooling main operation mode to the cooling only temporary operation mode.

19. The air-conditioning apparatus of claim 18, wherein, after a predetermined amount of time has elapsed since an operation starts in the cooling only temporary operation mode, when a difference between a temperature of the heat medium at an inlet side of the use side heat exchanger and that at an outlet side thereof is at or above a predetermined value, the second refrigerant flow switching device corresponding to the intermediate heat exchanger used for heating in the cooling main operation mode is switched, and the operation is changed to the cooling only operation mode.

20. The air-conditioning apparatus of claim 18, wherein, after a predetermined amount of time has elapsed since an operation starts in the heating only temporary operation mode, when a difference between a temperature of the heat medium at an inlet side of the use side heat exchanger and that at an outlet side thereof is at or above a predetermined value, the second refrigerant flow switching device corresponding to the intermediate heat exchanger used for cooling in the heating main operation mode is switched, and the operation is changed to the heating only operation mode.

21. The air-conditioning apparatus of claim 18, further comprising outside air temperature detector that detects the outside air temperature, the outside air temperature detector being disposed in the outdoor unit.

22. The air-conditioning apparatus of claim 21, further comprising:

heat medium temperature detector that detects the temperature of the heat medium at each of the inlet side and the outlet side of the use side heat exchanger; and a controller configured to calculate the difference between the temperature of the heat medium at the inlet side and that at the outlet side on the basis of a result of detection by the heat medium temperature detector.

23. An air-conditioning apparatus comprising:

an outdoor unit including a compressor, a first refrigerant flow switching device, and a heat source side heat exchanger;

a relay unit including a plurality of intermediate heat exchangers, a plurality of expansion devices, and a plurality of second refrigerant flow switching devices; and at least one indoor unit including a use side heat exchanger, wherein the compressor, the first refrigerant flow switching device, the expansion devices, the second refrigerant flow switching devices, and the intermediate heat exchangers are connected by a refrigerant pipe to form a refrigeration cycle through which a refrigerant circulates, the intermediate heat exchangers and the use side heat exchanger are connected by a heat medium pipe to form a heat medium circulation circuit through which a heat medium different from the refrigerant circulates, the air-conditioning apparatus switches the second refrigerant flow switching devices corresponding to the intermediate heat exchangers and causes each of the intermediate heat exchangers to function as a condenser or an evaporator, and the air-conditioning apparatus has a heating only operation mode in which all the intermediate heat exchangers function as condensers, a heating main operation mode in which at least one of the intermediate heat exchangers functions as the condenser, at least one thereof functions as the evaporator, and a heating load is larger than a cooling load, a heating only temporary operation mode in which, in changing from the heating main operation mode to the heating only operation mode, when an outside air temperature is at or above a predetermined temperature, at least one of the intermediate heat exchangers functioning as the condenser in the heating main operation mode continues functioning as the condenser, and the refrigerant is not supplied to the intermediate heat exchanger functioning as the evaporator in the heating main operation mode, a cooling only operation mode in which all the intermediate heat exchangers function as evaporators, a cooling main operation mode in which at least one of the intermediate heat exchangers functions as evaporator, at least one thereof functions as the condenser, and the cooling load is larger than the heating load, a cooling only temporary operation mode in which, in changing from the cooling main operation mode to the cooling only operation mode, when the outside air temperature is at or below a predetermined temperature, at least one of the intermediate heat exchangers functioning as the evaporator in the cooling main operation mode continues functioning as the evaporator, and the refrigerant is not supplied to the intermediate heat exchanger functioning as the condenser in the cooling main operation mode, the air-conditioning apparatus further comprising an operation mode controller that detects whether an operation mode is the heating only operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, in accordance with the air conditioning load of the indoor unit that continues its operation, the operation mode controller changes the operation mode set in the operation mode controller from the heating main operation mode to the heating only temporary operation mode or to the heating only operation mode or changed from the heating main operation mode to the cooling only temporary operation mode or to the cooling only operation mode, and in changing from the cooling main operation mode to the cooling only operation mode, when the operation mode controller detects that the operation mode is the cooling only operation mode, in accordance with the air conditioning load of the indoor unit that continues its operation, the operation mode controller changes the operation mode set in the operation mode controller from the cooling main operation mode to the cooling only temporary operation mode or to the cooling only operation mode or changed from the cooling main operation mode to the heating only temporary operation mode or to the heating only operation mode.

24. An air-conditioning apparatus comprising:

an outdoor unit including a compressor, a first refrigerant flow switching device, and a heat source side heat exchanger;

a relay unit including a plurality of intermediate heat exchangers, a plurality of expansion devices, and a plurality of second refrigerant flow switching devices; and at least one indoor unit including a use side heat exchanger, wherein the compressor, the first refrigerant flow switching device, the expansion devices, the second refrigerant flow switching devices, and the intermediate heat exchangers are connected by a refrigerant pipe to form a refrigeration cycle through which a refrigerant circulates, the intermediate heat exchangers and the use side heat exchanger are connected by a heat medium pipe to form a heat medium circulation circuit through which a heat medium different from the refrigerant circulates, the air-conditioning apparatus switches the second refrigerant flow switching devices corresponding to the intermediate heat exchangers and causes each of the intermediate heat exchangers to function as a condenser or an evaporator, and the air-conditioning apparatus has a heating main operation mode in which at least one of the intermediate heat exchangers functions as the condenser, at least one thereof functions as the evaporator, and a heating load is larger than a cooling load, a heating only temporary operation mode switched from the heating main operation mode, the heating only temporary operation mode in which the at least one of the intermediate heat exchangers functioning as the condenser in the heating main operation mode continues functioning as the condenser, and the refrigerant is not supplied to the intermediate heat exchanger functioning as the evaporator in the heating main operation mode, a heating only operation mode switched from the heating only temporary operation mode, the heating only operation mode in which all the intermediate heat exchangers function as condensers, a cooling main operation mode in which at least one of the intermediate heat exchangers functions as the evaporator, at least one thereof functions as the condenser, and the cooling load is larger than the heating load, a cooling only temporary operation mode switched from the cooling main operation mode, the cooling only temporary operation mode in which the at least one of the intermediate heat exchangers functioning as the evaporator in the cooling main operation mode continues functioning as the evaporator, and the refrigerant is not supplied to the intermediate heat exchanger functioning as the condenser in the cooling main operation mode, a cooling only operation mode switched from the cooling only temporary operation mode, the cooling only operation mode being in which all the intermediate heat exchangers function as evaporators, the air-conditioning apparatus further comprising an operation mode controller that detects whether an operation mode is the heating operation mode, the heating main operation mode, the cooling only operation mode, and the cooling main operation mode on the basis of an operation of the indoor unit and an air conditioning load of the indoor unit, wherein in changing from the heating main operation mode to the heating only operation mode, when the operation mode controller detects that the operation mode is the heating only operation mode, in accordance with the air conditioning load of the indoor unit that continues its operation, the operation mode controller changes the operation mode set in the operation mode controller from the heating main operation mode to the heating only temporary operation mode or to the heating only operation mode or changed from the heating main operation mode to the cooling only temporary operation mode or to the cooling only operation mode, and in changing from the cooling main operation mode to the cooling only operation mode, when the operation mode controller detects that the operation mode is the cooling only operation mode, in accordance with the air conditioning load of the indoor unit that continues its operation, the operation mode controller changes the operation mode set in the operation mode controller from the cooling main operation mode to the cooling only temporary operation mode or to the cooling only operation mode or changed from the cooling main operation mode to the heating only temporary operation mode or to the heating only operation mode.

25. An air-conditioning apparatus with multiple operational modes comprising:

an outdoor unit including a compressor, a first refrigerant flow switching device, and a heat source side heat exchanger;

a relay unit including a plurality of intermediate heat exchangers, a plurality of expansion devices, and a plurality of second refrigerant flow switching devices;

at least one indoor unit including a use side heat exchanger; and a controller configured to control the compressor, the first refrigerant flow switching device, the plurality of expansion devices, and the plurality of second refrigerant flow switching devices;

wherein the compressor, the first refrigerant flow switching device, the expansion devices, the second refrigerant flow switching devices, and the intermediate heat exchangers are connected by a refrigerant pipe to form a refrigeration cycle through which a refrigerant circulates, the intermediate heat exchangers and the use side heat exchanger are connected by a heat medium pipe to form a heat medium circulation circuit through which a heat medium different from the refrigerant circulates, and the controller switches the second refrigerant flow switching devices corresponding to the intermediate heat exchangers and causes each of the intermediate heat exchangers to function as a condenser or an evaporator, and wherein the controller is configured to operate in a heating main operation mode in which at least one of the intermediate heat exchangers functions as the condenser, at least one thereof functions as the evaporator, and a heating load is larger than a cooling load, a heating only temporary operation mode switched from the heating main operation mode, the heating only temporary operation mode in which the at least one of the intermediate heat exchangers functioning as the condenser in the heating main operation mode continues functioning as the condenser, and the refrigerant is not supplied to the intermediate heat exchanger functioning as the evaporator in the heating main operation mode, a heating only operation mode switched from the heating only temporary operation mode, the heating only operation mode in which all the intermediate heat exchangers function as condensers, a cooling main operation mode in which at least one of the intermediate heat exchangers functions as the evaporator, at least one thereof functions as the condenser, and the cooling load is larger than the heating load, a cooling only temporary operation mode switched from the cooling main operation mode, the cooling only temporary operation mode in which the at least one of the intermediate heat exchangers functioning as the evaporator in the cooling main operation mode continues functioning as the evaporator, and the refrigerant is not supplied to the intermediate heat exchanger functioning as the condenser in the cooling main operation mode, and a cooling only operation mode switched from the cooling only temporary operation mode, the cooling only operation mode being in which all the intermediate heat exchangers function as evaporators, wherein the controller is configured to control a switching state of the plurality of the second refrigerant flow switching devices in the cooling only temporary operation mode to be a same switching state in the cooling main operation mode, and the switching state of the plurality of the second refrigerant flow switching devices in the heating only temporary operation mode to be the same switching state in the heating main operation mode.

26. The air-conditioning apparatus with multiple operational modes of claim 25, wherein the controller is configured to switch the heating only temporary operation mode only from the heating main operation mode, and switch the cooling only temporary operation mode only from the cooling main operation mode.

* * * * *